US008763384B2

(12) United States Patent
Takagaki et al.

(10) Patent No.: US 8,763,384 B2
(45) Date of Patent: Jul. 1, 2014

(54) EXHAUST APPARATUS OF INTERNAL COMBUSTION ENGINE

(75) Inventors: Nakaya Takagaki, Toyota (JP); Kazutoshi Wakatsuki, Toyota (JP); Hideyuki Komitsu, Toyota (JP)

(73) Assignees: Toyota Jidosha Kabushiki Kaisha, Toyota (JP); Sango Co., Ltd., Aichi (JP)

( * ) Notice: Subject to any disclaimer, the term of this patent is extended or adjusted under 35 U.S.C. 154(b) by 69 days.

(21) Appl. No.: 13/499,151

(22) PCT Filed: Nov. 9, 2009

(86) PCT No.: PCT/JP2009/005945

§ 371 (c)(1), (2), (4) Date: Mar. 29, 2012

(87) PCT Pub. No.: WO2011/055415

PCT Pub. Date: May 12, 2011

(65) Prior Publication Data

US 2012/0180465 A1 Jul. 19, 2012

(51) Int. Cl.
*F01N 1/00* (2006.01)

(52) U.S. Cl.
USPC ..... 60/324; 60/322; 137/527.6; 181/207

(58) Field of Classification Search
USPC ..... 60/274–324; 137/520–527.8
See application file for complete search history.

(56) References Cited

U.S. PATENT DOCUMENTS

| | | | | |
|---|---|---|---|---|
| 4,645,031 | A * | 2/1987 | Omura et al. | 181/232 |
| 4,901,528 | A * | 2/1990 | Saigo et al. | 60/312 |
| 5,355,673 | A | 10/1994 | Sterling et al. | |
| 5,392,812 | A * | 2/1995 | Herron | 137/527.8 |
| 6,050,294 | A * | 4/2000 | Makowan | 137/527 |
| 6,527,006 | B2 * | 3/2003 | Jackson | 137/527.6 |
| 7,434,570 | B2 * | 10/2008 | Hill | 123/568.18 |
| 7,527,126 | B2 * | 5/2009 | Kuroda et al. | 181/254 |
| 8,201,401 | B2 * | 6/2012 | Abram et al. | 60/324 |
| 2005/0126850 | A1 | 6/2005 | Yamaguchi et al. | |

FOREIGN PATENT DOCUMENTS

| | | |
|---|---|---|
| JP | U-58-86431 | 6/1983 |
| JP | U-61-187914 | 11/1986 |
| JP | U-61-194726 | 12/1986 |
| JP | U-63-82022 | 5/1988 |
| JP | A-3-3912 | 1/1991 |
| JP | U-3-114513 | 11/1991 |
| JP | A-5-202729 | 8/1993 |

(Continued)

OTHER PUBLICATIONS

International Search Report issued in International Patent Application No. PCT/JP2009/005945 dated Feb. 2, 2010 (with translation).

*Primary Examiner* — Jesse Bogue
(74) *Attorney, Agent, or Firm* — Oliff PLC

(57) ABSTRACT

An exhaust gas apparatus of an internal combustion engine is capable of suppressing the sound pressure level from being increased by the air column resonance in the tail pipe. The exhaust gas apparatus being provided with an exhaust gas pipe at the downstream side of an internal combustion engine in the exhaust gas direction of an exhaust gas flow, the exhaust gas pipe having an upstream opening end at one end portion thereof and connected with a sound deadening device at the upstream side in the exhaust gas direction of the exhaust gas flow, and a downstream opening end at the other end portion thereof for exhausting the exhaust gas flow to the atmosphere.

23 Claims, 53 Drawing Sheets

(56) References Cited

FOREIGN PATENT DOCUMENTS

| | | |
|---|---|---|
| JP | A-5-202730 | 8/1993 |
| JP | U-6-40306 | 5/1994 |
| JP | U-3029656 | 10/1996 |
| JP | A-9-250330 | 9/1997 |
| JP | A-11-50863 | 2/1999 |
| JP | A-11-294136 | 10/1999 |
| JP | A-2005-171933 | 6/2005 |
| JP | A-2006-46121 | 2/2006 |
| JP | A-2007-205183 | 8/2007 |

* cited by examiner a OPENING IN IDLING STATE b OPENING IN RESONANCE STATE a OPENING IN IDLING STATE b OPENING IN RESONANCE STATE

EXHAUST APPARATUS OF INTERNAL COMBUSTION ENGINE

TECHNICAL FIELD

This invention relates to an exhaust apparatus of an internal combustion engine, and in particularly to an exhaust apparatus of an internal combustion engine for suppressing the increase of exhaust gas noises caused by an air column resonance of a tail pipe provided at the most downstream side in the discharging direction of an exhaust gas.

BACKGROUND ART

As an exhaust apparatus of an internal combustion engine to be used by an automotive vehicle, there has so far been known an exhaust apparatus as shown in FIG. 49 (for example see Patent Document 1). The known exhaust apparatus 4 is constructed in FIG. 49 to allow an exhaust gas to be introduced therein after the exhaust gas is exhausted from an engine 1 serving as an internal combustion engine and then passes through an exhaust manifold 2 and a catalytic converter 3 where the exhaust gas is purified.

The exhaust apparatus 4 is constituted by a front pipe 5 connected to the catalytic converter 3, a center pipe 6 connected to the front pipe 5, a main muffler 7 connected to the center pipe 6 and serving as a sound deadening device, a tail pipe 8 connected to the main muffler 7, and a sub-muffler 9 connected to the tail pipe 8.

The main muffler 7 has an expansion chamber for introducing therein and expanding the exhaust gas to mute the sound of the exhaust gas, and a resonance chamber for muting the sound of the exhaust gas having a specified frequency by Helmholtz resonator effect. More specifically, the resonance chamber is designed to enable its resonance frequency to be tuned to the low frequency side by increasing the volume of the resonance chamber or otherwise by lengthening the length of the center pipe 6 projecting into the resonance chamber, while enabling its resonance frequency to be tuned to the high frequency side by decreasing the volume of the resonance chamber or otherwise by shortening the length of the center pipe 6 projecting into the resonance chamber.

The sub-muffler 9 is adapted to suppress the sound pressure level of the air column resonance from being increased when the air column resonance is generated in response to the pipe length of the tail pipe 8 in the tail pipe 8 by the pulsation of the exhaust gas during the operation of the engine 1.

In general, the tail pipe 8 having an upstream opening end and a downstream opening end at the respective upstream and downstream sides of the exhaustion direction of the exhaust gas is subjected to incident waves caused by the pulsation of the exhaust gas during the operation of the engine 1 at the upstream opening end and the downstream opening end, thereby generating an air column resonance. The air column resonance has a frequency as a basic component with a half wavelength equal to the pipe length of the tail pipe, and thus has a frequency wavelength several times that of the half wavelength.

For example, taking an example in which the tail pipe 8 having no sub-muffler 9 extends backwardly from the main muffler 7, as shown in FIG. 50, the wavelength $\lambda_1$ of the air column resonance of a basic vibration (primary component) is roughly double the pipe length L of the tail pipe 8, while the wavelength $\lambda_2$ of the air column resonance of the secondary component is roughly one time the pipe length L of the tail pipe 8. The wavelength $\lambda_3$ of the air column resonance of the third component is ⅔ times the pipe length L of the tail pipe 8. Therefore, the tail pipe 8 has therein standing waves having respective nodes of sound pressure distributions at the upstream opening end and the downstream opening end.

The air column resonance frequency "fm" of the tail pipe 8 is given by the following equation (1)

$$fm=(c/2L)\cdot m \quad (1)$$

c: sound speed, L: pipe length of tail pipe, m: degree

As it is obvious from the above equation (1), it is known that the longer the pipe length L of the tail pipe 8, the more the air column resonance frequency "fm" is transferred to the low frequency area where the rotation number of engine 1 is low.

It is further known that as shown in FIG. 51, the frequency of the exhaust gas pulsation of the engine 1 is increased as the rotation number of the engine 1 is increased, and the sound pressure levels (dB) of the exhaust gas sounds are raised with the primary component f1 and the second component f2 of the exhaust gas sounds caused by the air column resonance in response to the rotation number of the engine 1.

Therefore, in the case of using a tail pipe 8 having a long pipe length (for example, the pipe length of the tail pipe 8 is equal to or more than 1.5 m), there is occasionally generated such an air column resonance in the normal rotation area having a low engine rotation number Ne, thereby causing exhaust gas noises to be deteriorated and giving unpleasant feelings to a driver.

In particular, as shown in FIG. 51, the peak (the width of the antinode portion of the sound pressure distribution) of the sound pressure for the secondary component f2 of the air column resonance is larger than the peak of the sound pressure for the primary component f1 of the air column resonance, so that there is generated in the normal rotation area of the engine unpleasant noises called muffled sounds which are a cause for the exhaust gas noises to be deteriorated.

For this reason, in the case of the pipe length of the tail pipe 8 being long, the sub-muffler 9 smaller in capacity than the main muffler 7 is provided at the optimum position among the antinode portion of the standing wave high in the sound pressure level as shown in FIG. 50, and the respective antinode portions of the primary component f1 and the secondary component f2 of the exhaust gas sound caused by the air column resonance, so that the exhaust gas noises are suppressed in the normal rotation area of the engine 1 to prevent the unpleasant feeling from being given to the driver.

On the other hand, it may be considered that the resonance frequency of the resonance chamber of the main muffler 7 to be connected with the upstream opening end of the tail pipe 8 is tuned to the air column resonance frequency of the tail pipe 8, thereby muting the air column resonance of the tail pipe 8 in the resonance chamber of the main muffler 7.

It is considered that by increasing the volume of the resonance chamber and by lengthening the projecting portion of the center pipe 6, the resonance frequency of the resonance chamber is tuned to the low frequency side, thereby preliminarily muting in the resonance chamber the air column resonance generated in the tail pipe 8 in the normal rotation number area of the engine.

However, only the exhaust gas flow is left with the gas amount discharged from the engine 1 to the exhaust apparatus 4 being drastically reduced because the throttle valve is opened at the deceleration time of the vehicle, so that the air pressure to be introduced into the resonance chamber comes to be small.

As a result, the sufficient amount of air cannot be obtained to cause the Helmholtz resonance effect in the resonance chamber, thereby making it difficult to suppress the air column resonance in the tail pipe 8. Especially at the deceleration time of the vehicle, the rotation number of the engine 1 is drastically decreased, so that the primary component f1 of the exhaust gas sound by the air column resonance enters the normal rotation number area, thereby occasionally causing muffled sounds in the vehicle cabin at the low rotation number of the engine 1 and thus giving unpleasant feelings to the driver.

As one of the conventional exhaust apparatuses for suppressing the noises at the deceleration time of the vehicle, there has so far been known an exhaust apparatus which comprises a valve for opening and closing an exhaust gas discharging pipe, and a control unit for controlling the opening and closing operations of the valve (for example see Patent Document 2).

As shown in FIGS. 52 and 53, the previously mentioned conventional exhaust apparatus further comprises a sound muting valve 10 provided at the downstream opening end 8*b* of the tail pipe 8 occupied by a node of the sound pressure of the standing wave of the air column resonance. The sound muting valve 10 is constituted by a valve case 11 and a butterfly type of valve body 12 mounted on the downstream opening end 8*b* of the tail pipe 8. The valve body 12 has a central portion formed with an orifice 13 for throttling the passage cross-sectional area of the tail pipe 8.

The valve body 12 is provided with a driving shaft 14 which is provided to extend in a direction perpendicular to the center axis of the tail pipe 8. The driving shaft 14 is connected with an electromagnet actuator 17 through a drum 15 and a wire 16. The electromagnet actuator 17 is on-off controlled by a control unit 19.

The control unit 19 is adapted to output to the electromagnet actuator 17 a command signal for on-off controlling electromagnet actuator 17 on the basis of the detection signal of a throttle sensor 18 for detecting the opening degree of the throttle valve not shown.

More specifically, the control unit 19 is adapted to allow the electromagnet actuator 17 to have the valve body 12 held in the open state by outputting the off-signal to the electromagnet actuator 17 in a usual case. The control unit 19 is adapted to output the on-signal to the electromagnet actuator 17 based on the detection information from the throttle sensor 18 at the deceleration time of the vehicle to have the valve body 12 perform the closing operation with the action of the electromagnet actuator 17.

For this reason, the sound muting valve 10 can serve to prevent the discharge of the exhaust gas from being hindered at the times of the normal cruising and the acceleration of the vehicle. Because of the exhaust gas passing through only the orifice 13 at the deceleration time of the vehicle, the motion of the particle of the exhaust gas is given resistance at the node of the sound pressure of the standing wave of the air column resonance at which the particle speed of the exhaust gas is at a maximum level, thereby making it possible to suppress the sound pressure level caused by the air column resonance of the tail pipe 8 from being increased.

CITATION LIST

Patent Literature

{PTL 1} No. JP2006-46121
{PTL 2} No. JP1991-3912

SUMMARY OF INVENTION

Technical Problem

However, the conventional exhaust apparatus for the engine 1 encounters such a problem that the conventional exhaust apparatus is necessary for the resonance chamber to be large in capacity, thereby leading to the main muffler 7 large in size, resulting from its construction in which the air column resonance of the tail pipe 28 is reduced by the resonance chamber of the main muffler 7. Another problem the conventional exhaust apparatus encounters is that the weight of the exhaust apparatus comes to be increased in response to the main muffler 7 large in size, and the production cost of the exhaust apparatus is increased.

In the exhaust apparatus for controlling the opening and closing operations of the sound muting valve 10 provided on the downstream opening end 8*b* of the tail pipe 8, it is possible to suppress the sound pressure level caused by the air column resonance of the tail pipe 8 at the deceleration time of the vehicle, however, it is necessary to control the opening and closing operations of the sound muting valve 10 by the control unit 19 and the electromagnet actuator 17. The conventional exhaust apparatus thus constructed still encounters such a problem that the conventional exhaust apparatus entails its complicated construction and control, thereby leading to increasing the production cost of the exhaust apparatus.

The present invention has been made for solving the conventional problems encountered by the conventional exhaust apparatuses, and it is therefore an object of the present invention to provide an exhaust apparatus of an internal combustion engine which is capable of suppressing the sound pressure level caused by the air column resonance in the tail pipe from being increased, and is simple in construction with no need for complicated controls while reducing the increased weight and the increased production cost of the exhaust apparatus.

Solution to Problem

To achieve the above object of the present invention, the exhaust apparatus of the internal combustion engine, (1) provided with an exhaust gas pipe at the downstream side of an internal combustion engine in the exhaust gas direction of an exhaust gas flow, the exhaust gas pipe having an upstream opening end at one end portion thereof and connected with a sound deadening device at the upstream side in the exhaust gas direction of the exhaust gas flow, and a downstream opening end at the other end portion thereof for exhausting the exhaust gas flow to the atmosphere, the exhaust apparatus comprises; a valve body having a swing shaft connected with the exhaust gas pipe to perpendicularly extend with respect to the center axis of the exhaust gas pipe and to be positioned outwardly of the center axis of the exhaust gas pipe and spaced apart from the center axis of the exhaust gas pipe, the valve body being adapted to receive only the exhaust gas flow flowing in the exhaust gas pipe and to be swingable around the center axis of the swing shaft to allow the passage cross-sectional area of the exhaust gas pipe to be varied, and a throttle unit for throttling the passage cross-sectional area of the exhaust gas pipe to a predetermined passage cross-sectional area when the valve body receives the amount of the exhaust gas flow flowing in the exhaust gas pipe in response to the operation state of the internal combustion engine to be swung around the center axis of the swing shaft in the case of an air column resonance being generated in the exhaust gas pipe.

The exhaust apparatus comprises a throttle unit for throttling the passage cross-sectional area of the exhaust gas pipe to a predetermined passage cross-sectional area when the valve body receives the amount of the exhaust gas flow flowing in the exhaust gas pipe in response to the operation state of the internal combustion engine to be swung around the center axis of the swing shaft in the case of an air column resonance being generated in the exhaust gas pipe, so that the opening ratio of the exhaust gas pipe can be reduced by throttling the passage cross-sectional area of the exhaust gas pipe to a predetermined passage cross-sectional area when the valve body receives the amount of the exhaust gas flow flowing in the exhaust gas pipe when the rotation number of the internal combustion engine becomes an air column resonance rotation number.

The exhaust apparatus thus constructed to enable the opening ratio of the exhaust gas pipe to be reduced, makes it possible to distribute a reflection wave, reflected from the opening of the exhaust gas pipe having the passage cross-sectional area throttled, into a reflection wave (open end reflection) reflected from the opening of the exhaust gas pipe and having a phase the same as that of an incident wave, and a reflection wave (closed end reflection) reflected from the valve body and having a phase 180 degrees different from that of the incident wave when the incident wave caused by the exhaust gas pulsation at the operation time of the internal combustion engine is introduced into the exhaust gas pipe with the frequency of the introduced wave becoming equal to the frequency of the air column resonance.

As a consequence, the open end reflection wave and the closed end reflection wave are interfered with each other, thereby enabling the sound pressure level caused by the air column resonance to be suppressed from being increased.

When the internal combustion engine is operated at the high rotation number to have the amount of the exhaust gas flow of the internal combustion engine increased, the passage cross-sectional area of the exhaust gas passage can be increased by swinging the valve body with the aid of the pressure of the exhaust gas flow, so that the back pressure of the exhaust gas flow can be suppressed from being increased, and the sound of the exhaust gas flow can be suppressed from being generated, thereby making it possible to prevent the exhaust gas property from be lowered.

In the case of decelerating the vehicle by opening a throttle valve at the high rotation time of the internal combustion engine, the amount of the exhaust gas flow of the internal combustion engine is drastically decreased. In this case, the valve body is swung from the swing position at the acceleration time of the vehicle toward the upstream side in the exhaust gas direction to have the passage cross-sectional area of the exhaust gas pipe throttled to the predetermined passage cross-sectional area.

As a consequence, the opening ratio of the exhaust gas pipe can be lowered to have the reflection waves caused by the opening end reflection and the closed end reflection interfered with each other, thereby making it possible to suppress the sound pressure level caused by the air column resonance from being increased.

Here, the predetermined passage cross-sectional area includes two passage cross-sectional areas at the acceleration and deceleration times. These two passage cross-sectional areas are set to enable suppressing the air column resonance from being generated at the acceleration and deceleration times.

The exhaust apparatus thus constructed comprises a throttle unit for throttling the passage cross-sectional area of the exhaust gas pipe to the predetermined passage cross-sectional area when the valve body receives the amount of the exhaust gas flow in response to the operation state of the internal combustion engine in the time of an air column resonance being generated in the exhaust gas pipe, thereby making it possible to suppress the sound pressure level caused by the air column resonance from being increased.

Therefore, the exhaust apparatus thus constructed makes it unnecessary to control the valve body with the aid of a control unit and an electromagnet actuator both of which are needed for the conventional exhaust apparatus, to make the sound muting device (corresponding to the conventional main muffler) large in size, and to provide a sub-muffler in the exhaust gas pipe, so that the weight of the exhaust apparatus can be prevented from being increased, and the production cost of the exhaust apparatus can also be prevented from being increased.

In the exhaust apparatus of the internal combustion engine as set forth in the above definition (1), (2) the throttle unit is constituted by at least part of a projection portion provided at the lower end portion of the valve body to project from the lower end portion of the valve body toward the downstream side of the exhaust gas direction of the exhaust gas flow.

The exhaust apparatus is constructed to have the throttle unit constituted by at least part of a projection portion provided at the lower end portion of the valve body, so that the passage cross-sectional area between the inner peripheral portion of the exhaust gas pipe and the projection portion can be secured by the projection portion of the valve body at the time of the air column resonance being generated.

As a consequence, the passage cross-sectional area in the exhaust gas pipe can be throttled in the normal rotation area where the exhaust gas pipe, has a small amount of exhaust gas at the deceleration and acceleration times, thereby making it possible to suppress the sound pressure level caused by the air column resonance from being increased.

In the exhaust apparatus of the internal combustion engine as set forth in the above definition (2), (3) the valve body is formed with a pair of guide portions at the both widthwise end portions of the valve body perpendicularly extending to the center axis of the exhaust gas pipe, the guide portions projecting from the both widthwise end portions of the valve body toward the downstream side of the exhaust gas direction of the exhaust gas flow.

The exhaust apparatus is constructed to have the valve body formed with a lower projection projecting from the lower end portion of the valve body, and a pair of guide portions at the both widthwise end portions of the valve body, so that the exhaust gas flows can be rectified by the lower projection portion and the side projection portions, thereby making it possible to prevent the sound of the exhaust gas flow from being generated.

In the exhaust apparatus of the internal combustion engine as set forth in the above definition (2) or (3), (4) the throttle unit is constituted by a projection base end portion forming part of the projection portion, the initial position of the valve body being set to be inclined toward the upstream side of the exhaust gas direction of the exhaust gas flow with respect to the vertical direction, the throttle unit having a section forming part of the projection portion extending from the projection base end portion toward the downstream side of the exhaust gas direction of the exhaust gas flow, the section of the projection portion allowing the passage cross-sectional area of the exhaust gas pipe to be larger than the predetermined passage cross-sectional area at the time of an air column resonance being generated in the exhaust gas pipe.

The exhaust apparatus thus constructed can allow the valve body to be inclined to the initial position when the engine rotation number of the internal combustion engine is an engine idle rotation number smaller than the air column resonance rotation number, so that the passage cross-sectional area of the exhaust gas pipe can be made larger than the passage cross-sectional area at the time of the air column resonance being generated by the projection base end portion of the valve body and the projection portion at the downstream side in the exhaust gas direction.

This means that the passage cross-sectional area of the exhaust gas pipe at the idle rotation time can be made larger than the passage cross-sectional area of the exhaust gas pipe at the air column resonance rotation time, thereby making it possible to suppress noises, for example, whistle noises and the like caused by the exhaust gas flow at the idle rotation time from being generated.

When the rotation number of the internal combustion engine becomes an air column resonance rotation number larger than the idle rotation number, the valve body receives the exhaust gas flow and is thus swung toward the downstream side, so that the passage cross-sectional area of the exhaust gas pipe can be throttled to the predetermined passage cross-sectional area by the projection base end portion of the valve body, thereby making it possible to lower the opening ratio of the exhaust gas pipe and thus to suppress the sound pressure level caused by the air column resonance from being increased.

When the internal combustion engine is operated at the high rotation number to have the amount of the exhaust gas flow of the internal combustion engine increased, the passage cross-sectional area of the exhaust gas passage can be increased by swinging the valve body further toward the downstream side with the aid of the pressure of the exhaust gas flow, so that the back pressure of the exhaust gas flow can be suppressed from being increased, and the sound of the exhaust gas flow can be suppressed from being generated, thereby making it possible to prevent the exhaust gas property from being lowered.

In the exhaust apparatus of the internal combustion engine as set forth in the above definitions (2) to (4), (5) the projection portion has a curved shape along the swing locus of the lower portion of the valve body when the valve body is swung, the passage cross-sectional area of the exhaust gas pipe being throttled to the predetermined passage cross-sectional area when the valve body is in a predetermined swing range.

The exhaust apparatus thus constructed can allow the exhaust gas pipe to have the passage cross-sectional area of the exhaust gas pipe maintained constant when the valve body is swung by the vehicle inclined and the exhaust gas pulsation fluctuated at the time of the air column resonance being generated. As a consequence, the opening ratio of the exhaust gas pipe can be maintained constant irrespective of the swing effect of the valve body at the time of the air column resonance being generated, so that the sound pressure level caused by the air column resonance can be suppressed from being increased, and noises caused by the swing motion of the valve body can be prevented from being generated, thereby making it possible to suppress the noises from being generated.

In the exhaust apparatus of the internal combustion engine as set forth in the above definition (1), (6) the throttle unit is constituted by a projection portion projecting toward the center axis of the exhaust gas pipe from the inner peripheral lower portion of the exhaust gas pipe, the initial position of the valve body being set to be inclined toward the upstream side of the exhaust gas direction of the exhaust gas flow, the projection portion being brought into face-to-face relationship with the lower end portion of the valve body to throttle the passage cross-sectional area of the exhaust gas pipe to the predetermined passage cross-sectional area when the valve body is swung from the initial position toward the downstream side of the exhaust gas direction of the exhaust gas flow.

The exhaust apparatus thus constructed can allow the valve body to be inclined to the initial position when the engine rotation number of the internal combustion engine is an engine idle rotation number smaller than the air column resonance rotation number, so that the passage cross-sectional area of the exhaust gas pipe can be made larger than the predetermined passage cross-sectional area at the time of the air column resonance being generated by the projection base end portion of the valve body and the projection portion at the downstream side in the exhaust gas direction.

This means that the passage cross-sectional area of the exhaust gas pipe at the idle rotation time can be made large, thereby making it possible to suppress noises, for example, whistle noises and the like caused by the exhaust gas flow at the idle rotation time from being generated.

When the rotation number of the internal combustion chamber becomes an air column resonance rotation number larger than the idle rotation number, the valve body receives the exhaust gas flow and is thus swung toward the downstream side, so that the passage cross-sectional area of the exhaust gas pipe can be throttled to the predetermined passage cross-sectional area by having the projection base end portion of the valve body in face-to-face relationship with the projection portion, thereby making it possible to lower the opening ratio of the exhaust gas pipe and thus to suppress the sound pressure level caused by the air column resonance from being increased.

In the exhaust apparatus of the internal combustion engine as set forth in the above definition (1), (7) the throttle unit is partly constituted by a curved portion formed on the inner peripheral lower portion of the exhaust gas pipe to be curved along the swing locus of the lower portion of the valve body when the valve body is swung, the passage cross-sectional area of the exhaust gas pipe being throttled to the predetermined passage cross-sectional area by the curved portion when the valve body is in the predetermined swing range.

The exhaust apparatus thus constructed can allow the exhaust gas pipe to have the passage cross-sectional area of the exhaust gas pipe maintained constant when the valve body is swung by the vehicle inclined and the exhaust gas pulsation fluctuated at the time of the air column resonance being generated. As a consequence, the opening ratio of the exhaust gas pipe can be maintained constant irrespective of the swing effect of the valve body at the time of the air column resonance being generated, so that the sound pressure level caused by the air column resonance can be suppressed from being increased, and noises caused by the swing motion of the valve body can be prevented from being generated, thereby making it possible to suppress the noises from being generated.

In the exhaust apparatus of the internal combustion engine as set forth in the above definitions (1) to (7), (8) the lower portion of the exhaust gas pipe is formed with a lower diameter expansion portion at the downstream side of the exhaust gas direction of the exhaust gas flow with respect to the valve body, the valve body and the lower diameter expansion portion allowing the passage cross-sectional area of the exhaust gas pipe to be increased when the valve body is swung from the swing position at the time of the air column resonance being generated to the direction in which the passage cross-sectional area of the exhaust gas pipe is increased.

The exhaust apparatus thus constructed can have the valve body swung to the predetermined swing position, thereby making it possible to throttle the passage cross-sectional area of the exhaust gas pipe to the predetermined passage cross-sectional area when the amount of the exhaust gas flow is small at the deceleration time of the vehicle. On the other hand, the passage cross-sectional area of the exhaust gas pipe can be increased by the lower diameter expansion portion when the amount of the exhaust gas flow is large at the acceleration time of the vehicle.

For this reason, even if the air column resonance rotation numbers are equal to each other in the normal rotation area, the exhaust apparatus thus constructed can have the passage cross-sectional areas of the exhaust gas pipes made different from each other at the acceleration and deceleration times of the vehicle when the amounts of the exhaust gas flow, thereby making it possible to set the optimum passage cross-sectional area enabling the air column resonance to be suppressed, and to further suppress the sound pressure level from being increased. In addition, it is possible to prevent the back pressure of the exhaust gas flow from being increased at the acceleration time, thereby making it possible to enhance the exhaust gas property.

In the exhaust apparatus of the internal combustion engine as set forth in the above definitions (1) to (8), (9) the swing shaft is positioned radially outwardly of the inner surface of the exhaust gas pipe at the upstream side of the exhaust gas direction of the exhaust gas flow with respect to the valve body.

The exhaust apparatus thus constructed can have the swing shaft positioned radially outwardly of the inner surface of the exhaust gas pipe at the upstream side of the exhaust gas direction of the exhaust gas flow with respect to the valve body, viz., can have the swing shaft positioned radially outwardly of the exhaust gas passage. The exhaust gas flow can be partly prevented from flowing from the gap between the upper end of the valve body and the exhaust gas pipe to the downstream side of the swing shaft, thereby making it possible to have the exhaust gas flow efficiently collide with the part of the valve body below the swing shaft.

As a consequence, the pressure loss of the exhaust gas flow to collide with the part of the valve body can be prevented from being generated, thereby making it possible to reliably position the valve body to the predetermined swing position, and thus to throttle the passage cross-sectional area of the exhaust gas flow to the predetermined passage cross-sectional area at the time of the air column resonance.

In the exhaust apparatus of the internal combustion engine as set forth in the above definitions (1) to (8), (10) the throttle unit is partly constituted by a curved projection portion curved to project toward the center axis of the exhaust gas pipe from the inner peripheral upper portion of the exhaust gas pipe at the inner peripheral upper portion of the upstream side of the exhaust gas direction of the exhaust gas flow with respect to the swing shaft, the curved projection portion allowing the exhaust gas flow flowing toward the swing shaft to be guided to the section of the valve body below the swing shaft.

The exhaust apparatus thus constructed can have the throttle unit is partly constituted by a curved projection portion curved to project toward the center axis of the exhaust gas pipe from the inner peripheral upper portion of the exhaust gas pipe at the inner peripheral upper portion of the upstream side of the exhaust gas direction of the exhaust gas flow with respect to the swing shaft, so that the exhaust gas flow can be partly prevented from flowing from the gap between the upper end of the valve body and the exhaust gas pipe to the downstream side of the swing shaft, thereby making it possible to have the exhaust gas flow efficiently collide with the part of the valve body below the swing shaft.

As a consequence, the pressure loss of the exhaust gas flow to collide with the part of the valve body can be prevented from being generated, thereby making it possible to reliably position the valve body to the predetermined swing position, and thus to throttle the passage cross-sectional area of the exhaust gas flow to the predetermined passage cross-sectional area at the time of the air column resonance.

In the exhaust apparatus of the internal combustion engine as set forth in the above definitions (1) to (10), (11) the swing shaft is spaced apart from the inner peripheral upper portion of the exhaust gas pipe toward the center axis of the exhaust gas pipe, the valve body having an upper projection portion upwardly projecting from the swing shaft, the upper portion of the exhaust gas pipe being formed with an upper diameter expansion portion expanded toward the upper projection portion, the passage cross-sectional area between the forward end of the upper projection portion and the inner peripheral surface of the upper diameter expansion portion being variable in response to the swing motion of the valve body.

The reason why the exhaust apparatus is thus constructed is due to the fact that the passage cross-sectional area of the exhaust gas pipe is throttled by the throttle unit to the predetermined passage cross-sectional area at the times of the air column resonance rotation and the idle rotation to reduce the passage cross-sectional area of the exhaust gas pipe, and thus to prevent the sound of exhaust gas flow from being generated.

The exhaust apparatus thus constructed has the upper portion of the exhaust gas pipe formed with an upper diameter expansion portion expanded in face-to-face relationship with the upper projection portion of the valve body, and has the passage cross-sectional area between the forward end of the upper projection portion and the inner peripheral surface of the upper diameter expansion portion be variable in response to the swing motion of the valve body, so that the passage cross-sectional area can be retained between the forward end of the upper projection portion and the upper diameter expansion portion in the range from the idle rotation number with a small opening formed by the position of the swing plate to the air column resonance rotation number. This makes it possible to pass the exhaust gas through the exhaust gas passage throttled by the throttle unit and through between the forward end of the upper projection portion and the inner peripheral surface of the upper diameter expansion portion, thereby increasing the passage cross-sectional area of the exhaust gas pipe having the exhaust gas flow pass therethrough, and thus to suppress the sound of the exhaust gas flow from being generated.

Further, the passage cross-sectional area between the forward end of the upper projection portion and the inner peripheral surface of the upper diameter expansion portion can be reduced to an extremely small level at the time of the air column resonance being generated, thereby making it possible to prevent the exhaust gas flow from the passage cross-sectional area between the forward end of the upper projection portion and the inner peripheral surface of the upper diameter expansion portion passing through the forward end of the upper projection portion and the inner peripheral surface of the upper diameter expansion portion. As a consequence, the passage cross-sectional area can be throttled to the predetermined passage cross-sectional area by the throttle unit, thereby making it possible to suppress the sound pressure level caused by the air column resonance from being increased.

Further, in the case of the part of the valve body below the swing shaft receiving the exhaust gas flow, the swing angle of the valve body is set by the relationship between the force of the exhaust gas flow pressing the part of the valve body below the swing shaft and the own weight of the valve body.

However, it is difficult to position the valve body at the predetermined swing position where the air column resonance can be suppressed because the valve body has inertia, and it is sometimes difficult to maintain the opening ratio of the exhaust gas pipe by maintaining constant the opening degree of the valve body when the air column resonance is generated to cause the swings of the valve body to be generated.

The exhaust apparatus thus constructed is provided with an upper projection portion upwardly projecting with respect to the swing shaft of the valve body, so that the inertia force of the valve body below the swing shaft can be reduced by the exhaust gas flow since the upper projection portion is pressed by the exhaust gas flow. As a consequence, the swings of the valve body is suppressed from being generated at the time of the air column being generated to maintain the opening degree of the valve body constant, thereby making it possible to maintain the opening ratio of the exhaust gas pipe constant, and thus to suppress the sound pressure level caused by the air column resonance from being increased.

In the exhaust apparatus of the internal combustion engine as set forth in the above definition (11), (12) the upper projection portion has an inclination portion inclined toward the upstream side of the exhaust gas direction of the exhaust gas flow in the state of the valve body being positioned to vertically extend.

The exhaust apparatus thus constructed can allow the exhaust gas flow to collide with the inclination portion of the upper projection portion when the valve body receives the exhaust gas flow and is thus swung to a large angle at the high rotation time of the internal combustion engine having a large amount of exhaust gas flow. For this reason, the rotation force (assist force) around the center axis of the swing shaft can be applied to the valve body to have the opening degree increased.

This makes it possible to increase the opening degree of the valve body which is simple in construction only by devising the shape of the valve body. This means that the back pressure of the exhaust gas flow can be suppressed from being increased while reducing the pressure loss of the exhaust gas flow at the high rotation time of the internal combustion engine.

In the exhaust apparatus of the internal combustion engine as set forth in the above definitions (1) to (12), (13) the valve body is provided at least one of one end portion and the other end portion of the exhaust gas pipe.

The exhaust apparatus thus constructed has the valve body provided at one end portion or the other end portion of the exhaust gas pipe, so that the valve body can be positioned to a position corresponding to a node of a sound pressure distribution of the air column resonance.

The exhaust apparatus thus constructed makes it possible to distribute a reflection wave, reflected from the opening of the exhaust gas pipe having the passage cross-sectional area throttled, into a reflection wave (open end reflection) reflected from the opening of the exhaust gas pipe and having a phase the same as that of an incident wave, and a reflection wave (closed end reflection) reflected from the valve body and having a phase 180 degrees different from that of the incident wave when the incident wave caused by the exhaust gas pulsation at the operation time of the internal combustion engine is introduced into the exhaust gas pipe with the frequency of the in incident wave becoming equal to the frequency of the air column resonance.

Advantageous Effects of Invention

The present invention can provide an exhaust apparatus of an internal combustion engine which is capable of suppressing the sound pressure level caused by the air column resonance in the tail pipe from being increased, and is simple in construction with no need for complicated controls while reducing the increased weight and the increased production cost of the exhaust apparatus.

DESCRIPTION OF EMBODIMENTS

The embodiments of the exhaust apparatus of the internal combustion engine according to the present invention will be described hereinafter with reference to the accompanying drawings.

First Embodiment

FIGS. 1 to 12 are views respectively showing a first embodiment of the exhaust apparatus of the internal combustion engine according to the present invention.

The construction of the first embodiment will firstly be explained hereinafter.

Figure 1:
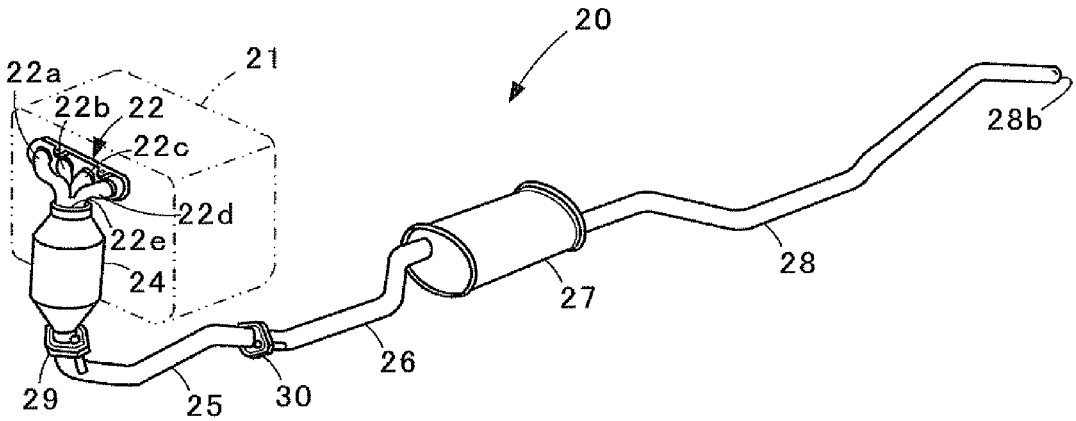
FIG. 1 shows a view of a first embodiment of an exhaust apparatus of an internal combustion engine according to the present invention, and is a perspective construction view of the exhaust apparatus of the internal combustion engine.

As shown in FIG. 1, the exhaust apparatus 20 of the internal combustion engine according to the present embodiment is applied to an apparatus for discharging an exhaust gas from an engine 21 serving as a straight 4-cylinder internal combustion engine. The engine 21 is connected to an exhaust manifold 22 which is connected to the exhaust apparatus 20.

Here, the fluid discharged to the exhaust apparatus 20 from the engine 21 includes an exhaust gas discharged when a throttle valve is opened, and air discharged when the throttle valve is closed to have the vehicle cruising at a reduced speed. Thus, the exhaust gas and the air inclusive will hereinafter be expressed only with a term "exhaust gas".

The engine 21 is not limited to the straight 4-cylinder internal combustion engine, but may be constituted by a straight 3-cylinder internal combustion engine or a straight more than 4-cylinder internal combustion engine. The engine 21 may be a V-type engine having more than two cylinders respectively mounted on the banks divided right and left.

The exhaust manifold 22 is constituted by four exhaust gas branch pipes 22*a*, 22*b*, 22*c*, 22*d* respectively connected to exhaust ports formed to be held in communication with the first to fourth cylinders of the engine 21, and an exhaust gas collecting pipe 22*e* constructed to collect the downstream sides of the exhaust gas branch pipes 22*a*, 22*b*, 22*c*, 22*d*, so that the exhaust gas discharged from the cylinders of the engine 21 can be introduced into the exhaust gas collecting pipe 22*e* through the exhaust gas branch pipes 22*a*, 22*b*, 22*c*, 22*d*.

The exhaust apparatus 20 is provided with a catalytic converter 24, a cylindrical front pipe 25, a cylindrical center pipe 26, a muffler 27 serving as a sound deadening device, and a tail pipe 28 serving as a cylindrical exhaust gas pipe. The exhaust apparatus 20 is installed at the downstream side of the exhaust gas discharging direction of the engine 21 in such a manner that the exhaust apparatus 20 resiliently droops from the floor of the vehicle. The term "upstream side" indicates an upstream side in the discharging direction of the exhaust gas, while the term "downstream side" indicates a downstream side in the discharging direction of the exhaust gas.

The upstream end of the catalytic converter 24 is connected to the downstream end of the exhaust gas collecting pipe 22*e*, while the downstream end of the catalytic converter 24 is connected to the front pipe 25 through a universal joint 29. The catalytic converter 24 is constructed by a case which accommodates therein a honeycomb substrate or a granular activated alumina catalyst carrier deposited with catalysts such as platinum and palladium to perform reduction of Nox, and oxidization of CO, HC.

The universal joint 29 is constructed by a spherical joint such as a ball joint and the like to allow the catalytic converter 24 and the front pipe 25 to be relatively displaceable with each other. The downstream end of the front pipe 25 is connected to the upstream end of the center pipe 26 through a universal joint 30. The universal joint 30 is constructed by a spherical joint such as a ball joint and the like to allow the front pipe 25 and the center pipe 26 to be relatively displaceable with each other.

The downstream end of the center pipe 26 is connected to the muffler 27 adapted to mute the exhaust gas sound.

Figure 2:
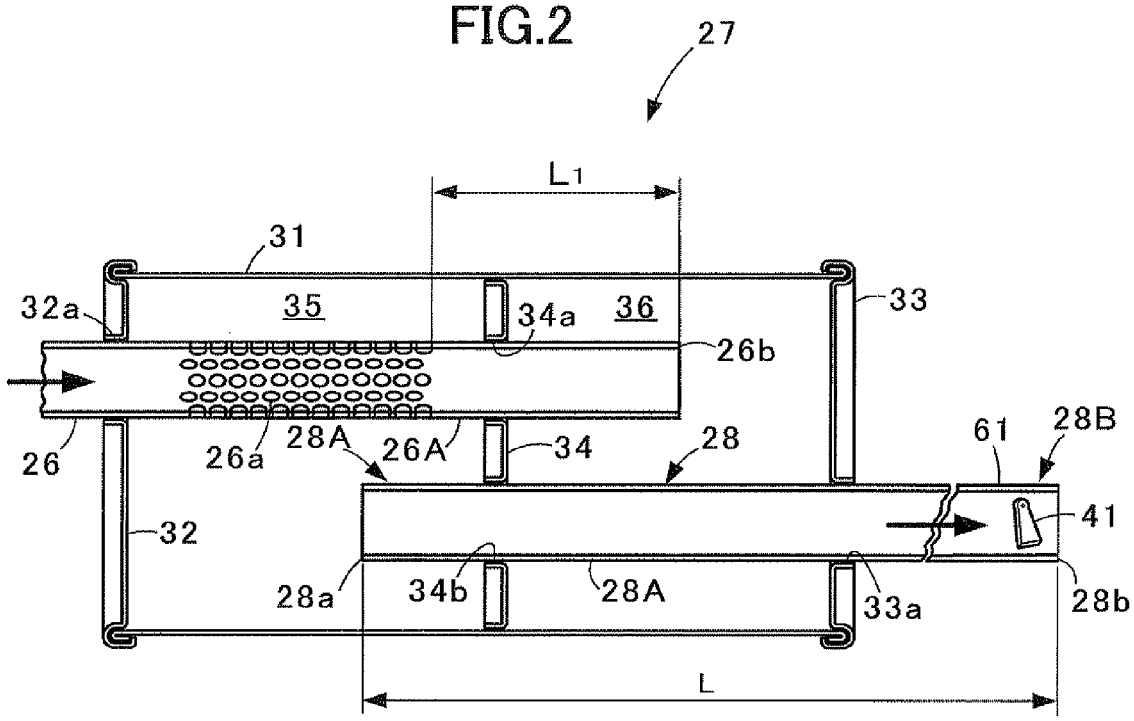
FIG. 2 shows a view of the first embodiment of the exhaust apparatus of the internal combustion engine according to the present invention, and is a cross-sectional view of a muffler connected with a tail pipe.

As shown in FIG. 2, the muffler 27 is provided with an outer shell 31 formed in a cylindrical shape, and end plates 32, 33 for closing the both ends of the outer shell 31.

The outer shell 31 is provided therein with a partition plate 34 to divide the outer shell 31 into an expansion chamber 35 for expanding the exhaust gas to deaden the exhaust gas sound, and a resonance chamber 36 for muting the exhaust gas sound with a specified frequency by the Helmholtz resonance effect.

The end plate 32 and the partition plate 34 are formed with through bores 32*a*, 34*a*, respectively. The through bores 32*a*, 34*a* allow the downstream portion of the center pipe 26 (hereinafter referred to as an inlet pipe portion 26A forming part of the center pipe 26) to pass therethrough.

The inlet pipe portion 26A is supported on the end plate 32 and the partition plate 34 to be accommodated in the expansion chamber 35 and the resonance chamber 36 with the downstream opening end 26*b* being opened to the resonance chamber 36.

The inlet pipe portion 26A is formed with a plurality of small through bores 26*a* formed to be arranged in the axial direction, i.e., the gas discharging direction of the exhaust gas, of the inlet pipe portion 26A and in the circumferential direction of the inlet pipe 26A, so that the inner chamber of the inlet pipe portion 26A is held in communication with the expansion chamber 35 through the small through bores 26*a*.

Therefore, the exhaust gas introduced into the muffler 27 through the inlet pipe portion 26A of the center pipe 26 is introduced into the expansion chamber 35 through the small through bores 26*a* and then introduced into the resonance chamber 36 through the downstream open end 26*b* of the inlet pipe portion 26A.

The exhaust gas sound of the exhaust gas with a specified frequency (Hz) can be muted by the Helmholtz resonance effect when being introduced into the resonance chamber 36. More specifically, the resonance chamber 36 can tune the resonance frequency of the exhaust gas sound to the low frequency side selectively by increasing the volume of the resonance chamber 36 or by lengthening the length L1 of the projection portion of the center pipe 26 projecting into the resonance chamber 36.

On the other hand, the resonance chamber 36 can tune the resonance frequency of the exhaust gas sound toward the high frequency side selectively by decreasing the volume of the resonance chamber 36 or by shortening the length L1 of the projection portion of the center pipe 26 projecting into the resonance chamber 36.

The partition plate 34 and the end plate 33 are formed with through bores 34*b*, 33*a*, respectively. The through bores 34*b*, 33*a* allow the upstream portion 28A (one end portion) of the tail pipe 28 to pass therethrough.

The upstream portion 28A of the tail pipe 28 is provided at its upstream end with an upstream open end 28*a*. The upstream portion 28A of the tail pipe 28 is connected with the muffler 27 with the upstream open end 28*a* being opened to the expansion chamber 35 and passes through the through bores 34*b*, 33*a* as previously mentioned.

The downstream portion (the other end portion) 28B of the tail pipe 28 is provided at its downstream end with a downstream open end 28*b* held in communication with the atmosphere. This means that the exhaust gas introduced into the upstream open end 28*a* of the tail pipe 28 from the expansion chamber 35 of the muffler 27 is discharged to the atmosphere through the downstream open end 28*b* of the tail pipe 28.

In other words, the tail pipe 28 according to the present embodiment has the upstream portion 28A, and the downstream portion 28B. The upstream portion 28A has the upstream open end 28*a* connected with the muffler 27 at the upstream side in the exhaust gas direction of the exhaust gas discharged from the engine 21, while the downstream portion 28B has the downstream open end 28*b* for discharging the exhaust gas to the atmosphere.

Here, the upstream portion 28A and the downstream portion 28B of the tail pipe 28 is indicative of portions upstream and downstream of the tail pipe 28 respectively having the upstream open end 28*a* and the downstream open end 28*b* inclusive and each having a predetermined length.

Figure 3:
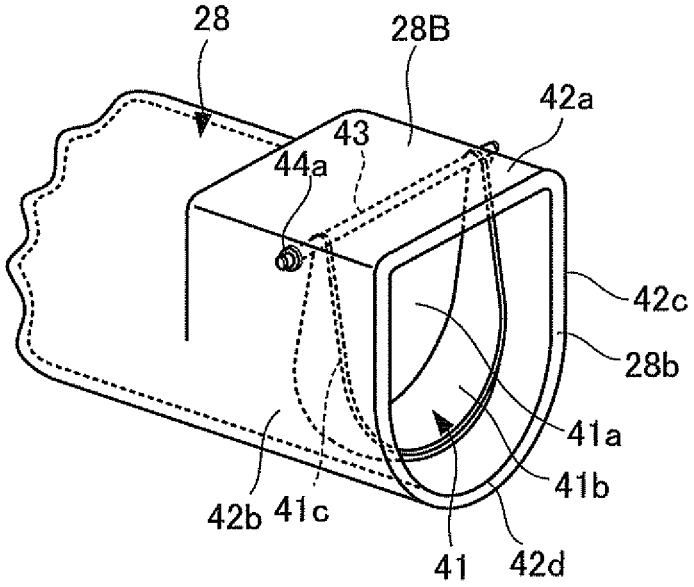
FIG. 3 shows a view of the first embodiment of the exhaust apparatus of the internal combustion engine according to the present invention, and is a perspective view of the other end portion of the tail pipe.
Figure 4:
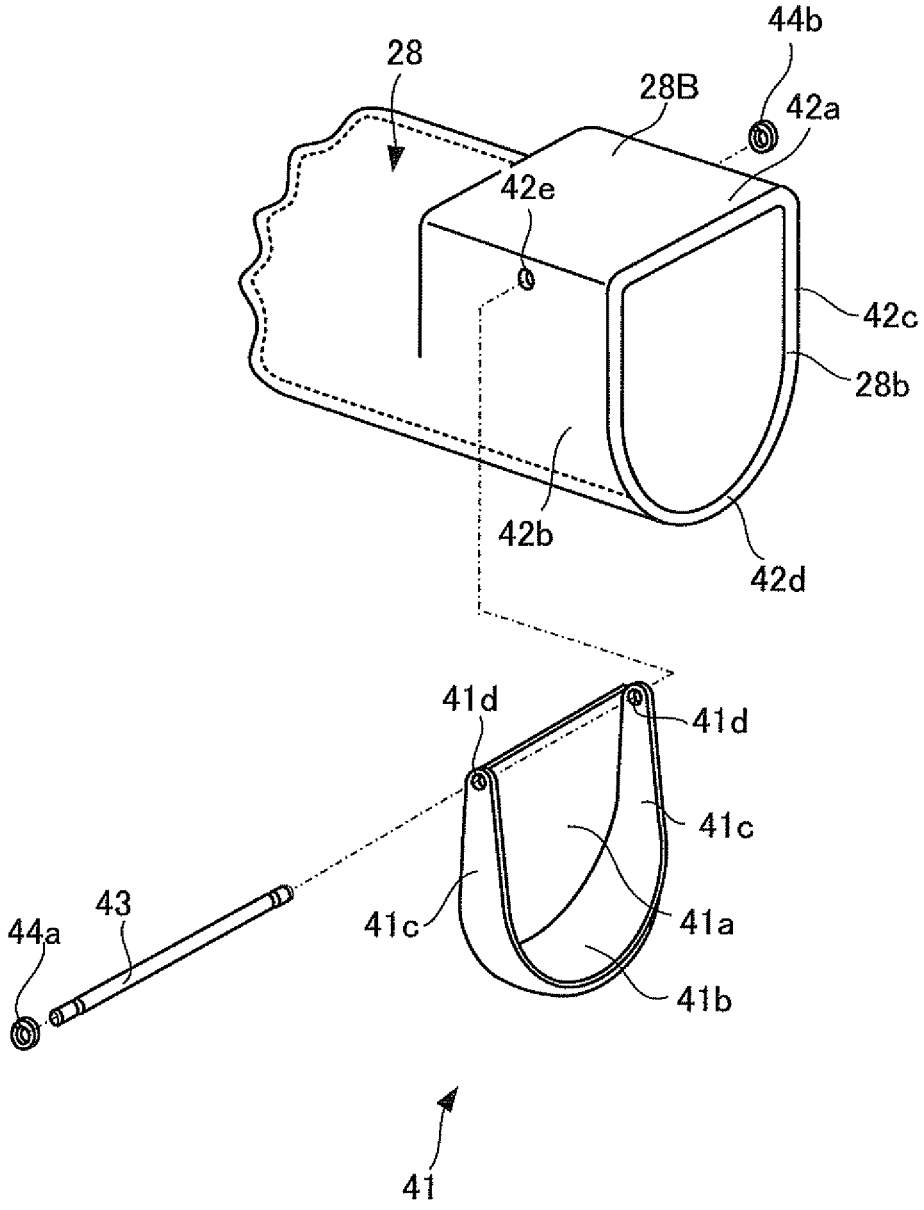
FIG. 4 shows a view of the first embodiment of the exhaust apparatus of the internal combustion engine according to the present invention, and is an exploded view of the other end portion of the tail pipe and a swing plate.
Figure 5:
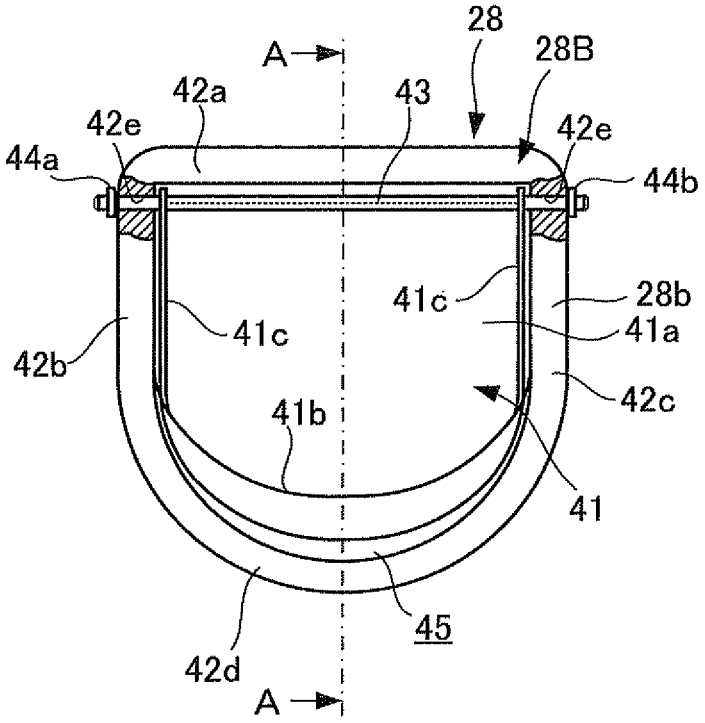
FIG. 5 shows a view of the first embodiment of the exhaust apparatus of the internal combustion engine according to the present invention, and is a front elevational view of the tail pipe as seen from the axial direction of the tail pipe.

In FIGS. 3 to 5, the downstream portion 28B of the tail pipe 28 is provided with a swing plate 41 serving as a valve body formed in semi-circular shape.

The downstream portion 28B of the tail pipe 28 is constituted by a straight upper portion 42*a*, straight side portions 42*b*, 42*c* downwardly extending from both end portions of the upper portions 42*a*, and a bottom portion 42*d* arcuately extending between the lower ends of the side portions 42*b*, 42*c*.

The swing plate 41 has a receiving surface 41*a* for receiving the exhaust gas flow, a lower projection portion 41*b* projecting from the lower end portion of the receiving surface 41*a* toward the downstream side of the exhaust gas direction and serving as part of a throttle unit, and side projection portions 41*c* projecting from the both widthwise end portions of the receiving surface 41*a*, respectively, and serving as a guide portion. The lower projection portion 41*b* and the side projection portions 41*c* are integrally formed in this embodiment.

The receiving surface 41*a*, the lower projection portion 41*b* and the side projection portions 41*c* may be integrally formed, and the lower projection portion 41*b* and the side projection portions 41*c* integrally formed with the receiving surface 41*a* are secured to each other in a welding method and other fixing methods.

The upper end portions of the side projection portions 41*c* are formed with through bores 41*d*, respectively, while the side portions 42*b*, 42*c* of the downstream portion 28B are formed with through bores 42*e* (see FIG. 4), respectively. The through bores 41*d*, 42*e* allow a swing shaft 43 to pass therethrough.

Figure 6:
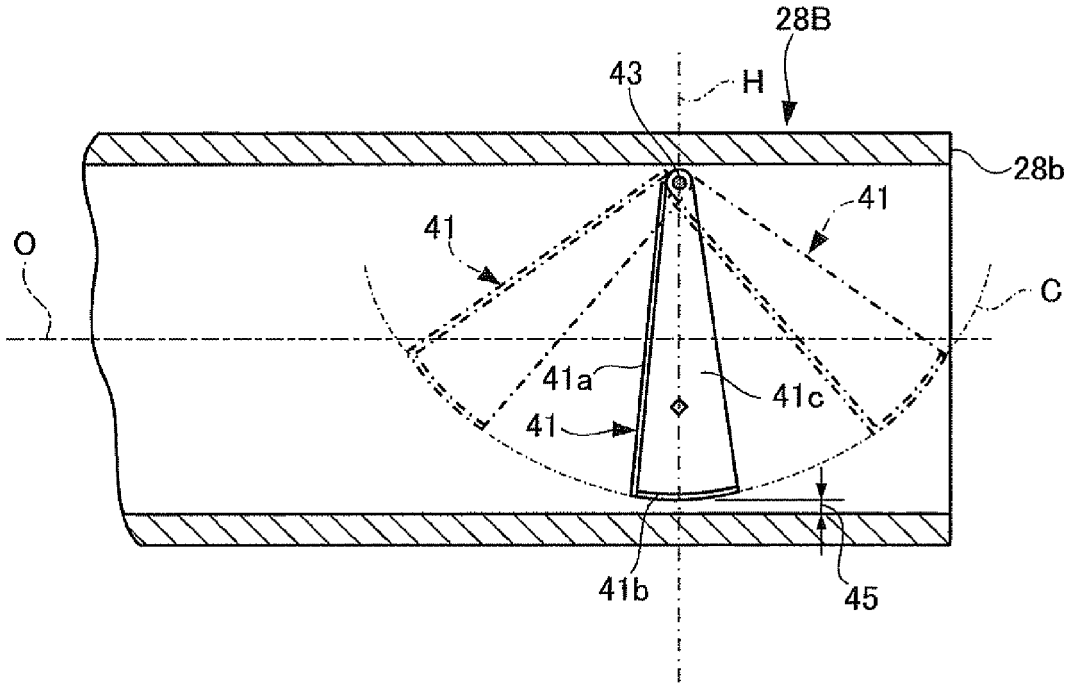
FIG. 6 shows a cross-sectional view of the tail pipe taken along and seen from the lines A-A in FIG. 5.

As shown in FIG. 6, the swing shaft 43 is therefore connected with the downstream portion 28B of the tail pipe 28 to perpendicularly extend with respect to the center axis (hereinafter simply referred to as "the center axis O") of the tail pipe 28 and to be positioned outwardly of the center axis O of the tail pipe 28 and spaced apart from the center axis O of the tail pipe 28, so that the swing plate 41 is swingable around the swing shaft 43 to take an upstream position and a downstream position as shown in the phantom lines of FIG. 6.

The both longitudinal end portions of the swing shaft 43 have C-rings 44*a*, 44*b*, respectively, which are positioned axially outwardly of the downstream portion 2813 to prevent the swing shaft 43 from being detached from the downstream portion 2813 by the C-rings 44*a*, 44*b*.

The cross-sectional shapes of the swing plate 41 and the downstream portion 28B are each in the form of a semi-circular shape. The swing plate 41 is swingable between the upstream position and the downstream position while being not in contact with the inner peripheral portion of the downstream portion 2813.

As shown in FIG. 6, the lower projection portion 41*b* of the swing plate 41 is curved in the swing direction of the swing plate 41, viz., in the form of a shape curved along the swing locus C of the lower end portion of the receiving surface 41*a* when the swing plate 41 is swung.

The lower projection portion 41*b* of the swing plate 41 is adapted to throttle and adjust the passage cross-sectional area between the lower surface of the lower projection portion 41*b* and the inner peripheral surface of the downstream portion 2813 in the case of the air column resonance of the tail pipe 28 being generated and of the receiving surface 41*a* being swung when receiving the exhaust flow in the exhaust flow amount in response to the operation state of the engine 21. The lower projection portion 41*b* of the swing plate 41 constructed to throttle and adjust the passage cross-sectional area to a predetermined passage cross-sectional area can form an opening portion 45 having a small opening area.

Due to the fact that the lower projection portion 41*b* of the swing plate 41 is in the form of a shape curved along the swing locus C of the lower end portion of the receiving surface 41*a* when the swing plate 41 is swung, the passage cross-sectional area of the tail pipe 28 is maintained at a constant level when the swing plate 41 remains in a constant swing range to form the opening portion 45 having a constant opening area.

Here, the term "constant swing range" is intended to indicate a swing range in which the vertical axis H of the swing plate 41 is positioned and vertically extends, and in which the swing plate 41 is swingable between the upstream position and the downstream position across the vertical axis H of the swing plate 41. The swing plate 41 is set to have a swing position within the swing range at the time of the air column resonance being generated.

The swing plate 41 is set to have a weight so sufficiently heavy that the swing plate 41 takes the swing position where the opening portion 45 can form a small opening ratio when the swing plate 41 receives the exhaust gas flow at the time of the engine 21 being operated under the air column resonance. Further, the swing plate 41 may be provided with a weight to take a predetermined swing position where the swing plate 41 can suppress the air column resonance.

The swing plate 41 is constructed to have the receiving surface 41*a* receive the exhaust flow and gradually swung to the position downstream of the vertical axis H when the rotation number of the engine 21 is raised to have the amount of the exhaust gas flow increased, thereby gradually increasing the passage cross-sectional area in response to the swing position of the receiving surface 41*a*, viz., gradually increasing the opening area of the tail pipe 28.

Next, the operation will be described hereinafter.

As shown in FIG. 1, at the time of the engine 21 being operated, the exhaust gas discharged from the cylinders of the engine 21 is introduced from the exhaust manifold 22 into the catalyst convertor 24 by which the reduction of Nox, and the oxidization of CO, HC are carried out.

The exhaust gas discharged from the catalyst convertor 24 is then introduced into the muffler 27 shown in FIG. 2 through the front pipe 25 and the center pipe 26. The exhaust gas introduced into the muffler 27 is introduced into the expansion chamber 35 through the small through bores 26*a* of the inlet pipe portion 26A. The exhaust gas is then introduced into the resonance chamber 36 from the downstream open end 26*b* of the inlet pipe portion 26A. The exhaust gas sound of the exhaust gas with a specified frequency (Hz) can be muted by the Helmholtz resonance effect when being introduced into the resonance chamber 36.

The exhaust gas introduced into the expansion chamber 35 is in turn introduced into the tail pipe 28 through the upstream open end 28*a* of the upstream portion 28A of the tail pipe 28, and then discharged to the atmosphere through the downstream open end 28*b* of the tail pipe 28.

The downstream open end 28*h* of the tail pipe 28 is provided with a swing plate 41 capable of varying the opening cross-sectional area of the downstream open end 28*b* with the swinging motion of the swing plate 41 caused by the exhaust gas flow of the exhaust gas. Between the lower end surface of the swing plate 41 and the inner peripheral surface of the downstream open end 28*b* is formed the opening portion 45 having a predetermined opening area.

When the receiving surface 41*a* of the swing plate 41 receives the exhaust gas flow under the operation of the engine 21 in the low rotation area or in the intermediate rotation area representing an ordinary rotation area (2,000 rpm-5,000 rpm), the receiving surface 41*a* is in the upstream range or the downstream range encompassing the vertical axis H in which the swing plate 41 is inclined to have the lower projection portion 41*b* in opposing relationship with the downstream portion 28B, thereby throttling the passage cross-sectional area of the tail pipe 28 to a minimum level to form the opening portion 45 with the small opening area.

On the other hand, in the high rotation area (more than 5,000 rpm) of the engine 21, the amount of the exhaust gas discharged from the engine 21 is increased. This operation of the engine 21 causes the swing plate 41 to receive a large amount of exhaust gas and to be sufficiently swung toward the downstream side of the tail pipe 28, so that the passage cross-sectional area of the tail pipe 28 is increased as shown in the phantom lines of FIG. 6. As a consequence, the exhaust gas introduced into the tail pipe 28 is discharged to the atmosphere from the opening portion larger in opening area than the opening portion 45. Under the maximum rotation speed of the engine 21, the downstream open end 28*b* of the tail pipe 28 comes to be roughly in a full open state.

When, on the other hand, the operation of the engine 21 is brought from the high rotation area to the low rotation area in which the speed of the vehicle is reduced with the throttle valve being closed, the amount of the exhaust gas discharged from the engine 21 is drastically reduced. As a consequence, the swing plate 41 is promptly swung to have the receiving surface 41*a* of the swing plate 41 moved to the upstream position across the vertical axis H (see the solid lines in FIG. 6). At this time, the exhaust gas is discharged to the atmosphere in the state having the opening portion 45 throttled to the minimum level.

By the present embodiment thus constructed in the above, when the vehicle is accelerated and decelerated in the state of the engine 21 being operated in the normal rotation area, the passage allowing the exhaust gas flow to be reflected at the closed portion closed by the swing plate 41 and at the opening portion 45, respectively. The interference of the reflection waves can suppress the noises from being generated in the tail pipe 28.

Next, explanation will be made about the reflection waves and their interference generated by the downstream open end 28*b* of the tail pipe 28 and the swing plate 41.

The exhaust gas is introduced into the tail pipe 28 in response to the operation of the engine 21 while accompanying an exhaust gas pulsation varied in response to the rotation speeds of engine 21. The exhaust gas pulsation comes to be an incident wave in the tail pipe 28, the incident wave having a frequency increased in response to the increased rotation number of the engine 21.

When the incident wave caused by the exhaust gas pulsation at the time of the engine 21 being operated is introduced into the tail pipe 28, the incident wave causes a reflection wave what is called an open end refection at the opening portion 45 of the downstream open end 28*b* of the tail pipe 28. The reflection wave is the same in phase as the incident wave and is opposite in advance direction to the incident wave. The reflection wave again causes an opening end reflection at the upstream open end 28*a* of the tail pipe 28 to become a new reflection wave the same in phase as the previous reflection wave and is opposite in advance direction to the previous reflection wave. This new reflection wave thus generated comes to be another incident wave and then becomes another reflection wave again at the opening portion 45 of the downstream open end 28*b* of the tail pipe 28.

The reason why the opening end reflection is caused at the opening portion 45 of the downstream open end 28*b* of the tail pipe 28 is due to the fact that the pressure of the exhaust gas flowing in the tail pipe 28 is high while the pressure of the outer space outward of the downstream open end 28*b* of the tail pipe 28 is low, so that the incident wave vigorously discharged to the atmosphere causes the pressure of the exhaust gas in the downstream open end 28*b* to be decreased, thereby causing the exhaust gas having the decreased pressure in the downstream open end 28*b* to start advancing toward the upstream open end 28*a* of the tail pipe 28.

Therefore, the reflection wave comes to be the same in phase as the incident wave and is opposite in advance direction to the incident wave. Further, the reason why the reflection wave is generated at the upstream open end 28*a* of the tail pipe 28 is the same as the reason why the reflection wave is generated at the downstream open end 28*b* of the tail pipe 28.

The incident wave toward the opening portion 45 of the downstream open end 28*b* of the tail pipe 28 is interfered with the reflection wave advancing in an opposite direction from the opening portion 45 of the downstream open end 28*b* of the tail pipe 28, thereby generating a standing wave having a sound pressure distribution with nodes corresponding to, viz., occupying the upstream open end 28*a* and the opening portion 45 of the downstream open end 28*b* of the tail pipe 28.

When the pipe length L (see FIG. 2) of the tail pipe 28 is in special relationship with a wave length λ of the standing wave, the standing wave comes to have an extremely large amplitude and thus generates an air column resonance. The air column resonance thus generated is on the basis of a standing wave having a half wave length for the pipe length L of the tail pipe 28. When the standing wave having a wave length corresponding to the pipe length L obtained by multiplying inverse of a natural number to the half wave length is generated, the sound pressure in the tail pipe 28 is increased, thereby causing noises.

Figure 7:
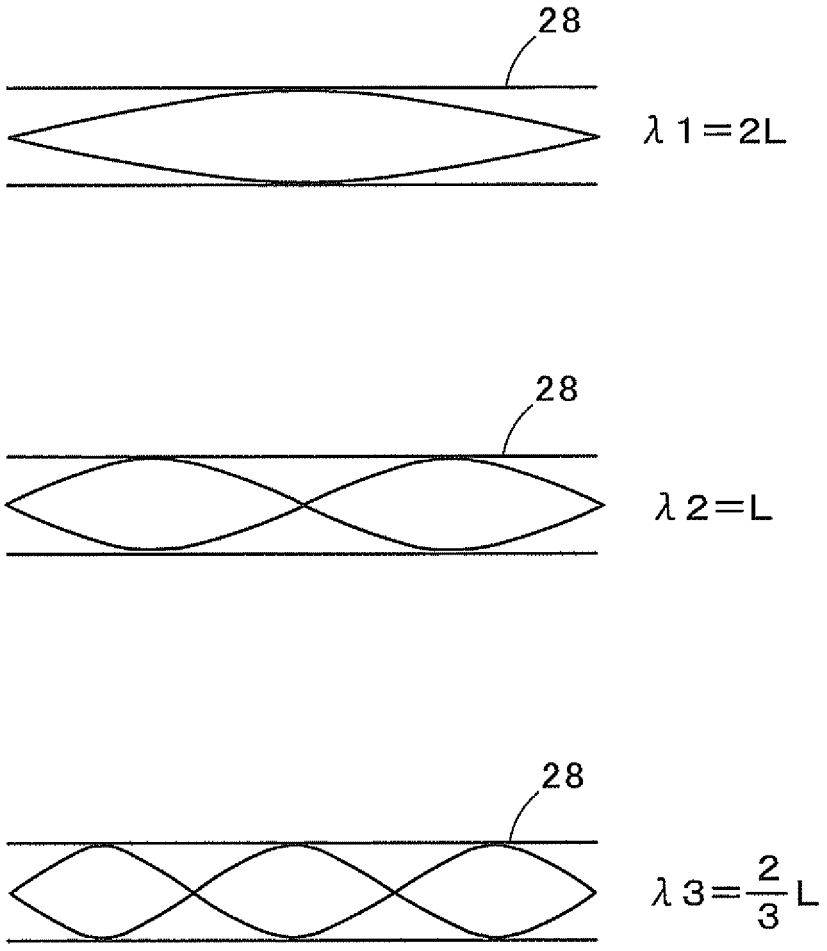
FIG. 7 shows views of the first embodiment of the exhaust apparatus of the internal combustion engine according to the present invention, and shows explanatory views for explaining standing waves in sound pressure distributions of air column resonances each caused by an opening end reflection generated in the tail pipe.

FIG. 7 shows sound pressure distributions of standing waves of, air column resonances. The wave length λ1 of the air column resonance with the basic vibration (primary component) is two times the pipe length L of the tail pipe 28, and the wave length λ2 of the air column resonance with the secondary component is one time the pipe length L of the tail pipe 28. The wave length λ3 of the air column resonance with the tertiary component is ⅔ times the pipe length L of the tail pipe 28. Each of the standing waves have nodes of the sound pressure distribution corresponding to, viz., occupying the upstream open end 28*a* and the downstream open end 28*b* of the tail pipe 28. The swing plate 41 according to the present embodiment is provided at the downstream open end 28*b* of the tail pipe 28, meaning that the swing plate 41 is positioned at one of the nodes of the sound pressure distribution of the standing wave of the air column resonance.

Figure 8:
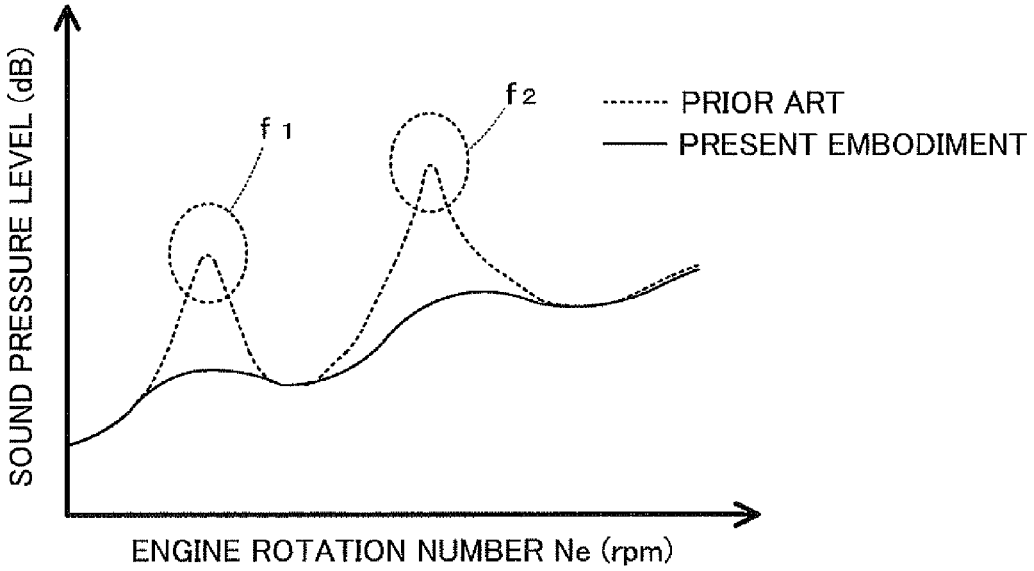
FIG. 8 shows a view of the first embodiment of the exhaust apparatus of the internal combustion engine according to the present invention, and is a graph showing the relationship between a sound pressure level generated in the tail pipe and an engine rotation number.
Figure 9:
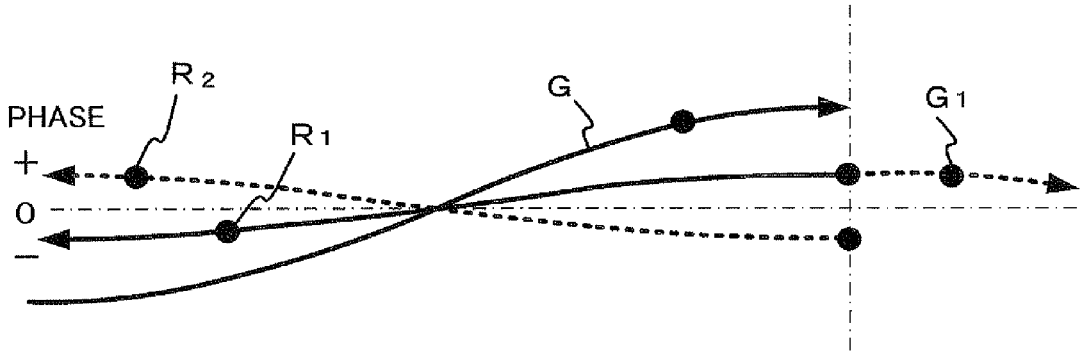
FIG. 9 shows a view of the first embodiment of the exhaust apparatus of the internal combustion engine according to the present invention, and is an explanatory view for explaining a state in which an incident wave G is distributed to a transparent wave G1 and reflection waves R1, R2 at the downstream opening end of the tail pipe.

As shown in FIG. 8, the sound pressure levels (dB) of the exhaust gas reach maximum levels at the rotation numbers of the engine corresponding to the frequencies of the air column resonance of the primary component f1, and the secondary component f2 in response to the increased rotation numbers Ne (rpm) of the engine.

Here, assuming that the speed of sound in air is c(m/s), the length of the tail pipe 28 is L(m), and the degree is "m", the frequency fm (Hz) of the air column resonance of the tail pipe 28 is given by the following equation (2).

$$fm=(c/2L)\times m \tag{2}$$

c: speed of sound, L: length of tail pipe, m: degree

Further, assuming that the rotation number of the engine is Ne, and the number of cylinders is N, the frequency fe of the exhaust gas pulsation of the engine is given by the following equation (3).

$$fe=(Ne/60)\times(N/2) \tag{3}$$

As will be appreciated from the above equation (2), (3), the frequency fin of the air column is transferred to the low frequency area with the low rotation number Ne of the engine 21 as the pipe length L of the tail pipe 28 becomes lengthened.

It will therefore be understood that, when the tail pipe 28 having a long pipe length is used, the air column resonance is occasionally generated in the normal rotation area where the rotation number Ne of the engine 21 is low, thereby causing deteriorated exhaust gas noises, and thus leading to imparting unpleasant feelings to the driver.

For the air column resonance frequency of the tertiary component, the rotation number Ne of the engine 21 exceeds the normal rotation area of the engine 21, so that the noises caused by the air column resonance is not so unpleasant for the driver due to the various noises such as wind noises generating during the high speed cruising of the vehicle. Therefore, there is almost no problem occurred for the tertiary component and other components exceeding the tertiary component.

The exhaust apparatus 20 according to the present embodiment is provided at the downstream open end 28*b* of the downstream portion 28B with a swing plate 41 capable of receiving only the exhaust gas flow to be swingable around the center axis of the swing shaft 43 and to have the passage cross-sectional area in the tail pipe 28 be variable. The swing plate 41 has a lower projection portion 41*b* which partly serves to throttle the passage cross-sectional area of the tail pipe 28 to a minimum level when the air column resonance is generated in the tail pipe 28 to have the swing plate 41 swung by receiving the exhaust gas flow amount in response to the operation of the engine 21, so that two reflection waves, i.e., the opening end reflection and the closed end reflection are generated at the downstream open end 28*b* of the downstream portion 28B, thereby suppressing the sound pressure level (dB) caused by the air column resonance from being increased.

The following explanation will be made hereinafter about the reason why the sound pressure level is suppressed from being increased.

Assuming that the opening area of the opening portion 45 is S1, the opening area of the downstream open end 28*b* is S2, and acoustic impedances of mediums are Z1, Z2, the reflection ratio Rp of the sound is given by the following equation (4).

$$Rp=\frac{Z2\cdot S2-Z1\cdot S1}{Z1\cdot S1+Z2\cdot S2} \tag{4}$$

Here, the acoustic impedance is a product of the density of the medium and the sound speed. In this case, the medium is the exhaust gas, and thus Z1=Z2. The reflection ratio Rp of the sound is given by the following equation (5).

$$Rp=\frac{S2-S1}{S1+S2} \tag{5}$$

When the closed end reflection caused by the swing plate 41 is identical in strength to the opening end reflection caused by the opening portion 45, both the reflections can be suppressed by the interference between the closed end reflection and the opening end reflection. For allowing the swing plate 41 to perform the closed end reflection identical in strength to the opening end reflection caused by the opening portion 45, the reflection ratio Rp is required to be 0.5, and thus from the above equation (5), the equation S1=(⅓)·S2 can be obtained.

Therefore, when the swing plate 41 is swung to have the opening area of the opening portion 45 in the state closing the downstream open end 28*b* become ⅓ the opening area of the downstream open end 28*b*, the sound pressure level comes to be suppressed to its lowest level.

The following explanation will be made about the case in which the incident wave G caused by the exhaust gas pulsation in the operation of the engine 21 is introduced into the tail pipe 28, and the incident wave G has a wave length equal to a half wave length corresponding to the pipe length L of the tail pipe 28.

As shown in 9, the incident wave G is discharged through the opening portion 45 at the downstream open end of the tail pipe 28 to the atmosphere as a transmissive wave G1, and is reflected to becomes a reflection wave R1 (opening end reflection wave) from the downstream open end 28*b* toward the upstream open end 28*a*. Further, the incident wave G is reflected by the swing plate 41 to become a reflection wave R2 (closed end reflection wave) from the downstream open end 28*b* toward the upstream open end 28*a*.

The reflection wave R1 is an open end reflection wave the same in phase as the incident wave G, while the reflection wave R2 is a closed end reflection wave displaced by 180 degrees in phase with respect to the incident wave G.

The reflection wave R1 is the same in phase as the incident wave G, and thus is overlapped with the incident wave G. However, the reflection wave R1 is shown as being downwardly displaced with respect to the incident wave G for the sake of convenience to explain about these waves in FIG. 9.

As explained in the above description, the reflection wave R1 is the same in phase as the incident wave G, so that when the frequency of the incident wave G becomes equal to the frequency of the air column resonance in the tail pipe 28, the incident wave G and the reflection wave R1 are interfered and strengthened with each other, thereby leading to increasing the sound pressure level of the exhaust gas sound.

In contrast, the reflection wave R2 is displaced by 180 degrees in phase with respect to the reflection wave R1 and the incident wave G, so that the incident wave G and the reflection wave R2 cancel each other, thereby leading to decreasing the sound pressure level of the exhaust gas sound.

For example, as shown in FIG. 8, when the frequency of the incident wave G caused by the pulsation of the exhaust gas becomes equal to the primary component f1 of the air column resonance frequency of the tail pipe 28, the sound pressure level is increased (to the maximum level) as shown in the broken lines only with the interference caused by the reflection wave R1, i.e., the open end reflection wave, however, if there is caused the reflection wave R2, i.e., the closed end reflection wave, the sound pressure level caused by the air column resonance can be suppressed from being increased as shown in solid lines, thereby making it possible to drastically decrease the sound pressure level of the exhaust gas sound.

When the frequency of the incident wave G caused by the pulsation of the exhaust gas becomes equal to the secondary component f2 of the air column resonance frequency of the tail pipe 28, the sound pressure level increased with the interference caused by the reflection wave R1, i.e., the open end reflection wave can similarly be suppressed from being increased with the reflection wave R2, i.e., the closed end reflection wave, thereby making it possible to drastically decrease the sound pressure level of the exhaust gas sound.

Here, the previous explanation has been made about the case in which the swing plate 41 is swung to close the downstream open end 28*b*, and the sound pressure level is suppressed to the lowest level when the opening portion 45 becomes ⅓ the opening area of the downstream open end 28*b*, however, the suppressive effect of the sound pressure level of the air column resonance caused by the interference of the closed end reflection wave can be generated if the opening portion 45 is not ⅓ the opening area of the downstream open end 28*b*.

However, the suppressive effect of the sound pressure level is remarkably decreased when the predetermined ratio, for example, the opening ratio of the opening portion 45 is more than 70%.

For this reason, it is preferable that the opening ratio of the opening portion 45 be set to be below 70%. According to the present embodiment, the opening ratio of the opening portion 45 is set at a small opening ratio of 20%.

The exhaust apparatus according to the present embodiment is provided with a swing shaft 43 and a swing plate 41, the swing shaft 43 being connected with the downstream portion 28B of the tail pipe 28 to perpendicularly extend with respect to the center axis O of the tail pipe 28 and to be positioned outwardly of the center axis O of the tail pipe 28 and spaced apart from the center axis O of the tail pipe 28, and the swing plate 41 receiving only exhaust gas flow flowing in the tail pipe 28 to be swingable around the center axis of the swing shaft 43 to have the passage cross-sectional area in the tail pipe 28 be variable. The swing plate 41 is provided with a lower projection portion 41*b* for throttling the passage cross-sectional area to a predetermined passage cross-sectional area when the swing plate 41 is swung by the exhaust gas flow having an exhaust gas amount in response to the operation state of the engine 21 at the time of the air column resonance being generated.

The exhaust apparatus according to the present embodiment thus constructed results in the fact that when the air column resonances of the primary component f1 and the secondary component f2 are generated in the normal rotation area of the engine 21, the swing plate 41 is positioned to take a swing position substantially extending vertically, thereby throttling the opening ratio of the opening portion 45 of the tail pipe 28 to a degree of 20%. This makes it possible to generate a closed end reflection wave displaced by 180 degrees in phase with respect to the opened end reflection wave becoming a cause to generate the air column resonance, so that the closed end reflection wave and the open end reflection wave can be interfered with each other, thereby enabling the sound pressure level to be suppressed from being increased even if the air column resonance is generated.

When, on the other hand, the speed of the engine 21 is reduced with the throttle valve being closed under the high rotation area of the engine 21, the amount of the exhaust gas is drastically decreased to lower the exhaust gas pressure acting on the receiving surface 41*a* of the swing plate 41. For this reason, the swing plate 41 is promptly swung to have the receiving surface 41*a* of the swing plate 41 positioned in the upstream side with respect to the vertical axis H, thereby making it possible to throttle the opening ratio of the opening portion 45 to around the degree of 20%.

This results in the fact that when the air column resonances of the primary component f1 and the secondary component f2 are generated in the normal rotation area of the engine 21, the closed end reflection wave displaced by 180 degrees in phase with respect to the opened end reflection wave causing to generate the air column resonance is generated, so that the closed end reflection wave can be interfered with the open end reflection wave, thereby enabling the sound pressure level to be suppressed from being increased even if the air column resonance is generated.

The swing plate 41 is constructed to be swung in the high rotation area of the engine 21 to have the opening portion opened to have a large opening, thereby making it possible to suppress the back pressure of the exhaust gas from being increased, and to suppress the sound of the gas flow from being generated.

As a consequence, the exhaust apparatus according to the present embodiment can have no need to control the swing plate 41 with a control unit and an electromagnet actuator, or to size up the muffler 27 (corresponding to a conventional main muffler), or to provide a sub-muffler in the tail pipe 28 as needed by the conventional apparatuses, thereby making it possible to prevent the exhaust apparatus 20 from being increased in weight, to prevent the exhaust apparatus 20 from being increased in production cost, and to suppress the sound pressure level caused by the air column resonance from being increased with a simple construction having no complicated control to be added to the apparatus.

Further, the lower projection portion 41*b* of the swing plate 41 in the exhaust apparatus according to the present embodiment is constructed in the form of a curved shape along the swing locus C of the lower end portion of the receiving surface 41*a* when the swing plate 41 is swung, so that the opening portion 45 can be maintained to have a predetermined opening area of 20% even if the swing plate 41 is swung within the predetermined angular range at the time of the air column resonance being generated.

More specifically, even if the swing plate 41 is, as shown in FIG. 6, swung within the predetermined angular range to the upstream side or to the downstream side from the vertical position shown in solid lines by the exhaust apparatus 20 vibrated at the time of the air column resonance being generated, the opening portion 45 can be maintained to have a constant opening area of 20%.

Figure 10:
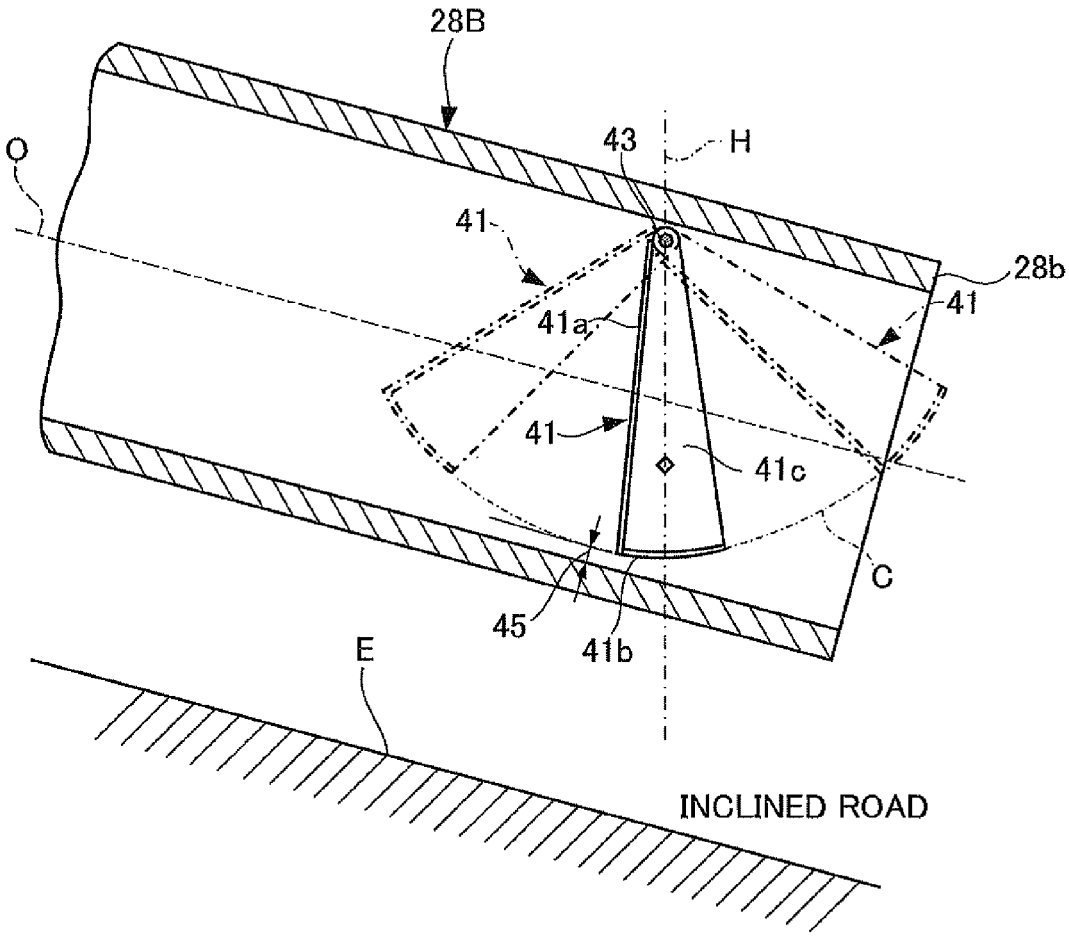
FIG. 10 shows a view of the first embodiment of the exhaust apparatus of the internal combustion engine according to the present invention, and is a cross-sectional view of the tail pipe inclined on the sloping road when the vehicle is running on the inclined road surface.

Further, in the case as shown in FIG. 10 that the air column resonance is generated under the state of the swing plate 41 being inclined toward the downstream side by the tail pipe 28 inclined on the sloping road when the vehicle is running on the inclined road surface E, the opening portion 45 can be maintained to have the constant opening area of 20% even if the swing plate 41 is swung within the predetermined angular range.

As a result, it is possible to reliably suppress the air column resonance from being generated, and to suppress the noises from being generated in response to the swinging motions of the swing plate 41 at the time of the air column resonance being generated, thereby making it possible to suppress the noises.

Further, the exhaust apparatus according to the present embodiment is constructed to have a lower projection portion 41*b* projecting from the lower end portion of the receiving surface 41*a* toward the downstream side of the exhaust gas direction, and side projection portions 41*c* projecting from the both widthwise end portions of the receiving surface 41*a*, respectively, so that the exhaust gas flow can be rectified to suppress the sound of the gas flow from being generated.

Figure 11:
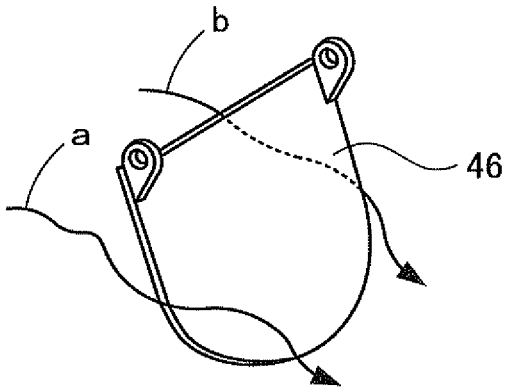
FIG. 11 shows a view of the first embodiment of the exhaust apparatus of the internal combustion engine according to the present invention, and is a perspective view showing an exhaust gas flow and a swing plate which is not provided with a lower projection portion and side projection portions.
Figure 12:
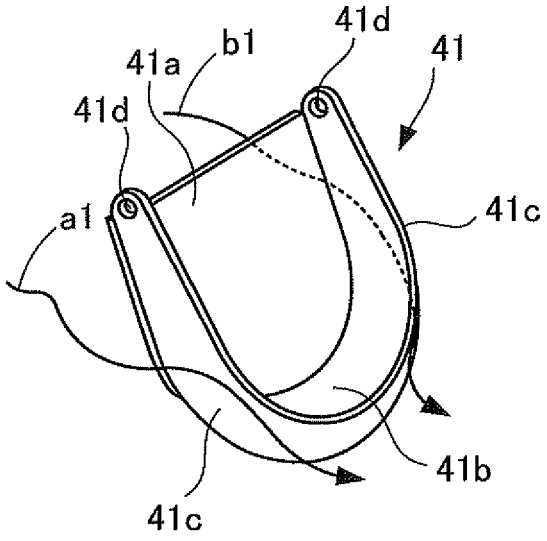
FIG. 12 shows a view of the first embodiment of the exhaust apparatus of the internal combustion engine according to the present invention, and is a perspective view showing an exhaust gas flow and the swing plate which is provided with a lower projection portion and side projection portions.

As shown in FIG. 11, the swing plate 46 not provided with the lower projection portion 41*b* and side projection portions 41*c* generates turbulent flows and thus generate the sound of the gas flow when the exhaust gas flows "a", "b" pass through the gaps between the lower end portion and the both widthwise end portions of the swing plate 46 and the inner peripheral surface of the downstream portion 28B of the tail pipe 28.

In contrast, the exhaust apparatus according to the present embodiment is constructed to have the lower projection portion 41*b* and the side projection portions 41*c* at the lower end portion and the both widthwise end portions of the swing plate 41, respectively, so that the exhaust gas flows "a1", "b1" can be rectified by the lower projection portion 41*b* and the side projection portions 41*c*.

For this reason, it is possible to prevent the turbulent flow from being generated and to prevent the sound of the exhaust gas flow from being generated when the exhaust gas flows "a1", "b1" pass through the gaps between the downstream portion 28B of the tail pipe 28 and the lower projection portion 41*b* and the both widthwise end portions 41*c* of the swing plate 41.

Although the swing plate 41 is provided only at the downstream portion 28B of the tail pipe 28 in the present embodiment, the swing plate 41 may be provided only at the upstream portion 28A of the tail pipe 28. The swing plates 41 may be provided at the downstream portion 28B and the upstream portion 28A, respectively, of the tail pipe 28.

Even in the case that the swing plate 41 is provided only at the upstream portion 28A of the tail pipe 28 and in the case that the swing plates 41 are provided at the downstream portion 28B and the upstream portion 28A, respectively, of the tail pipe 28, the reflection waves reflected at the upstream open end 28*a* of the tail pipe 28 can be distributed into two reflection waves, viz., the reflection wave R1 reflected by the opening portion 45 of the swing plate 41, and the reflection wave R2 reflected by the swing plate 41, thereby making it possible to suppress the sound pressure level from being increased by the air column resonance.

The present embodiment has been explained about the case in which the swing plate 41 is provided at the downstream portion 28B of the tail pipe 28, however, the swing plate 41 is sufficient to have a position corresponding to the node of the sound pressure distribution of the standing wave of the air column resonance. For example, as shown in FIG. 7, the swing plate 41 may be disposed at a position corresponding to the central node of the sound pressure distribution of the secondary component, viz., at the central portion of the tail pipe 28.

Second Embodiment

Figure 13:
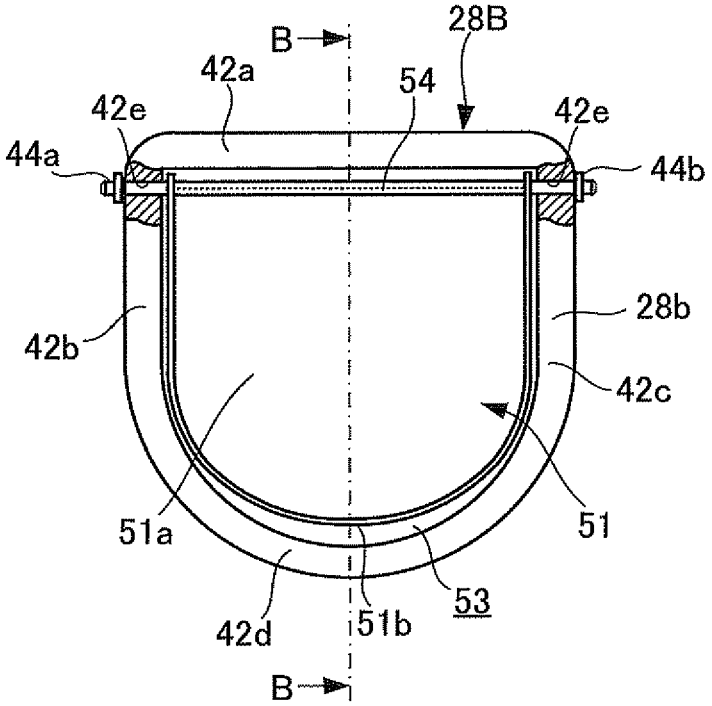
FIG. 13 shows a view of a second embodiment of the exhaust apparatus of the internal combustion engine according to the present invention, and is a front elevational view of the tail pipe as seen from the axial direction of the tail pipe.
Figure 14:
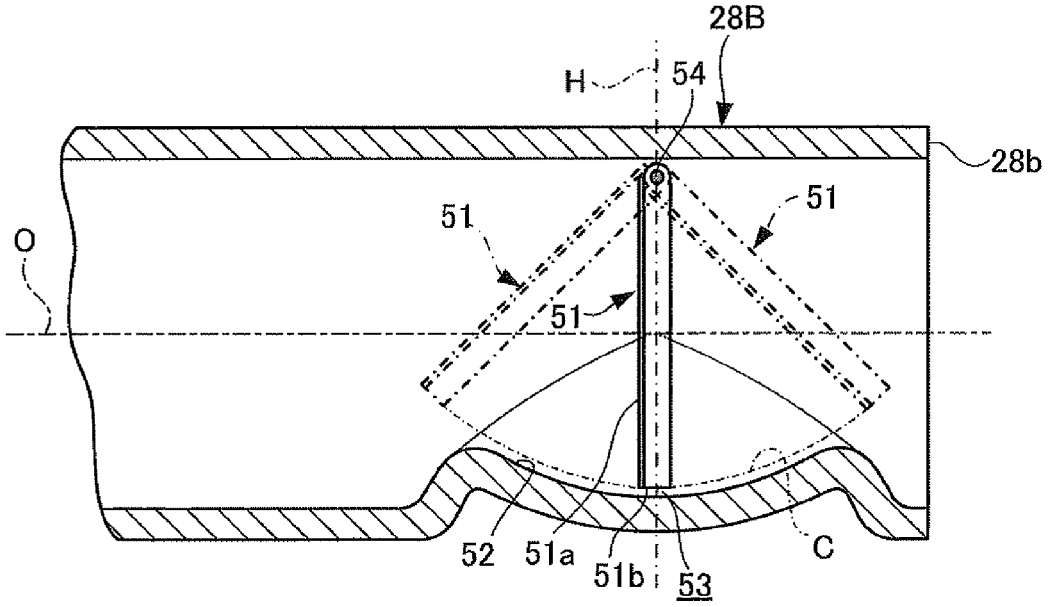
FIG. 14 shows a cross-sectional view of the tail pipe taken along and seen from the lines B-B in FIG. 13.

FIGS. 13 and 14 show the second embodiment of the exhaust apparatus of the internal combustion engine according to the present invention. The constitution elements and parts of the second embodiment the same as the constitution elements and part of the first embodiment are illustrated with the reference numerals the same as the reference numerals of the first embodiment, and the detailed explanation about the second embodiment will be omitted hereinafter.

In FIG. 13, the second embodiment of the exhaust apparatus is provided with a swing plate 51 serving as a valve body and having a receiving surface 51*a* for receiving the exhaust gas flow. The swing plate 51 is swingably supported on the downstream portion 28B of the tail pipe 28 through a swing shaft 54 having both end portions supported on the downstream portion 28B of the tail pipe 28.

The downstream portion 28B of the tail pipe 28 is provided at its inner peripheral lower portion with a curved portion 52 partly constituting a throttle unit and having a curved surface curved along the swing locus C of the lower end portion 51*b* of the swing plate 51.

This means that between the lower end portion 51*b* of the swing plate 51 and the curved portion 52 is formed an opening portion 53 having a constant opening area, i.e., a predetermined passage cross-sectional area be constant in the swing range of the swing plate 51.

The exhaust apparatus according to the present embodiment is constructed to have the curved portion 52 provided at its inner peripheral lower portion of the downstream portion 28B of the tail pipe 28 to have a curved surface curved along the swing locus C of the lower end portion 51*b* of the swing plate 51, so that even if the swing plate 51 is swung within the predetermined angular range to the upstream side or the downstream side from the vertical position shown in solid lines shown in FIG. 14 by the exhaust apparatus 20 vibrated at the time of the air column resonance being generated, the gap between the lower end portion 51*b* of the swing plate 51 and the curved portion 52 can be constant, and thus the opening portion 53 can be maintained to have a constant opening area of 20%.

Further, in the case that the air column resonance is generated under the state of the swing plate 51 being inclined toward the downstream side by the tail pipe 28 inclined on the sloping road when the vehicle is running on the inclined road surface, the opening portion 53 can be maintained to have the constant opening area of 20% even if the swing plate 51 is swung within the predetermined angular range. For this reason, the air column resonance can reliably be suppressed from being generated.

Third Embodiment

Figure 15:
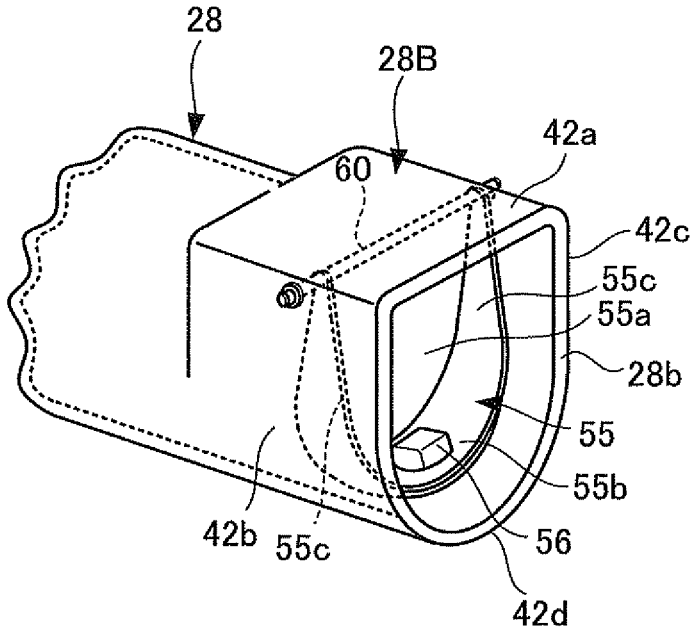
FIG. 15 shows a view of the third embodiment of the exhaust apparatus of the internal combustion engine according to the present invention, and is a perspective view of the other end portion of the tail pipe.
Figure 18:
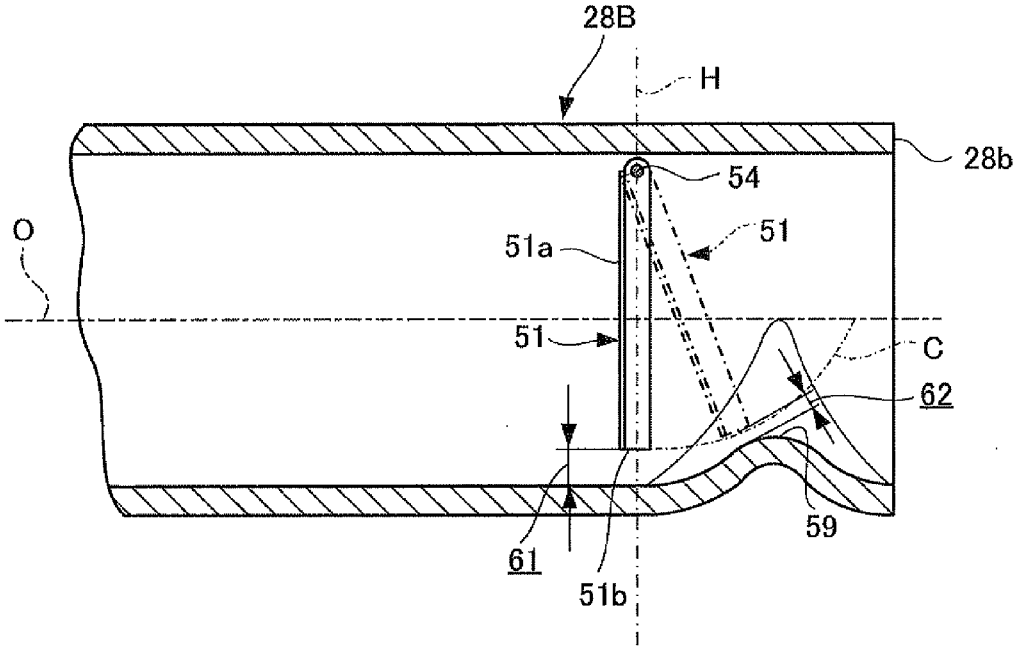
FIG. 18 shows a view of the third embodiment of the exhaust apparatus of the internal combustion engine according to the present invention, and is a cross-sectional view of the tail pipe having another shape.

FIGS. 15 and 18 show the third embodiment of the exhaust apparatus of the internal combustion engine according to the present invention. The constitution elements and parts of the third embodiment the same as the constitution elements and part of the first embodiment are illustrated with the reference numerals the same as the reference numerals of the first embodiment, and the detailed explanation about the third embodiment will be omitted hereinafter.

Figure 16:
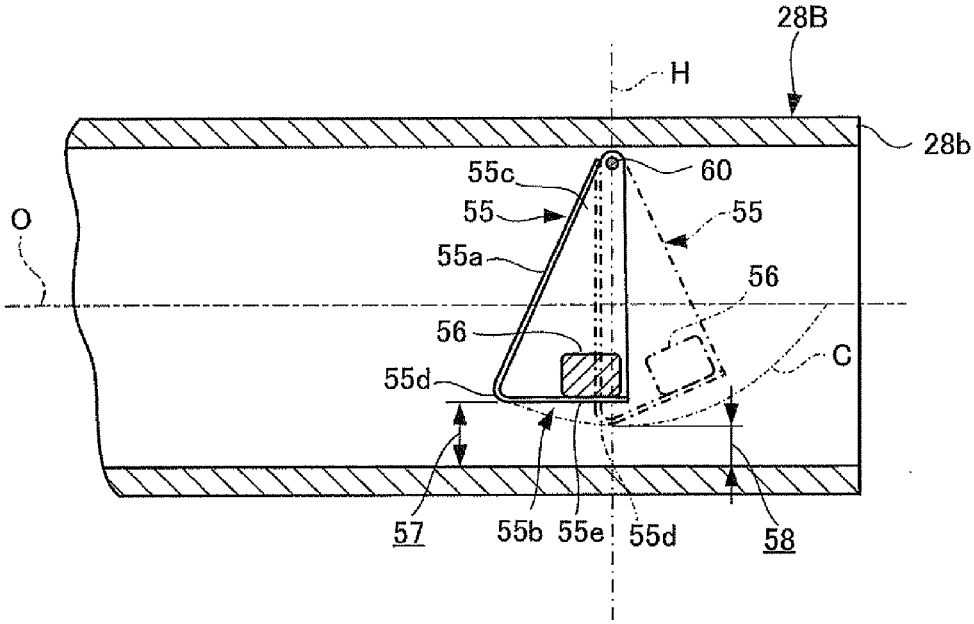
FIG. 16 shows a view of the third embodiment of the exhaust apparatus of the internal combustion engine according to the present invention, and is a cross-sectional view of the tail pipe.

In FIGS. 15 and 16, the third embodiment of the exhaust apparatus is provided with a swing plate 55 serving as a valve body and formed in a semi-circular shape. The swing plate 55 has a receiving surface 55*a* for receiving the exhaust gas flow, a lower projection portion 55*b* projecting toward the downstream side of the exhaust gas flow from the lower end portion of the receiving surface 55*a* and serving as part of a throttle unit, and side projection portions 55*c* projecting toward the downstream side of the exhaust gas flow from the both widthwise end portions of the receiving surface 55*a* and serving as a guide portion. The lower projection portion 55*b* and the side projection portions 55*c* are integrally formed with each other.

The swing plate 55 is swingably supported on the downstream portion 2813 of the tail pipe 28 through a swing shaft 60 having both end portions swingably supported on the downstream portion 28B of the tail pipe 28.

The lower projection portion 55*b* has a weight 56 mounted thereon. The swing plate 55 is set to have a gravity center to have the receiving surface 55*a* take a swing position where the receiving surface 55*a* is positioned upstream of the vertical axis H by the weight 56. The swing position becomes an initial position of the swing plate 55.

The swing plate 55 is set to have such a weight that the swing plate 55 is positioned at a swing angle to have the passage cross-sectional area of the tail pipe 28 to be throttled to the predetermined passage cross-sectional area by the weight 56 when the swing plate 55 receives the exhaust gas flow at the time of the engine being operated to generate the air column resonance. Further, the initial position of the swing plate 55 is indicative of a swing position of the swing plate 55 while the engine 21 is in an idling operation state.

In the present embodiment, when the swing plate 55 is positioned at the initial position, the section (hereinafter simply referred to as a "front section 55*e*") of the swing plate 55 flatly extending from the R-shaped base section 55*d* of the lower projection portion 55*b* to the section of the lower portion 55*b* in the downstream side of the tail pipe 28 causes the passage cross-sectional area of the tail pipe 28 to be larger than the passage cross-sectional area of the tail pipe 28 at the time of the air column resonance being generated More specifically, the swing plate 55 is positioned at the initial position shown in solid lines in FIG. 16 to form an opening portion 57 between the front section 55*e* and the inner peripheral surface of the downstream portion 28B of the tail pipe 28 when the engine 21 having a small amount of exhaust gas flow is in the idling operation state.

When the engine 21 is operated at the time of the air column resonance being generated, and thus has an increased amount of exhaust gas flow more than the amount of the exhaust gas flow in the idling operation state, the swing plate 55 is swung to the downstream side to form a small opening portion 58, smaller than the opening portion 57, between the base section 55*d* and the inner peripheral surface of the downstream portion 2813 of the tail pipe 28. The opening ratio of the opening portion 58 is set at about 20%, while the opening ratio of the opening portion 57 is set at more than 20%.

Next, the operation of the third embodiment will be described hereinafter.

Figure 17:
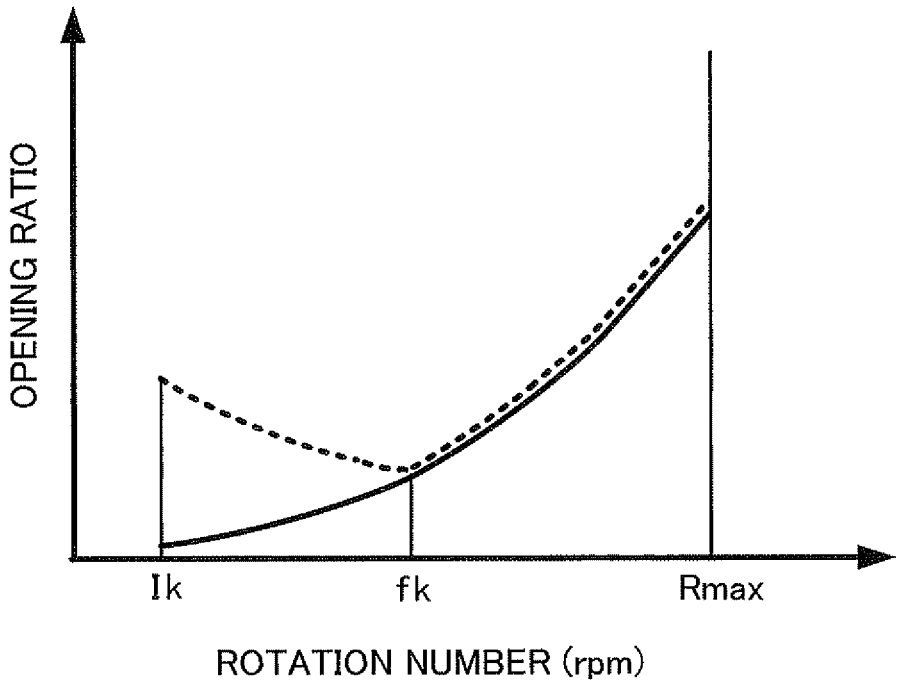
FIG. 17 shows a view of the third embodiment of the exhaust apparatus of the internal combustion engine according to the present invention, and is a view showing the relationship between the engine rotation numbers for the tail pipe having an opening property (solid line) having a linear form and for the tail pipe having an opening property (broken line) having a non-linear form in the present embodiment, and the opening ratio of the tail pipe.

The swing plate in the form of a plate shape having no lower projection portion 55*b* has an open ratio of the tail pipe 28 increased in proportion to the rotation number, i.e., exhaust gas flow amount of the engine 21 as shown in FIG. 17.

When the engine 21 is in the idling operation state (1k) with the small amount of exhaust gas flow, the opening of the tail pipe 28 comes to be at the minimum level, so that when the exhaust gas flow passes through the opening portion having the minimum opening, the sound of the exhaust gas flow is generated, and thus leading to generating unpleasant noises to the driver.

In the present embodiment, the base section 55*d* of the lower projection portion 55*b* partly constitutes a throttle unit. The initial position of the swing plate 55 in the idling operation state of the engine 21 is set as a swing position in which the receiving surface 55*a* is positioned upstream of the vertical axis H, so that the opening portion 57 of the tail pipe 28 is larger than the opening portion 58 of the tail pipe 28 by the front section 55*e* excluding the base section 55*d* at the time of the air column resonance being generated. This makes it possible to suppress the noises such as for example the sounds of whistles and the like caused by the exhaust gas flow in the idling operation state of the engine 21 from being generated.

When the rotation number of the engine 21 reaches the air column resonance rotation number (1k) more than the idling rotation number of engine 21, the swing plate 55 receives the exhaust gas flow and thus is swung toward the downstream side as shown in phantom lines in FIG. 16, so that the base section 55*d* of the swing plate 55 causes the passage cross-sectional area of the tail pipe 28 to be throttled to the predetermined passage cross-sectional area, thereby making it possible to form the opening portion 58. For this end, similarly to the first embodiment, the opening ratio of the tail pipe 28 is decreased, thereby making it possible to prevent the sound pressure level caused by the air column resonance from being increased.

At the time of the high rotation of the engine 21 (more than 1k, here, Rmax indicative of the highest rotation number of the engine) having the exhaust gas flow of the engine 21 increased, the pressure of the exhaust gas flow causes the swing plate 55 to be swung sufficiently toward the downstream side, thereby making it possible to increase the passage cross-sectional area of the tail pipe 28.

For this reason, it is possible to suppress the back pressure of the exhaust gas flow from being increased and to suppress the sound of exhaust gas flow, thereby making it possible to prevent the exhaust gas discharging property from being lowered.

Further, the present embodiment has been explained raising an example in which the swing plate 55 has a lower projection portion 55*b* having a front section 55*e* by which the opening ratio of the tail pipe 28 in the idling operation state of the engine 21 is made large, however, the swing plate may be constructed as shown in FIG. 18 without providing no lower projection portion 55*b* to the swing plate 55.

In FIG. 18, there is shown at the downstream portion 28B of the tail pipe 28 a swing plate 51 having constitution elements and parts the same as those of the second embodiment. On the inner peripheral lower portion of the downstream portion 28B of the tail pipe 28 is formed a protrusion portion 59 serving as part of a throttle unit and projecting toward the center axis O of the tail pipe 28 from the inner peripheral lower portion of the downstream portion 28B of the tail pipe 28.

The protrusion portion 59 is in opposing relationship with the lower end portion 51*b* of the swing plate 51 when the swing plate 51 is swung from its initial position toward the downstream side of the exhaust gas flow. In the state of the swing plate 51 being swung, the passage cross-sectional area of the tail pipe 28 is throttled from, viz., narrower than the passage cross-sectional area of the tail pipe 28 at the initial position of the swing plate 51 positioned on its vertical axis H.

The opening area of the opening portion 61 formed between the inner peripheral lower portion of the downstream portion 28B of the tail pipe 28 and the lower end portion 51*b* of the swing plate 51 when the swing plate 51 is positioned on the vertical axis H thereof is larger than the opening area of the opening portion 62 formed between the protrusion portion 59 and the lower end portion 51*b* of the swing plate 51.

The third embodiment constructed in the above enables the swing plate 51 to be swung to the initial position upstream of the protrusion portion 59 of the swing plate 51 to make large the passage cross-sectional area of the tail pipe 28, thereby making it possible to suppress the sounds of whistles and the like from being generated.

When the rotation number of the engine 21 reaches the air column resonance rotation number (fk) higher than the idle rotation number (1k), the swing plate 51 receives the exhaust gas flow and thus is swung from the initial position toward the downstream side to have the lower end portion 51*b* of the swing plate 51 brought into opposing relationship with the protrusion portion 59, thereby making it possible to set the opening portion 62 throttled in passage cross-sectional area. It is therefore possible to lower the opening ratio of the tail pipe 28 and to prevent the sound pressure level caused by the air column resonance from being increased.

At the time of the high rotation number of the engine 21 (more than 1k) having the exhaust gas flow of the engine 21 increased, the pressure of the exhaust gas flow causes the swing plate 51 to drastically be swung toward the downstream side, thereby making it possible to make large the passage cross-sectional area.

For this reason, it is possible to suppress the back pressure of the exhaust gas flow from being increased and to suppress the sound of exhaust gas flow, thereby making it possible to prevent the exhaust gas discharging property from being lowered.

Fourth Embodiment

Figure 19:
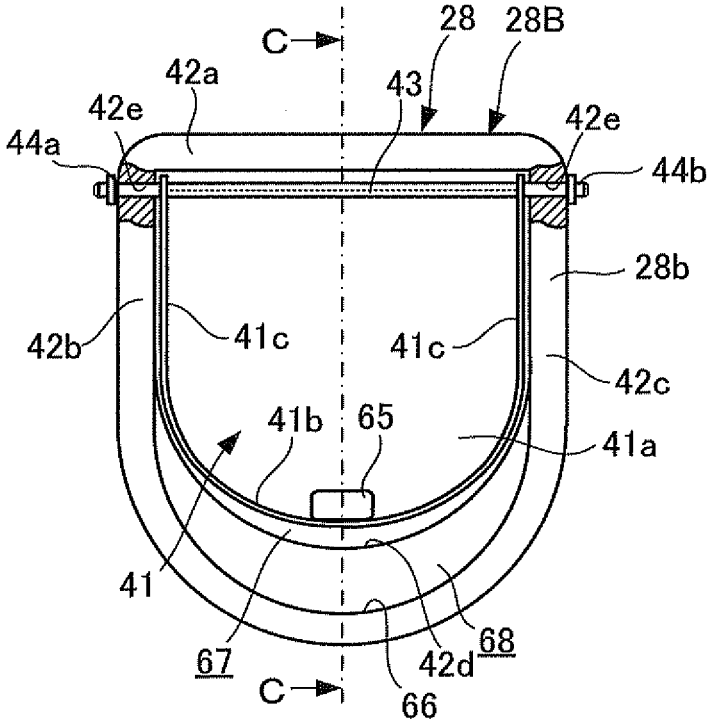
FIG. 19 shows a view of a fourth embodiment of the exhaust apparatus of the internal combustion engine according to the present invention, and is a front elevational view of the tail pipe as seen from the axial direction of the tail pipe.
Figure 23:
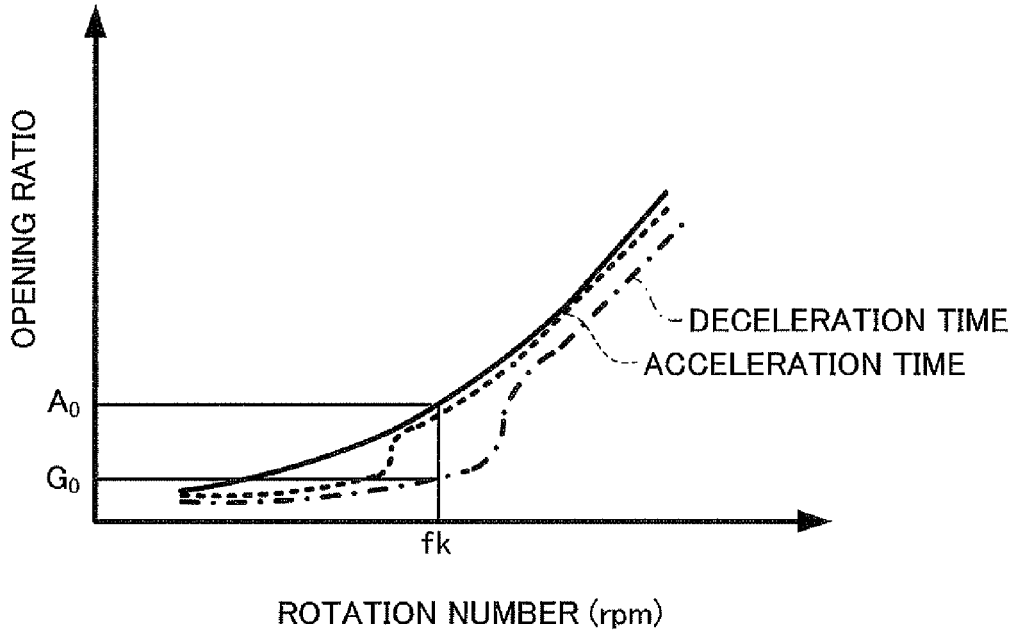
FIG. 23 shows a view of the fourth embodiment of the exhaust apparatus of the internal combustion engine according to the present invention, and is a view showing the relationship between the engine rotation numbers for the tail pipe having an opening property (solid line) having a linear form and for the tail pipe having an opening property (broken line) having a non-linear form at the acceleration and deceleration times in the present embodiment, and the opening ratio of the tail pipe.

FIGS. 19 and 23 show the fourth embodiment of the exhaust apparatus of the internal combustion engine according to the present invention. The constitution elements and parts of the fourth embodiment the same as the constitution elements and part of the first embodiment are illustrated with the reference numerals the same as the reference numerals of the first embodiment, and the detailed explanation about the fourth embodiment will be omitted hereinafter.

Figure 20:
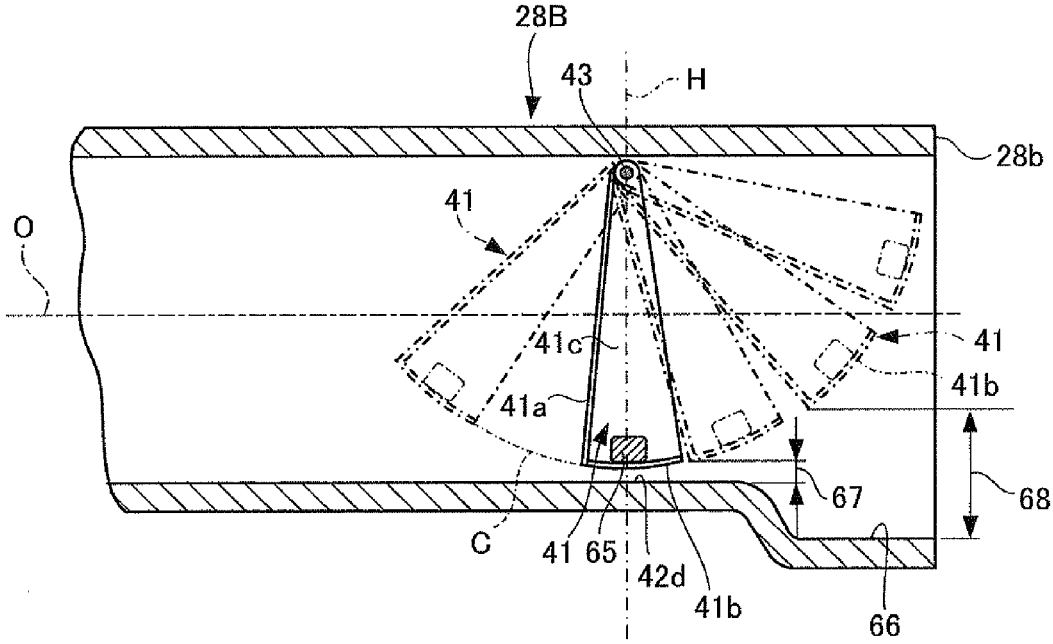
FIG. 20 shows a cross-sectional view of the tail pipe taken along and seen from the lines C-C in FIG. 19.

In FIGS. 19 and 20, the lower projection portion 41*b* of the swing plate 41 has a weight 65 mounted thereon. The swing plate 41 is set to have a gravity center to have the receiving surface 41*a* take a swing position where the receiving surface 41*a* is positioned upstream side of the vertical axis H by the weight 65. The swing position of the receiving surface 41*a* becomes an initial position of the swing plate 41.

The weight is set to have the swing plate 41 take a swing angle where the passage cross-sectional area of the tail pipe 28 is throttled to the predetermined cross-sectional area by the weight 65 when the swing plate 41 receives the exhaust gas flow at the time of the air column resonance rotation of the engine 21.

When the tail pipe 28 has a small amount of exhaust gas flow at the time of the vehicle being running at the reduced speeds, the swing plate 41 is constructed to be positioned at the initial position by the weight 65. The lower portion of the tail pipe 28 downstream of the swing plate 41 is formed with a diameter expansion portion (lower diameter expansion portion) 66 expanded from the passage cross-sectional area of the exhaust gas passage of the tail pipe 28.

In the initial state of the swing plate 41 shown in solid lines in FIG. 20, an opening portion 67 having a throttled passage cross-sectional area is formed between the lower projection portion 41*b* of the swing plate 41 and the inner peripheral surface of the downstream portion 28B of the tail pipe 28.

In the state of the swing plate 41 receiving the exhaust gas flow and thus being swung toward the downstream side with the vehicle being accelerated in the normal rotation area, the lower projection portion 41*b* of the swing plate 41 and the diameter expansion portion 66 form therebetween an opening portion 68 having an opening area larger than the open area (passage cross-sectional area) of the opening portion 67.

Further, the opening portion 68 has an opening area variable in response to the swing position of the swing plate 41 where the lower projection portion 41*b* is positioned above the diameter expansion portion 66.

Next, the operation of the fourth embodiment will be described hereinafter.

According to the present embodiment, the opening area of the opening portion of the tail pipe 28 set less than 70% makes it possible to suppress the air column resonance, however, at the acceleration and deceleration times in the normal rotation area of the vehicle, the exhaust gas flows are different from each other even with the equal rotation number of the engine 21 having the air column resonance generated. More specifically, even if the engine 21 is operated with the equal rotation number having the air column resonance generated, the exhaust gas flow is decreased at the deceleration time of the vehicle while the exhaust gas flow is increased at the acceleration time of the vehicle, thereby causing the swing plate 41 to take different positions at the acceleration and deceleration times.

For example, the swing plate 41 is positioned on the vertical axis H at the time of the deceleration having a small amount of exhaust gas, and thus the opening ratio of the opening portion 67 is decreased to a minimum level. Assuming that the tail pipe 28 is not provided with the diameter expansion portion 66 and the opening ratio of the tail pipe 28 is linearly increased in response to the swing motion of the swing plate 41 as shown by solid lines in FIG. 23, there is a possibility that the passage cross-sectional area of the tail pipe 28 cannot be sufficiently be throttled when the engine 21 is brought into the decelerated state and reaches the air column resonance rotation number.

In view of this problem, it may be considered to reduce to the minimum level the gap between the swing plate 41 and the inner peripheral surface of the downstream portion 28B of the tail pipe 28 to throttle the passage cross-sectional area of the tail pipe 28 at the deceleration time of the vehicle. In this case, however, at the time of the engine 21 being accelerated and reaching the air column resonance rotation number, it is impossible to make large the opening area of the tail pipe 28, so that it is considered that the back pressure of the exhaust gas flow is increased, thereby deteriorating the exhaust gas property.

The exhaust apparatus according to present embodiment is constructed to have a diameter expansion portion 66 in the tail pipe 28 downstream of the swing plate 41, so that when the swing plate 41 receives the exhaust gas flow and thus is swung to the downstream side, the passage cross-sectional area of the tail pipe 28 is increased by the lower projection portion 41*b* of the swing plate 41 and the diameter expansion portion 66, thereby making it possible to make large the opening ratio of the opening portion 68.

Figure 21:
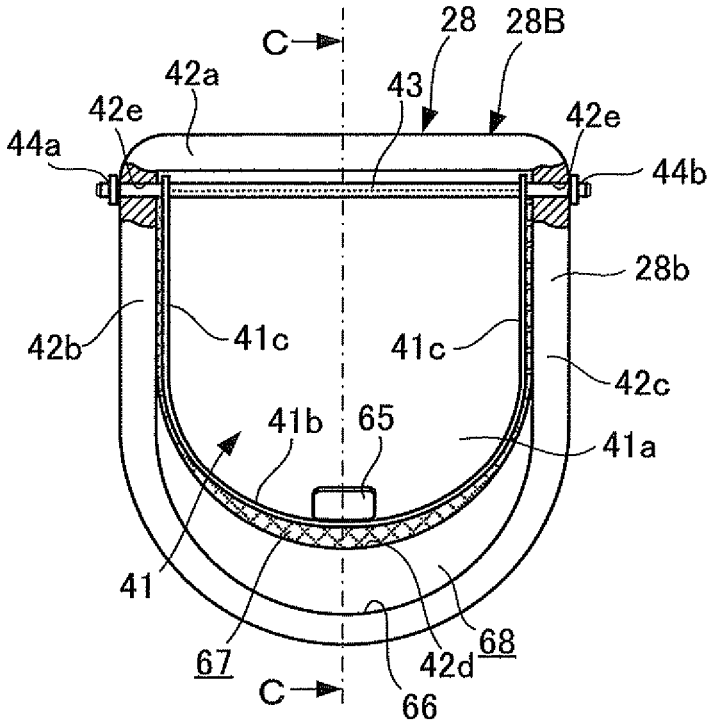
FIG. 21 shows a view of the fourth embodiment of the exhaust apparatus of the internal combustion engine according to the present invention, and is a front elevational view of the tail pipe as seen from the axial direction of the tail pipe showing an opening area of the tail pipe at the time of the air column resonance rotation when the vehicle is decelerating.

For this reason, when the vehicle is decelerated from the rotation number exceeding the air column resonance rotation number fk as shown by a chain line in FIG. 23, and the engine 21 reaches the air column resonance rotation number fk while the swing plate 41 is swung to the vertical axis H from the state that the swing plate 41 is drastically swung toward the downstream side, the passage cross-sectional area of the tale pipe 28 is throttled to the predetermined passage cross-sectional to have the opening ratio of the opening portion 67 reduced (see the opening ratio $G_o$ in FIG. 23). The opening area of the opening portion 67 is shown by cross-hatchings in FIG. 21.

For this reason, the reflection wave caused by the opening end reflection and the reflection wave caused by the closed end reflection are interfered with each other at the deceleration time of the vehicle, thereby making it possible to more drastically suppress the sound pressure level caused by the air column resonance in the tail pipe 28 from being increased.

Figure 22:
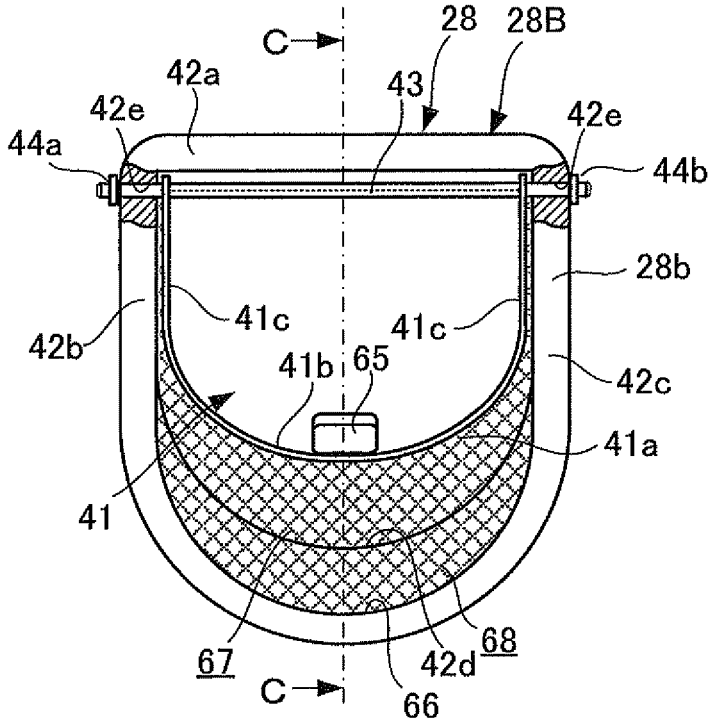
FIG. 22 shows a view of the fourth embodiment of the exhaust apparatus of the internal combustion engine according to the present invention, and is a front elevational view of the tail pipe as seen from the axial direction of the tail pipe showing an opening area of the tail pipe at the time of the air column resonance rotation when the vehicle is accelerating.

Even if the opening portion 67 of the tail pipe 28 is throttled to the opening ratio capable of suppressing the air column resonance at the deceleration time of the vehicle, the passage cross-sectional area of the tail pipe 28 can be increased by the lower projection portion 41*b* of the swing plate 41 and the diameter expansion portion 66 as shown in a broken line in FIG. 23 at the acceleration time of the vehicle, thereby making it possible to make large the opening ratio of the opening portion 68 (the opening area of the opening portion 68 is shown by the cross-hatchings in FIG. 22), and to suppress the back pressure of the exhaust gas flow from being increased. Further, the opening area of the opening portion 68 having a large amount of the exhaust gas flow at the acceleration time of the vehicle is made large, thereby making it possible to suppress the exhaust gas flow from being generated.

In addition, the opening ratio $A_o$ of the opening portion 68 in response to the air column resonance rotation number (fk) at the acceleration time of the vehicle can be less than 70%, so that the reflection wave caused by the opening end reflection and the reflection wave caused by the closed end reflection are interfered with each other at the acceleration time of the vehicle, thereby making it possible to suppress the sound pressure level caused by the air column resonance in the tail pipe 28 from being increased.

According to the present embodiment, the opening ratio of the opening portion 67 of the tail pipe 28 can be reduced at the decelerated time of the vehicle as shown by the chain line in FIG. 23, while the opening ratio of the opening portion 67 of the tail pipe 28 can be made large at the acceleration time of the vehicle as shown by the broken line in FIG. 23. For this end, the relationship between the swing position of the swing plate 41 and the opening area of the opening portion 67 of the tail pipe 28 can therefore be made in a non-linear shape.

For this reason, the opening ratio of the tail pipe 28 can be set at an optimum opening ratio which can suppress the air column resonance at the acceleration time and at the deceleration time of the vehicle in the normal rotation area, and can prevent the back pressure of the exhaust gas flow from being increased at the acceleration time of the vehicle, thereby improving the exhaust gas property.

Fifth Embodiment

Figure 24:
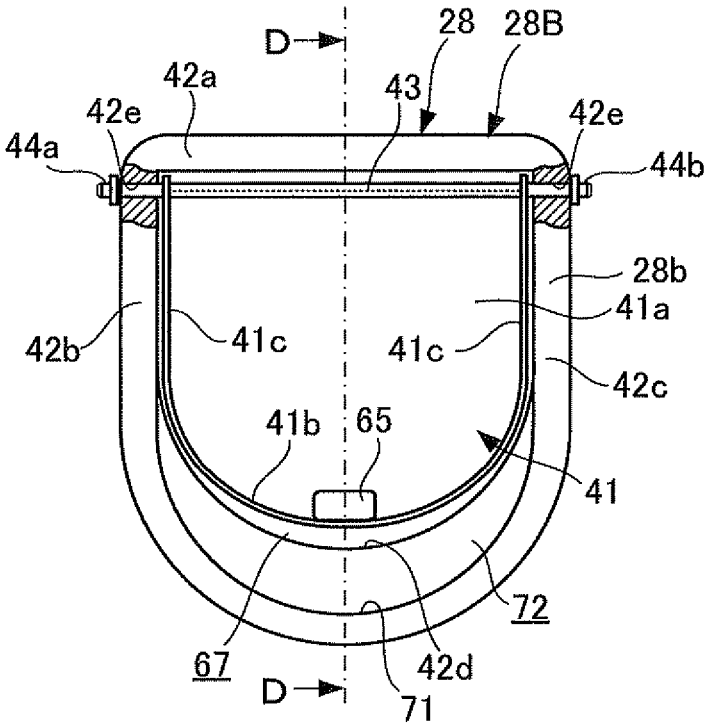
FIG. 24 shows a view of a fifth embodiment of the exhaust apparatus of the internal combustion engine according to the present invention, and is a front elevational view of the tail pipe as seen from the axial direction of the tail pipe.
Figure 29:
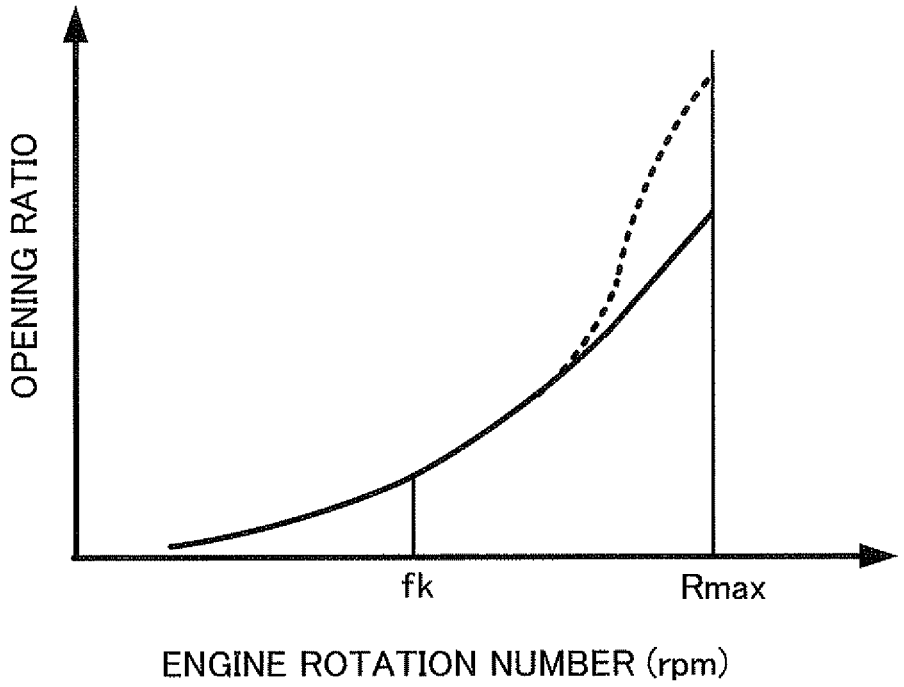
FIG. 29 shows a view of the fifth embodiment of the exhaust apparatus of the internal combustion engine according to the present invention, and is a view showing the relationship between the engine rotation numbers for the tail pipe having an opening property (solid line) having a linear form and for the tail pipe having an opening property (broken line) having a non-linear form at the acceleration time in the present embodiment, and the opening ratio of the tail pipe.

FIGS. 24 and 29 show the fifth embodiment of the exhaust apparatus of the internal combustion engine according to the present invention. The constitution elements and parts of the fifth embodiment the same as the constitution elements and part of the first embodiment are illustrated with the reference numerals the same as the reference numerals of the first embodiment, and the detailed explanation about the fifth embodiment will be omitted hereinafter.

Figure 25:
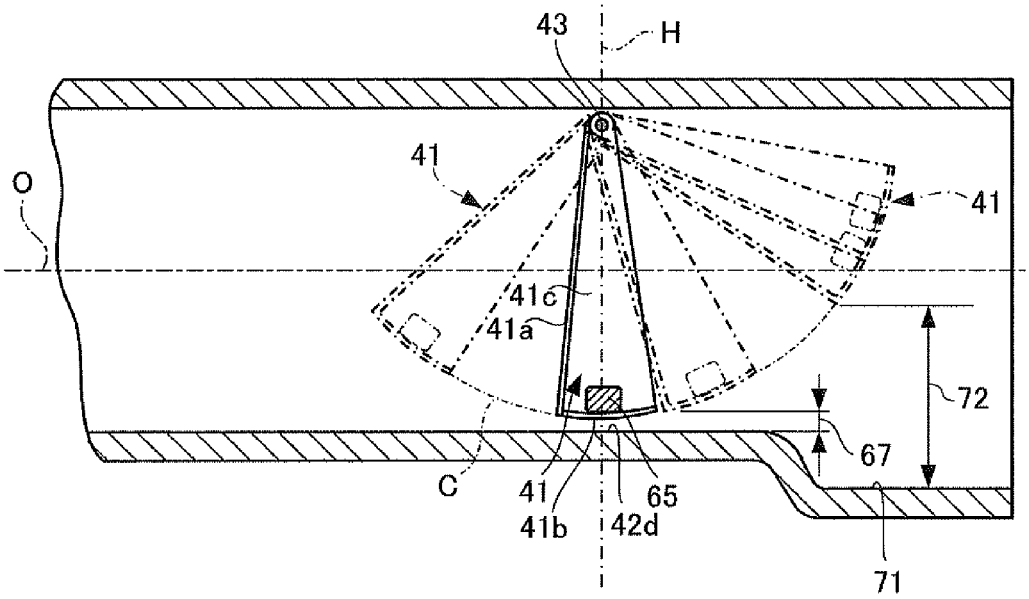
FIG. 25 shows a cross-sectional view of the tail pipe taken along and seen from the lines D-D in FIG. 24.

In FIGS. 24 and 25, the lower projection portion 41*b* has a weight 65 mounted thereon. The swing plate 41 is set to have a gravity center to have the receiving surface 41*a* take a swing position where the receiving surface 41*a* is positioned upstream side of the vertical axis H by the weight 65. The swing position of the receiving surface 41*a* becomes an initial position of the swing plate 41.

The weight is set to have the swing plate 41 take a swing angle where the passage cross-sectional area of the tail pipe 28 is throttled to the predetermined cross-sectional area by the weight 65 when the swing plate 41 receives the exhaust gas flow at the time of the air column resonance rotation of the engine 21.

When the tail pipe 28 has a small amount of exhaust gas flow at the time of the vehicle being running at the reduced speeds, the swing plate 41 is positioned at the initial position by the weight 65. The lower portion of the tail pipe 28 downstream of the swing plate 41 is formed with a diameter expansion portion (lower diameter expansion portion) 71 expanded from the passage cross-sectional area of the exhaust gas passage of the tail pipe 28.

In the initial state of the swing plate 41 shown in solid lines in FIG. 25, an opening portion 67 having a throttled passage cross-sectional area is formed between the lower projection portion 41*b* of the swing plate 41 and the inner peripheral surface of the downstream portion 28B of the tail pipe 28.

In the state of the swing plate 41 swung from the vertical position toward the downstream side, there is formed an opening portion 72 having an opening area larger than the opening area (cross-sectional area) of the opening portion 67.

The opening portion 72 has an open area variable in response to the swing position of the swing plate 41 where the lower projection portion 41*b* of the swing plate 41 is positioned above the diameter expansion portion 71.

The difference between the fifth embodiment and the fourth embodiment resides in the fact that the position of the diameter expansion portion 71 starting to expand is downstream of the position of the diameter expansion portion 66 starting to expand. This is due to the fact that the passage cross-sectional area is increased between the swing plate 41 and the diameter expansion portion 71 at the rotation number of the engine 21 exceeding the air column rotation number.

Next, the operation of the fifth embodiment will be described hereinafter.

According to the present embodiment, the opening area of the opening portion of the tail pipe 28 set less than 70% at the acceleration and deceleration times in the normal rotation area of the vehicle makes it possible to suppress the air column resonance at the air column resonance rotation of the engine 21 and to reduce the back pressure of the exhaust gas flow at the rotation number of engine 21 exceeding the air column resonance rotation of the engine 21.

When the opening ratio is linearly increased in response to the swing motion of the swing plate as shown by solid lines in FIG. 29, it may be considered that the opening ratio of the tail pipe 28 cannot be large, thereby leading to increasing the back pressure of the exhaust gas flow, and to deteriorating the exhaust gas property, at the time of the engine 21 being accelerated to have the rotation number exceeding the air column resonance rotation number (fk), especially in the high rotation area of the engine 21 (the rotation area including Rmax).

Figure 26:
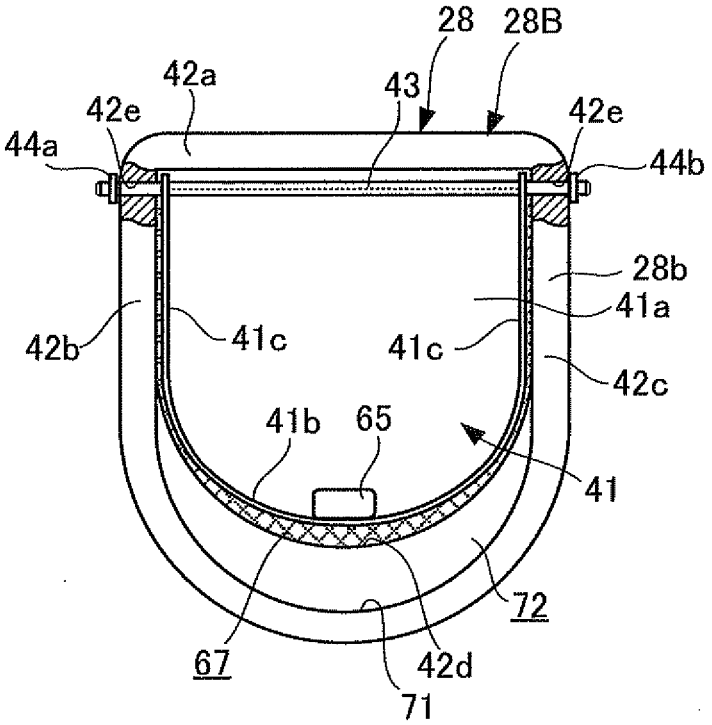
FIG. 26 shows a view of the fifth embodiment of the exhaust apparatus of the internal combustion engine according to the present invention, and is a front elevational view of a tail pipe as seen from the axial direction of the tail pipe showing an opening area of the tail pipe at the time of air column resonance rotation.

The exhaust apparatus according to present embodiment is constructed to have a diameter expansion portion 71 formed on the tail pipe 28 at the downstream side of the swing plate 41, so that the opening portion 67 of the tail pipe 28 can be throttled to reduce the opening ratio of the opening portion 67 when the rotation number of the engine 21 is below the air column resonance rotation number (1k) at the acceleration and deceleration times in the normal rotation area of the vehicle (the opening area of the opening portion 67 is shown by the cross-hatching in FIG. 26). This makes it possible to interfere the reflection wave caused by the open end reflection and the reflection wave caused by the closed end reflection with each other, thereby making it possible to suppress the sound pressure level caused by the air column resonance in the tail pipe 28.

According to the present embodiment, the opening portion 67 is constructed to be throttled between the lower projection portion 41*b* of the swing plate 41 and the inner peripheral surface of the downstream portion 28B of the tail pipe 28 when the rotation number of the engine 21 is below the air column resonance rotation number (fk).

Figure 27:
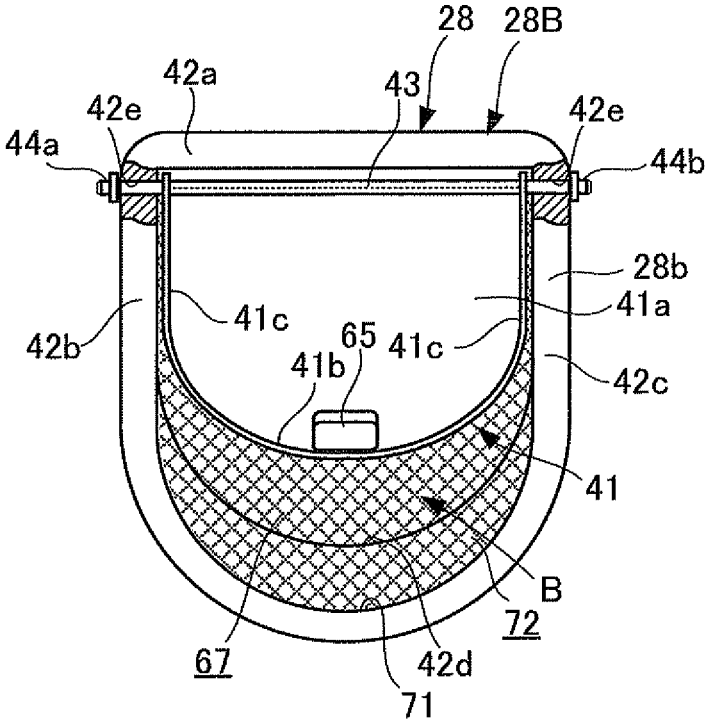
FIG. 27 shows a view of the fifth embodiment of the exhaust apparatus of the internal combustion engine according to the present invention, and is a front elevational view of the tail pipe as seen from the axial direction of the tail pipe and showing an opening area of the tail pipe at the acceleration time of the vehicle.

For the rotation number of the engine 21 exceeding the air column resonance rotation number (fk), it is no need to consider suppressing the air column resonance, but required to consider preventing the back pressure of the exhaust gas flow from being increased. For this end, when the swing plate 41 receives the exhaust gas flow and is thus swung toward the downstream side, the lower projection portion 41*b* of the swing plate 41 and the diameter expansion portion 71 allow the passage cross-sectional area of the tail pipe 28 to be increased and thus to have the opening ratio of the opening portion 72 (the opening area of the opening portion 72 is shown by the cross-hatching in FIG. 27) increased, thereby making it possible to suppress the back pressure of the exhaust gas flow from being increased. Further, the opening area of the opening portion 72 can be increased at the acceleration time of the vehicle having a large exhaust gas flow, thereby making it possible to suppress the sound of the exhaust gas flow from being generated.

Figure 28:
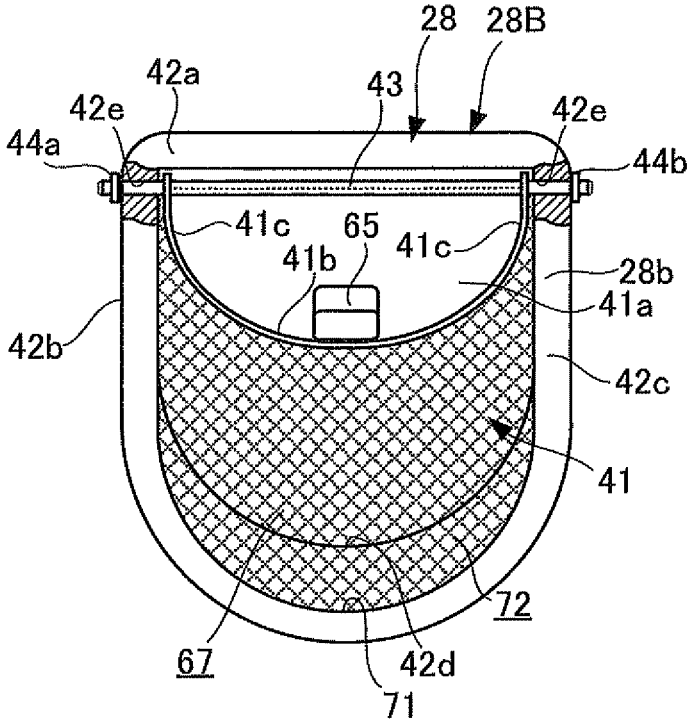
FIG. 28 shows a view of the fifth embodiment of the exhaust apparatus of the internal combustion engine according to the present invention, and is a front elevational view of the tail pipe as seen from the axial direction of the tail pipe showing an opening area of the tail pipe at the time of the highest engine rotation number.

When the rotation number of the engine 28 is increased and remains in the highest rotation area as shown in FIG. 29, the amount of exhaust gas flow the swing plate 41 receives is at a maximum level, so that the swing plate 41 is further swung toward the downstream side to have the lower projection portion 41*b* of the swing plate 41 and the diameter expansion portion 71 allow the passage cross-sectional area of the tail pipe 28 to be increased. At this time, the opening ratio of the tail pipe 28 is further increased as the broken line in FIG. 29 (the opening area of the opening portion 72 is shown by the hatching in FIG. 28), thereby making it possible to suppress the back pressure of the exhaust gas from being increased.

Sixth Embodiment

Figure 30:
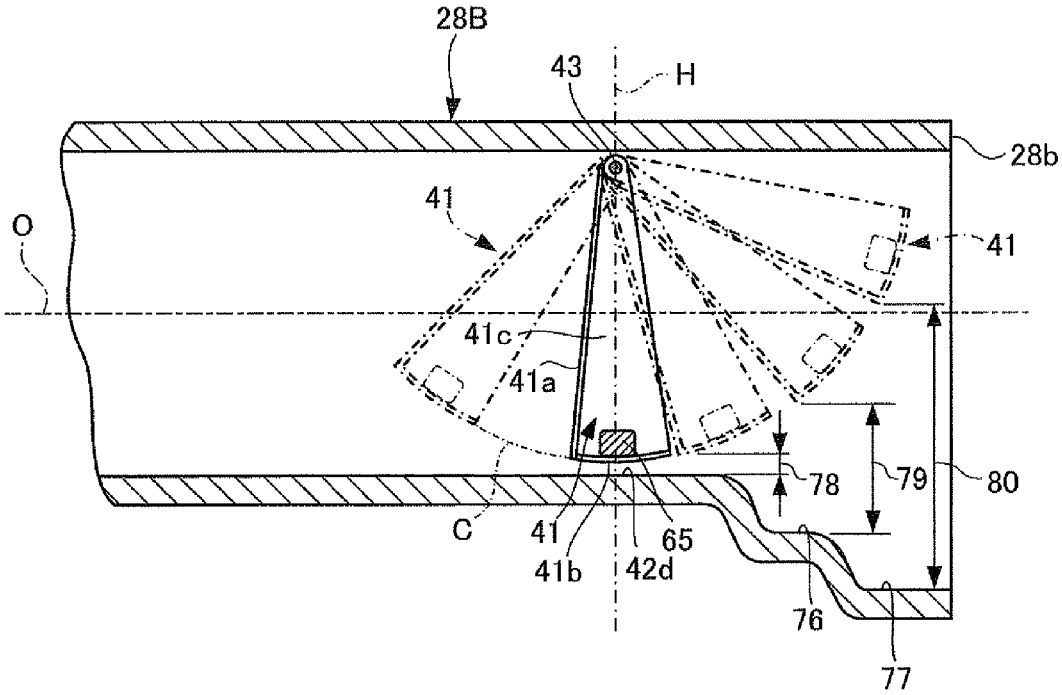
FIG. 30 shows a view of a sixth embodiment of the exhaust apparatus of the internal combustion engine according to the present invention, and is a cross-sectional view of the tail pipe.
Figure 31:
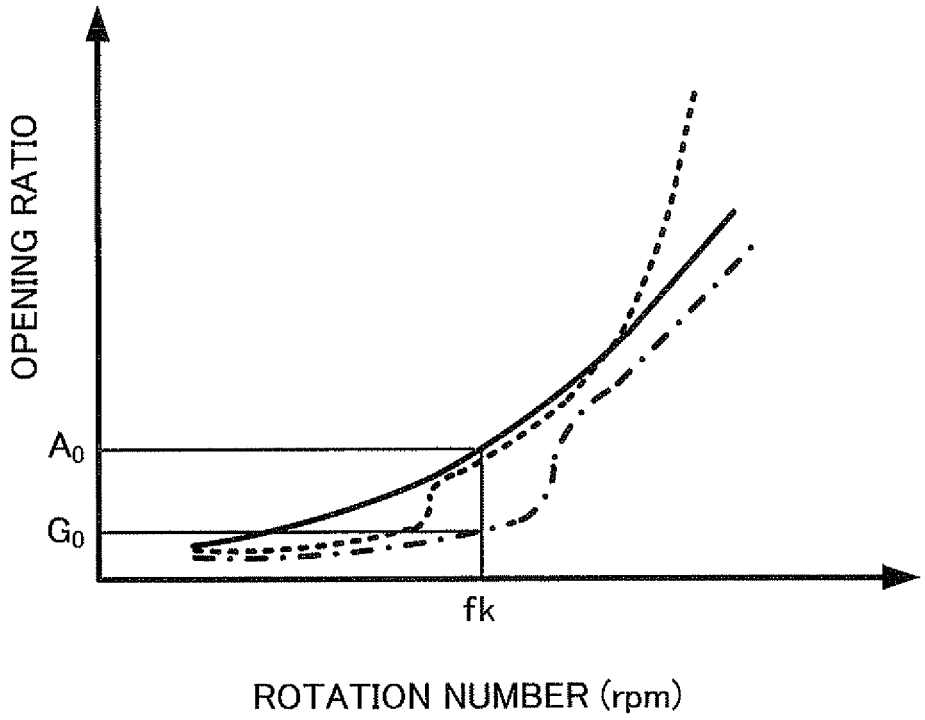
FIG. 31 shows a view of the sixth embodiment of the exhaust apparatus of the internal combustion engine according to the present invention, and is a view showing the relationship between the engine rotation numbers for the tail pipe having an opening property (solid line) having a linear form and for the tail pipe having an opening property (broken line) having a non-linear form at the acceleration and deceleration times in the present embodiment, and the opening ratio of the tail pipe.

FIGS. 30 and 31 show the sixth embodiment of the exhaust apparatus of the internal combustion engine according to the present invention. The constitution elements and parts of the sixth embodiment the same as the constitution elements and part of the first embodiment are illustrated with the reference numerals the same as the reference numerals of the first embodiment, and the detailed explanation about the sixth embodiment will be omitted hereinafter.

The lower projection portion 41*b* of the swing plate 41 has a weight 65 mounted thereon. The swing plate 41 is set to a gravity center for the swing plate 41 to have the receiving surface 41*a* take a swing position where the receiving surface 41*a* is positioned upstream of the vertical axis H by the weight 65. The swing position becomes an initial position of the swing plate 41.

The swing plate 41 is set to have such a weight that the swing plate 41 is positioned at a swing angle to have the passage cross-sectional area of the tail pipe 28 to be throttled to the predetermined passage cross-sectional area by the weight 65 when the swing plate 41 receives the exhaust gas flow at the time of the engine being operated to generate the air column resonance.

The swing plate 41 is constructed to be positioned at the initial position by the weight 65 when the amount of the exhaust gas flow is small at the deceleration time of the vehicle.

The lower portion of the tail pipe 28 downstream of the swing plate 41 is formed with diameter expansion portions (lower diameter expansion portions) 76, 77 respectively having passage cross-sectional areas of the exhaust passages expanded in diameter. The diameter of the diameter expansion portion 77 is larger than that of the diameter expansion portion 76.

The swing plate 41 takes the initial position as shown in FIG. 30 to have an opening portion 78 formed between the lower projection portion 41*b* of the swing plate 41 and the inner peripheral surface of the downstream portion 28B of the tail pipe 28, the opening portion 78 having a throttled passage cross-sectional area.

In the state that the swing plate 41 receives the exhaust gas flow to be swung toward the downstream side with the engine 28 being accelerated in the normal rotation area, the lower projection portion 41*b* of the swing plate 41 and the diameter expansion portion 76 allow the opening portion 79 to be formed therebetween, the opening portion 79 having an opening area larger than the opening area of the opening portion 78.

On the other hand, in the state that the swing plate 41 receives the exhaust gas flow to be swung farthest toward the downstream side with the engine 28 being accelerated to the high rotation area exceeding the normal rotation area, the lower projection portion 41*b* of the swing plate 41 and the diameter expansion portion 77 allow the opening portion 80 to be formed therebetween, the opening portion 80 having an opening area larger than the opening area of the opening portion 79.

The opening areas of the opening portions 79, 80 are set variable in response to the swing positions of the swing plate 41 where the lower projection portion 41*b* of the swing plate 41 is positioned above the diameter expansion portions 76, 77.

Next, the operation of the sixth embodiment will be described hereinafter.

According to the present embodiment, similarly to the fifth embodiment, the opening area of the opening portion of the tail pipe 28 set less than 70% makes it possible to suppress the air column resonance, however, at the acceleration and deceleration times in the normal rotation area of the vehicle, the exhaust gas flows are different from each other even with the equal rotation number of the engine 21 having the air column resonance generated. More specifically, even if the engine 21 is operated with the equal rotation number having the air column resonance generated, the exhaust gas flow is decreased at the deceleration time of the vehicle while the exhaust gas flow is increased at the acceleration time of the vehicle, thereby causing the swing plate 41 to take different positions at the acceleration and deceleration times.

According to the present embodiment, the diameter expansion portion 76 is formed on the tail pipe 28 downstream of the swing plate 41. When the swing plate 41 receives the exhaust gas flow to be swung toward the downstream side at the acceleration time of the vehicle, the lower projection portion 41*b* of the swing plate 41 and the diameter expansion portion 76 allow the passage cross-sectional area of the tail pipe 28 to be increased to have the opening ratio of the opening portion 79 increased.

For this reason, when the engine 21 reaches the air column resonance rotation number fk with the vehicle being decelerated from the rotation number exceeding the resonance rotation number fk, viz., with the swing plate 41 being swung to the vertical axis H from the state where the swing plate 41 is swung farthest toward the downstream side as shown by the chain line in FIG. 31, the passage cross-sectional area of the tail pipe 28 is throttled to the predetermined cross-sectional area, thereby making it possible to reduce the opening ratio (see the opening ratio $G_o$ in FIG. 31).

For this reason, the reflection wave caused by the opening end reflection and the reflection wave caused by the closed end reflection are interfered with each other at the deceleration time of the vehicle, thereby making it possible to more drastically suppress the sound pressure level caused by the air column resonance in the tail pipe 28 from being increased.

Even in the case that the opening portion 78 of the tail pipe 28 is throttled at the deceleration time of the vehicle to the degree that the air column resonance can be suppressed, the lower projection portion 41*b* of the swing plate 41 and the diameter expansion portion 76 allow the passage cross-sectional area of the tail pipe 28 to be increased to enable the opening ratio of the opening portion 79 to be increased at the acceleration time of the vehicle, as shown in the broken line in FIG. 31, thereby making it possible to suppress the back pressure of the exhaust gas flow from being increased. At the acceleration time of the vehicle with the amount of the exhaust gas flow being increased, the opening area of the opening portion 79 of the tail pipe 28 is increased, thereby making it possible to suppress the sound of the exhaust gas flow from being generated.

In addition, the opening ratio $A_o$ of the opening portion 79 can be less than 70% in response to the air column resonance rotation number (fk) at the acceleration time of the vehicle, so that the reflection wave caused by the opening end reflection and the reflection wave caused by the closed end reflection are interfered with each other at the acceleration time of the vehicle, thereby making it possible to suppress the sound pressure level caused by the air column resonance in the tail pipe 28 from being increased.

According to the present embodiment, the opening ratio of the opening portion 78 of the tail pipe 28 can be reduced at the deceleration time of the vehicle as shown in the chain line in FIG. 31, while the opening ratio of the opening portion 79 of the tail pipe 28 can be increased at the acceleration time of the vehicle as shown in the broken line in FIG. 31. The relationship between the swing position of the swing plate 41 and the opening area of the opening portion 79 of the tail pipe 28 can therefore be made in a non-linear shape.

For this reason, the opening ratio of the tail pipe 28 can be set at an optimum opening ratio which can suppress the air column resonance at the acceleration time and the deceleration time of the vehicle in the normal rotation area, and can prevent the back pressure of the exhaust gas flow from being increased at the acceleration time of the vehicle, thereby improving the exhaust gas property.

In the highest rotation area of the engine 21, the swing plate 41 receives the highest flow amount of the exhaust gas flow and thus is swung further toward the downstream side. At this time, the lower projection portion 41*b* of the swing plate 41 and the diameter expansion portion 77 allow the passage cross-sectional area to be increased to have the opening ratio of the opening portion 80 increased, thereby making it possible to suppress the back pressure of the exhaust gas flow from being increased.

At the acceleration time of the vehicle with the exhaust gas amount being increased to the highest level, the opening area of the opening portion 80 is increased, thereby making it possible to suppress the sound of the exhaust gas flow from being generated.

It may be considered that the state, in which the lower projection portion 41*b* of the swing plate 41 and the diameter expansion portion 76 allow the passage cross-sectional area of the tail pipe 28 to be increased at the time of the engine 21 being operated at the highest rotation number with no diameter expansion portion 77, makes it impossible to sufficiently suppress the back pressure of the exhaust gas flow from being increased.

According to the present embodiment, the diameter expansion portion 77 is provided on the tail pipe 28 downstream of the diameter portion 76 to have a diameter larger than that of the diameter portion 76, so that the lower projection portion 41*b* of the swing plate 41 and the diameter expansion portion 76 allow the passage cross-sectional area of the tail pipe 28 to sufficiently be increased at the time of the engine 21 being operated at the highest rotation number, thereby making it possible to sufficiently reduce the back pressure of the exhaust gas flow at the time of the engine 21 being operated at the opening rotation number.

Seventh Embodiment

Figure 32:
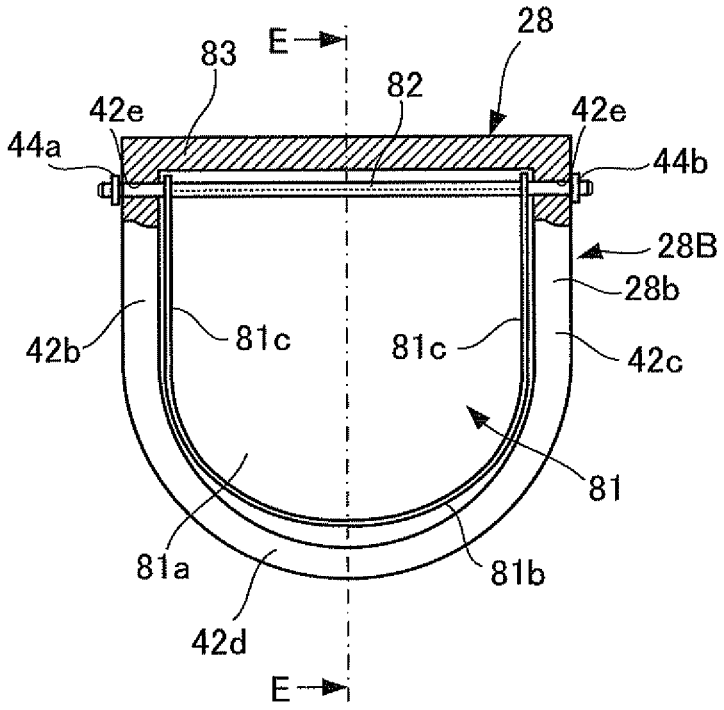
FIG. 32 shows a view of a seventh embodiment of the exhaust apparatus of the internal combustion engine according to the present invention, and is a front elevational view of the tail pipe as seen from the axial direction of the tail pipe.
Figure 37:
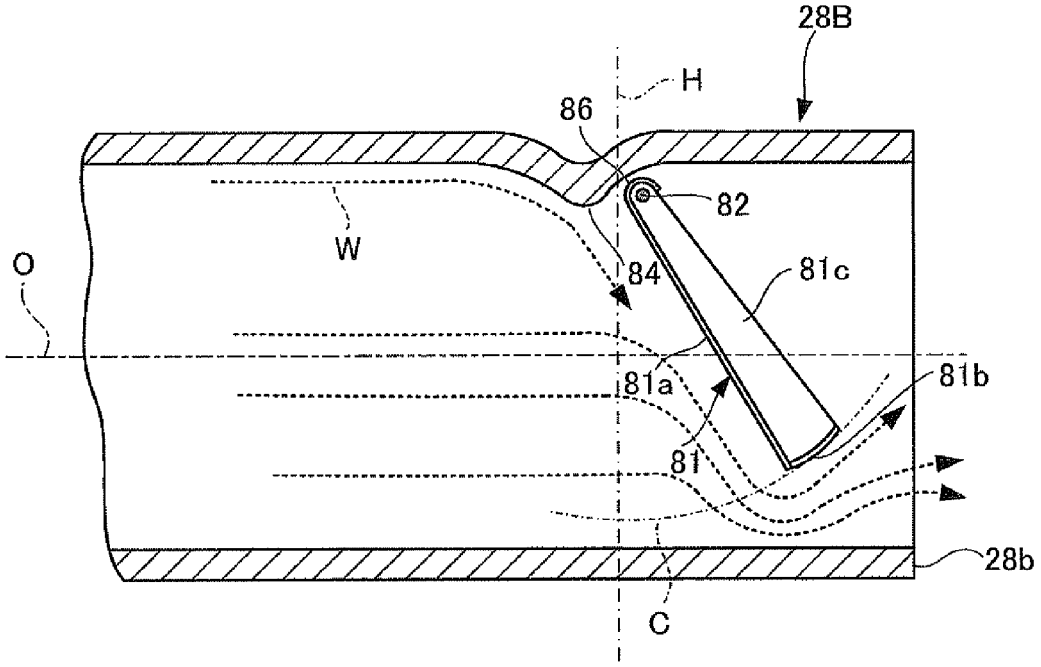
FIG. 37 shows a view of the seventh embodiment of the exhaust apparatus of the internal combustion engine according to the present invention, and is a cross-sectional view of the tail pipe having a yet still further shape.

FIGS. 32 and 37 show the seventh embodiment of the exhaust apparatus of the internal combustion engine according to the present invention. The constitution elements and parts of the seventh embodiment the same as the constitution elements and part of the first embodiment are illustrated with the reference numerals the same as the reference numerals of the first embodiment, and the detailed explanation about the seventh embodiment will be omitted hereinafter.

Figure 33:
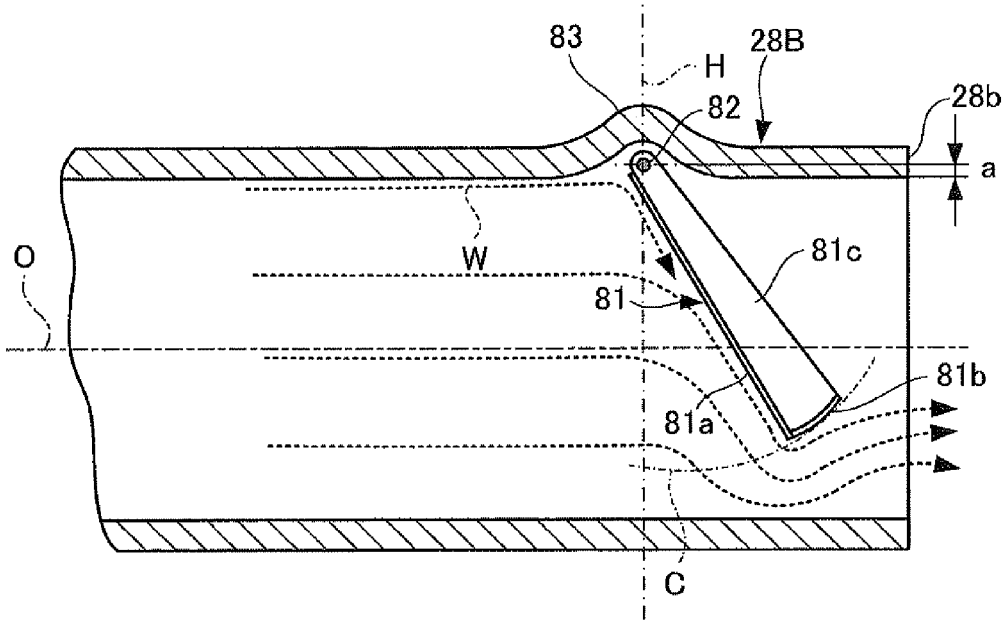
FIG. 33 shows a cross-sectional view of the tail pipe taken along and seen from the lines E-E in FIG. 32.
Figure 34:
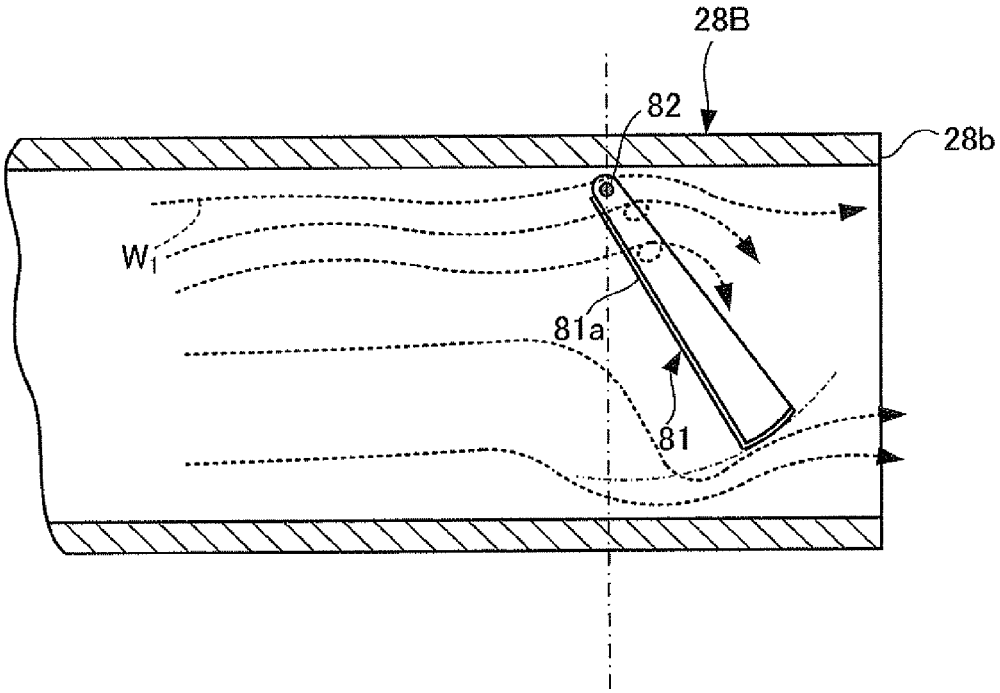
FIG. 34 shows a view of the seventh embodiment of the exhaust apparatus of the internal combustion engine according to the present invention, and is a cross-sectional view of the tail pipe used for the comparison with the tail pipe in the present embodiment.

In FIGS. 32 and 33, the swing plate 81 serving as a valve body comprises a receiving surface 81*a* receiving the exhaust gas flow, a lower projection portion 81*b* projecting toward the downstream side of the exhaust gas flow from the lower end portion of the receiving surface 81*a* and serving as part of a throttle unit, and side projection portions 81*c* projecting toward the downstream side of the exhaust gas flow from the both widthwise end portions of the receiving surface 81*a* and serving as a guide portion.

The lower projection portion 81*b* of the swing plate 81 is curved, more specifically in the form of a shape curved along the swing locus C of the lower end portion of the receiving surface 81*a* when the swing plate 81 is swung.

The upper end portions of the side projection portions 81*c* have a swing shaft 82 pass therethrough, and the swing shaft 82 perpendicularly extends with respect to the center axis O of the tail pipe 28 and is positioned outwardly of the center axis O of the tail pipe 28.

The swing shaft 82 is positioned radially outwardly of the inner surface of the tail pipe 28 upstream of the swing plate 81. The upper portion of the tail pipe 28 is formed with a diameter expansion portion 83 having the swing shaft 82 swingably supported thereon.

Next, the operation of the seventh embodiment will be described hereinafter.

In the case that the swing plate 81 is provided in the tail pipe 28 with the swing shaft 82 positioned radially inwardly of the inner surface of the tail pipe 28 upstream of the swing plate 81, thereby forming a gap above the swing shaft 82, one part W1 of the exhaust gas flow flows through the gap above the swing shaft 82 to the downstream side of the swing plate 81, so that the exhaust gas flow cannot completely act on the receiving surface 81*a* of the swing plate 81. This results in likely generating the pressure loss of the exhaust gas flow, and thus causing a fear that the swing plate 81 cannot be retained to take a swing position for suppressing the air column resonance.

The one part W1 of the exhaust gas flow flows from above the swing shaft 82 to the downstream side of the swing plate 81 and becomes a turbulent flow, which in turn acts on the back surface (facing the downstream side) of the receiving surface 81*a* from the downstream side of the swing plate 81, thereby causing a fear that the turbulent flow becomes a resistance to the exhaust gas flow acting on the surface (facing the upstream side) of the receiving surface 81*a* to have the back pressure raised.

According to the present embodiment, as shown in FIG. 33, the swing shaft 82 is positioned radially outwardly of the inner surface of the tail pipe 28 upstream of the swing plate 81, so that the one part W of the exhaust gas flow can be prevented from flowing from above the swing shaft 82 to the downstream side of the swing plate 81, and can completely act on the receiving surface 81*a* of the swing plate 81, thereby making it possible to prevent the pressure loss of the exhaust gas flow from being generated.

This makes it possible for the exhaust gas flow to efficiently act on the surface of the receiving surface 81*a*, and thereby to cause the swing plate 81 to stably be positioned at the swing position enabling the air column resonance to be suppressed.

Due to the fact that the one part W of the exhaust gas flow can be prevented from flowing from above the swing shaft 82 to the downstream side of the swing plate 81, the swing plate 81 can be easily swung by the exhaust gas flow, thereby making it possible to prevent the back pressure of the exhaust gas flow from being raised.

Further, the one part W of the exhaust gas flow can be prevented from flowing to the downstream side through the small gap between the swing shaft 82 and the tail pipe 28, thereby making it possible to prevent the sound of the exhaust gas flow from being generated.

Figure 35:
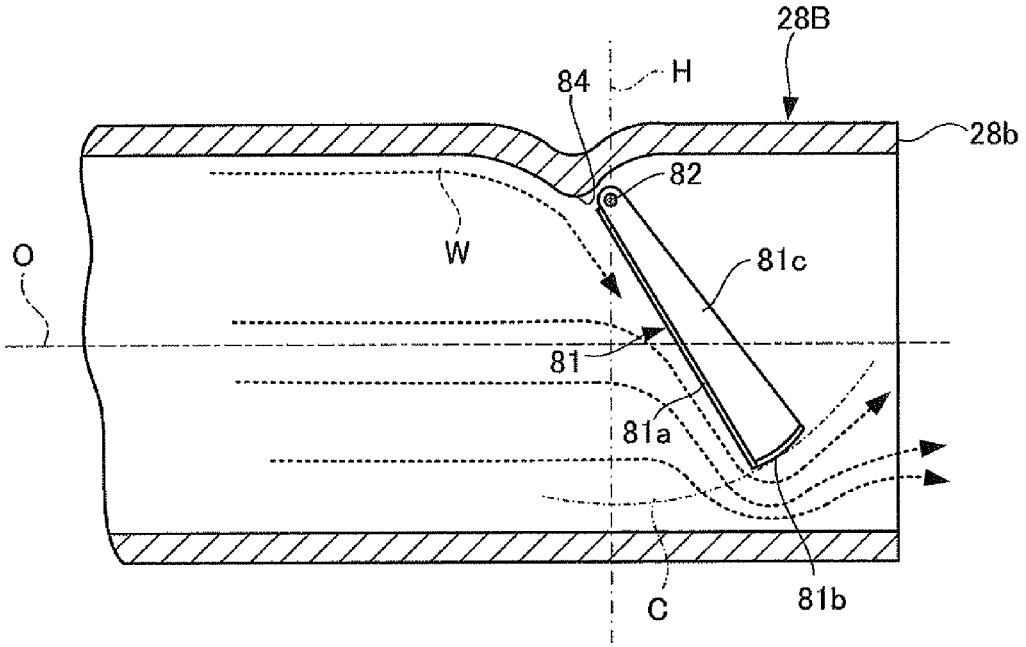
FIG. 35 shows a view of the seventh embodiment of the exhaust apparatus of the internal combustion engine according to the present invention, and is a cross-sectional view of the tail pipe having a further shape.

Although the present embodiment has been explained about the tail pipe 28 formed with the diameter expansion portion 83, and the swing shaft 82 positioned radially outwardly of the inner surface of the tail pipe 28 upstream of the swing plate 81, the tail pipe 28 upstream of the swing shaft 82 may be formed with a curved projection portion 84 curved to project toward the center axis O of the tail pipe 28 as shown in FIG. 35, so that the one part W of the exhaust gas flow flowing toward the swing shaft 82 is guided by the curved projection portion 84 to the receiving surface 81*a* of the swing plate 81 below the swing shaft 82.

The above example thus constructed also can prevent the one part W of the exhaust gas flow from flowing from above the swing shaft 82 to the downstream side of the swing plate 81, and can prevent the pressure loss of the exhaust gas flow from being generated, thereby making it possible to obtain advantageous effects as previously mentioned.

Figure 36:
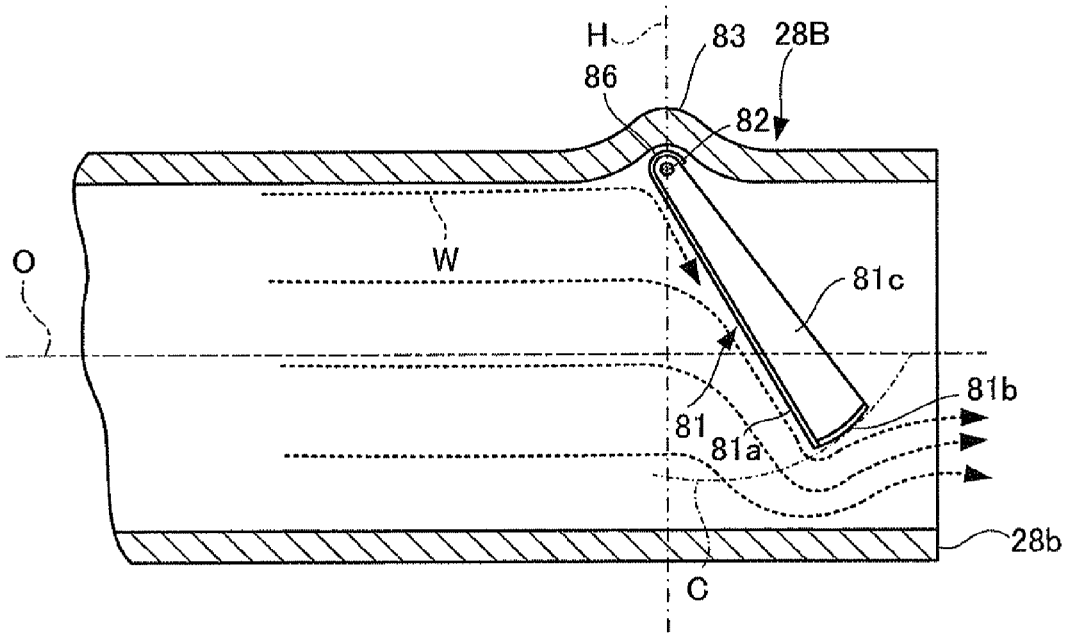
FIG. 36 shows a view of the seventh embodiment of the exhaust apparatus of the internal combustion engine according to the present invention, and is a cross-sectional view of the tail pipe having a still further shape.

As shown in FIGS. 36 and 37, the upper end portions of the side projection portions 81*c* may be provided thereon with a cover plate 86 for covering the swing shaft 82. The above example thus constructed also can prevent the exhaust gas flow having a high temperature from colliding with the swing shaft 82 with the aid of the cover plate 86.

Therefore, the cover plate 86 can cover and protect the swing shaft 82 from the exhaust gas flow of the high temperature, and thus can prevent the swing shaft 82 from being deformed. As a consequence, the swing plate 81 can be reliably and stably swung with respect the swing shaft 82.

Eighth Embodiment

Figure 38:
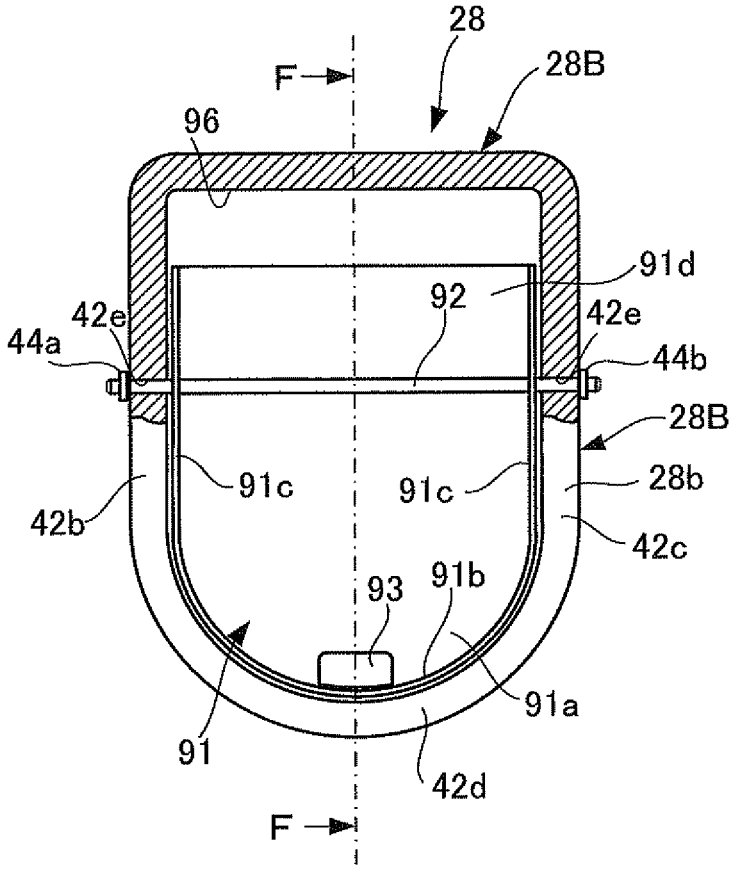
FIG. 38 shows a view of an eighth embodiment of the exhaust apparatus of the internal combustion engine according to the present invention, and is a front elevational view of the tail pipe as seen from the axial direction of the tail pipe.
Figure 39:
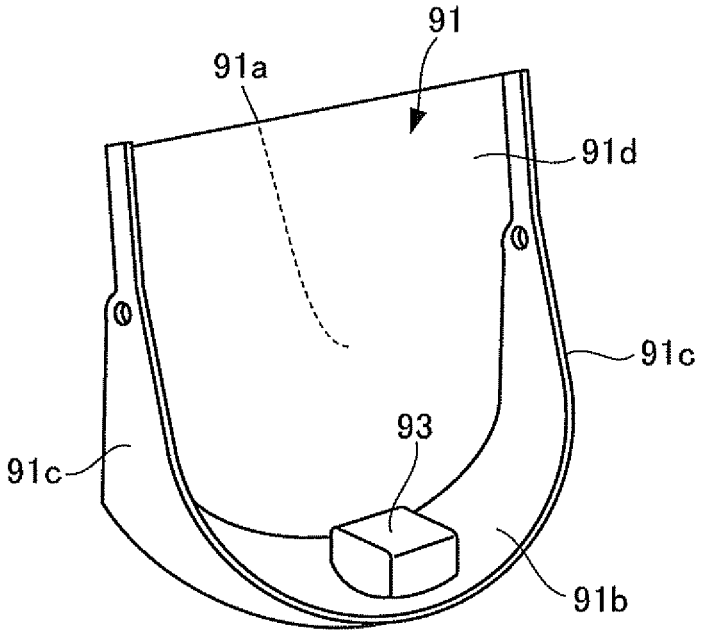
FIG. 39 shows a view of the eighth embodiment of the exhaust apparatus of the internal combustion engine according to the present invention, and is a perspective view of a swing plate.
Figure 42:
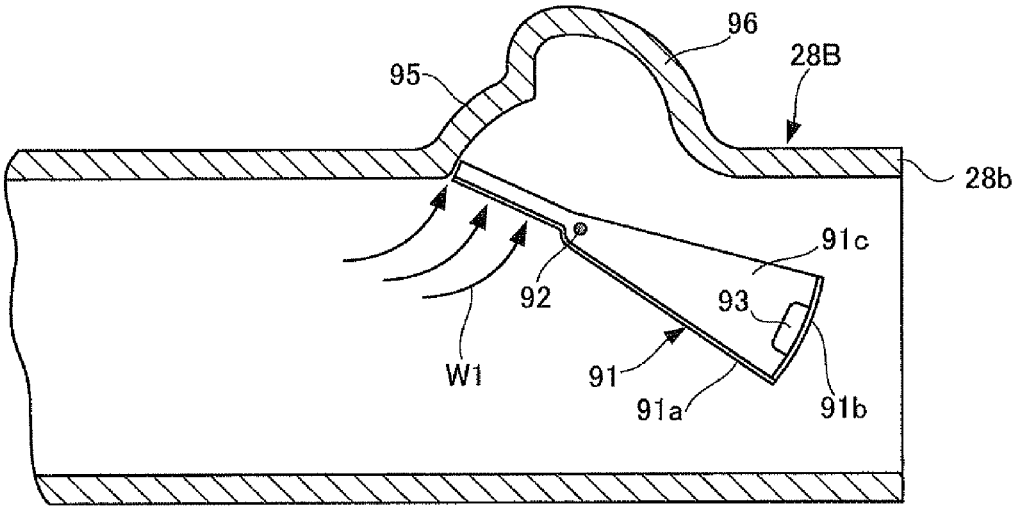
FIG. 42 shows a view of the eighth embodiment of the exhaust apparatus of the internal combustion engine according to the present invention, and is a cross-sectional view showing the state of the swing plate at the time of the engine rotation number exceeding the air column resonance rotation number.

FIGS. 38 and 42 show the eighth embodiment of the exhaust apparatus of the internal combustion engine according to the present invention. The constitution elements and parts of the eighth embodiment the same as the constitution elements and part of the first embodiment are illustrated with the reference numerals the same as the reference numerals of the first embodiment, and the detailed explanation about the eighth embodiment will be omitted hereinafter.

Figure 40:
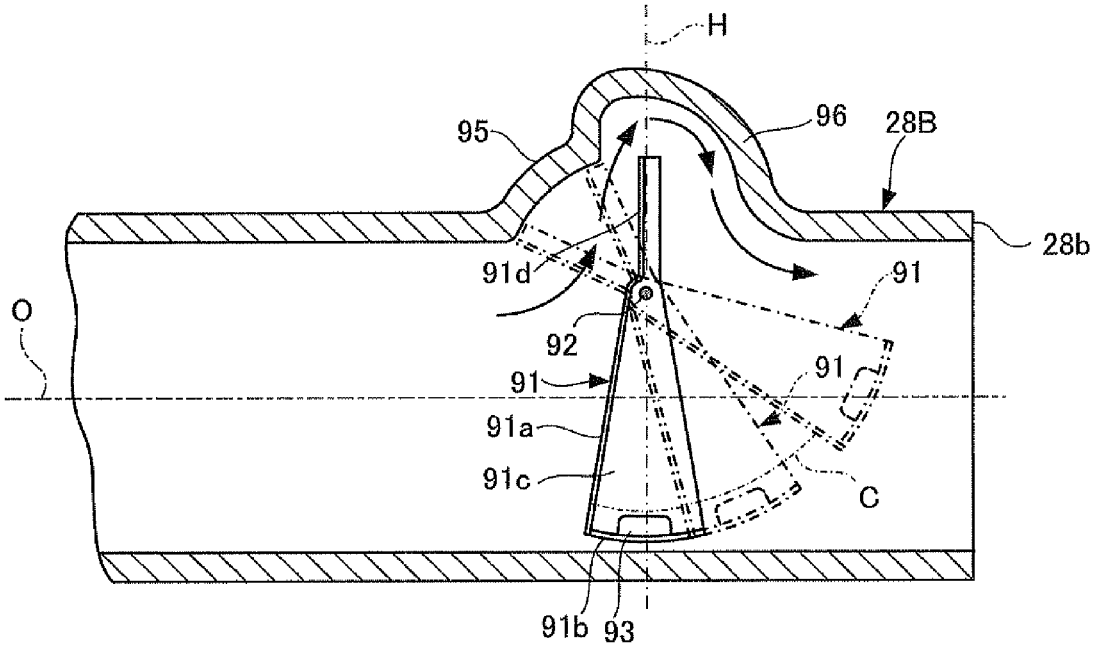
FIG. 40 shows a cross-sectional view of the tail pipe taken along and seen from the lines F-F in FIG. 38.

In FIGS. 38 and 40, the swing plate 91 serving as a valve body comprises a receiving surface 91*a* receiving the exhaust gas flow, a projection portion 91*b* projecting toward the downstream side of the exhaust gas flow from the lower end portion of the receiving surface 91*a* and serving as part of a throttle unit, and side projection portions 91*c* projecting toward the downstream side of the exhaust gas flow from the both widthwise end portions of the receiving surface 91*a* and serving as a guide portion.

The side projection portions 91*c* of the swing plate 91 have a swing shaft 92 pass therethrough, and the swing shaft 92 perpendicularly extends with respect to the center axis O of the tail pipe 28. The swing shaft 92 is spaced apart from the inner upper portion of the tail pipe 28 toward the center axis O of the tail pipe 28, and is swingably supported on the tail pipe 28 above the center axis O of the tail pipe 28.

The lower projection portion 91*b* has a weight 93 mounted thereon. The swing plate 91 has a gravity center set for the swing plate 91 to have the receiving surface 91*a* take a swing position where the receiving surface 91*a* is positioned upstream of the vertical axis H by the weight 93. The swing position becomes an initial position of the swing plate 91.

The swing plate 91 is set to have such a weight that the swing plate 91 is positioned at a swing angle to have the passage cross-sectional area of the tail pipe 28 to be throttled to the predetermined passage cross-sectional area by the weight 93 when the swing plate 91 receives the exhaust gas flow in response to the rotation number of the engine 21 at the time of the vehicle being accelerated in the normal rotation area to generate the air column resonance.

The swing plate 91 is constructed to be positioned at the initial position by the weight 93 when the amount of the exhaust gas flow is small at the deceleration time of the vehicle.

The lower projection portion 91*b* of the swing plate 91 is curved, more specifically in the form of a shape curved along the swing locus C of the lower end portion of the receiving surface 91*a* when the swing plate 91 is swung.

Figure 41:
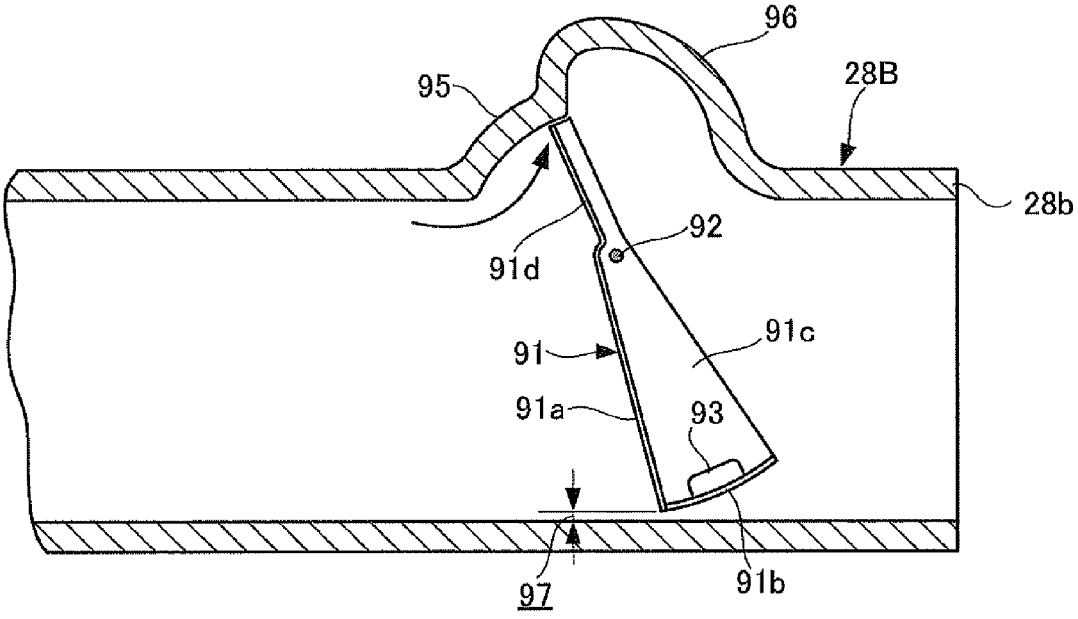
FIG. 41 shows a view of the eighth embodiment of the exhaust apparatus of the internal combustion engine according to the present invention, and is a cross-sectional view showing the state of the swing plate at the air column resonance rotation time.

When the swing plate 91 is swung toward the downstream side from the initial position by a certain angle, viz., in a predetermined angular range, the lower projection portion 91*b* and the inner peripheral surface of the downstream portion 28*b* of the tail pipe 28 allow the gap therebetween to be constant, thereby forming an opening portion 97 having a constant opening ratio between the lower projection portion 91*b* and the inner peripheral surface of the downstream portion 28*b* of the tail pipe 28 (see FIG. 41).

The swing plate 91 has an upper projection portion 91*d* upwardly projecting from the receiving surface 91*a*, viz., from the swing shaft 92. The upper portion of the tail pipe 28 is formed with a diameter expansion portion (upper diameter expansion portion) 95. The upper portion of the tail pipe 28 downstream of the diameter expansion portion 95 is formed with another diameter expansion portion (upper diameter expansion portion) 96 having a diameter larger than that of the diameter expansion portion 95. The passage cross-sectional areas between the projected top end portion of the upper projection portion 91*d* and the inner peripheral surfaces of the diameter expansion portions 95, 96 are variable in response to the swing positions of the swing plate 91.

The swing plate 91 forming part of the present embodiment is constructed to take the initial position where the receiving surface 91*a* is inclined toward the upstream side with respect to the vertical axis H when the engine rotation number is equal to the idle rotation number. Under this state, the projected top end portion of the upper projection portion 91*d* is in face-to-face relationship with the diameter expansion portion 96 to allow the passage cross-sectional area between the projected top end portion of the upper projection portion 91*d* and the diameter expansion portion 96 to be enlarged (see FIG. 40).

When the engine rotation number is equal to the air column resonance rotation number, the swing plate 91 is set to take the predetermined swing position where the receiving surface 91*a* receives the exhaust gas flow and is thus inclined toward the downstream side with respect to the vertical axis H. Under this state, the projected top end portion of the upper projection portion 91*d* is in face-to-face relationship with the diameter expansion portion 95 to allow the passage cross-sectional area between the projected top end portion of the upper projection portion 91*d* and the diameter expansion portion 95 to be throttled to an extremely small level (see FIG. 41). This means that the swing plate 91 is set from the idle rotation time to the air column resonance rotation time to allow the passage cross-sectional area between the projected top end portion of the upper projection portion 91*d* and the diameter expansion portion 96 to remain enlarged.

Further, the swing plate 91 is constructed to take the predetermined swing position where the receiving surface 91*a* receives a large amount of the exhaust gas flow and is thus inclined toward the downstream side with respect to the vertical axis H when the engine rotation number exceeds the air column rotation number. Under this state, the projected top end portion of the upper projection portion 91*d* is in face-to-face relationship with the diameter expansion portion 95 to allow the passage cross-sectional area between the projected top end portion of the upper projection portion 91*d* and the diameter expansion portion 95 to be throttled to an extremely small level (see FIG. 42).

Next, the operation of the eighth embodiment will be described hereinafter.

At the idle rotation time when the tail pipe 28 has a small amount of the exhaust gas flow, the receiving surface 91*a* of the swing plate 91 receives the exhaust gas flow and is thus swung toward the upstream side with respect to the vertical axis H to take the initial position.

At the idle rotation time, the projected top end portion of the upper projection portion 91*d* is in face-to-face relationship with the diameter expansion portion 96 to allow the passage cross-sectional area between the projected top end portion of the upper projection portion 91*d* and the diameter expansion portion 96 to become large. Even in the case of the opening ratio of the opening portion 97 coming to be small, the one part W1 of the exhaust gas flow can be discharged through between the projected top end portion of the upper projection portion 91*d* and the diameter expansion portion 96 as shown in FIG. 40, thereby making it possible to prevent the exhaust gas flow at the opening portion 97 having a small opening area from being concentrated. This makes it possible to prevent the sound of the exhaust gas flow from being generated by the exhaust gas flow flowing through the opening portion 97.

When the engine 21 is operated at the time of the air column resonance being generated, and thus has an increased amount of exhaust gas flow more than the amount of the exhaust gas flow in the idling operation state, the receiving surface 91*a* of the swing plate 91 receives the exhaust gas flow and thus is swung to take the swing position at the downstream side of the vertical axis H.

At this time, as shown in FIG. 41, the projected top end portion of the upper projection portion 91*d* is in face-to-face relationship with the diameter expansion portion 95 to allow the passage cross-sectional area between the projected top end portion of the upper projection portion 91*d* and the diameter expansion portion 95 to be throttled to the extremely small level, so that the exhaust gas flow cannot pass through between the projected top end portion of the upper projection portion 91*d* and the diameter expansion portion 95.

This means that the gap between the upper projection portion 91*d* and the inner peripheral surface of the downstream portion 28B of the tail pipe 28 can be sufficiently throttled. In other words, the opening area of the opening portion 97 can be reduced, so that the reflection wave caused by the opening end reflection and the reflection wave caused by the closed end reflection are interfered with each other, thereby making it possible to suppress the sound pressure level caused by the air column resonance in the tail pipe 28 from being increased.

Due to the fact that the lower projection portion 91*b* of the swing plate 91 is constructed in the form of a curved shape along the swing locus C of the lower end portion of the receiving surface 91*a*, the passage cross-sectional area of the tail pipe 28 is maintained at a constant level, and the opening portion 97 having a constant opening area can be formed when the swing plate 91 is swung by the vibrations of the exhaust apparatus 20, and by the vehicle cruising on the slope and the like within the predetermined angular range at the time of the air column resonance being generated.

For this reason, even if the swing plate 91 is swung in the predetermined angular range at the time of the air column resonance being generated, the opening portion 97 can be maintained to have the constant opening area.

Therefore, the present embodiment can reliably suppress the air column resonance, and can prevent noises from being generated in response to the swing motions of the swing plate 91 at the time of the air column being generated.

According to the present embodiment, the passage cross-sectional areas between the projected top end portion of the lower projection portion 91*b* and the diameter expansion portions 95, 96 are variable in response to the swing positions of the swing plate 91 to ensure that the passage cross-sectional area is retained between the projected top end portion of the lower projection portion 91*b* and the diameter expansion portions 96 in the range from the idle rotation number with a small opening formed by the position of the swing plate 91 to the air column resonance rotation number. This makes it possible to pass the exhaust gas flow flowing in the tail pipe 28 through between the projected top end portion of the lower projection portion 91*h* and the diameter expansion portions 96 other than through the opening portion 97 having a small opening area.

For this reason, the present embodiment can increase the passage cross-sectional area of the exhaust gas passage allowing the exhaust gas to flow, and can suppress the sound of the exhaust gas flow from being generated.

On the other hand, the swing plate having no upper projection portion is swingably supported on and droops from the swing shaft to have only the receiving surface receive the exhaust gas flow.

In the case of the exhaust gas flow being received by the receiving surface below the swing shaft, the swing angle of the swing plate is set with the balancing relationship between a pressing force on the receiving surface by the exhaust gas flow and the own weight of the swing plate. The swing plate has an inertia, so that it is difficult to position the swing plate to the predetermined position where the air column resonance can be suppressed, and it is also difficult to make constant the opening ratio of the tail pipe 28 since the swings of the swing plate are generated at the time of the air column resonance being generated.

According to the present embodiment, the swing plate 91 is provided with the upper projection portion 91*d* upwardly projecting from the swing shaft 92, so that the upper projection portion 91*d* can be pressed by the exhaust gas flow W1 at the acceleration time of the vehicle as shown in FIG. 42. The pressing action of the exhaust gas flow W1 can reduce the inertias of the constitution elements of the swing plate 91 below the swing shaft 92, i.e., the receiving surface 91*a*, the lower projection portion 91*b*, and the side projection portions 91*c*.

For this reason, the swinging motions of the swing plate 91 can additionally be prevented from being generated in the state that the opening ratio of the tail pipe 28 is maintained constant at the time of the air column resonance being generated. As a consequence, it is possible to additionally suppress the sound pressure level caused by the air column resonance, and to prevent the noises from being generated in response to the swinging motions of the swing plate 91, thereby making it possible to suppress the noises from being generated.

Ninth Embodiment

Figure 43:
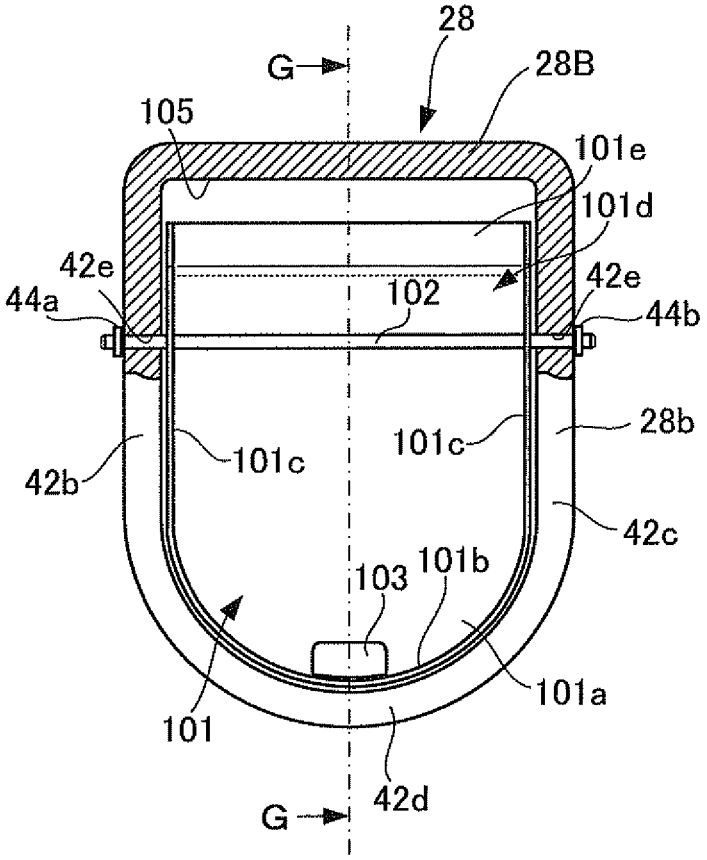
FIG. 43 shows a view of a ninth embodiment of the exhaust apparatus of the internal combustion engine according to the present invention, and is a front elevational view of the tail pipe as seen from the axial direction of the tail pipe.
Figure 44:
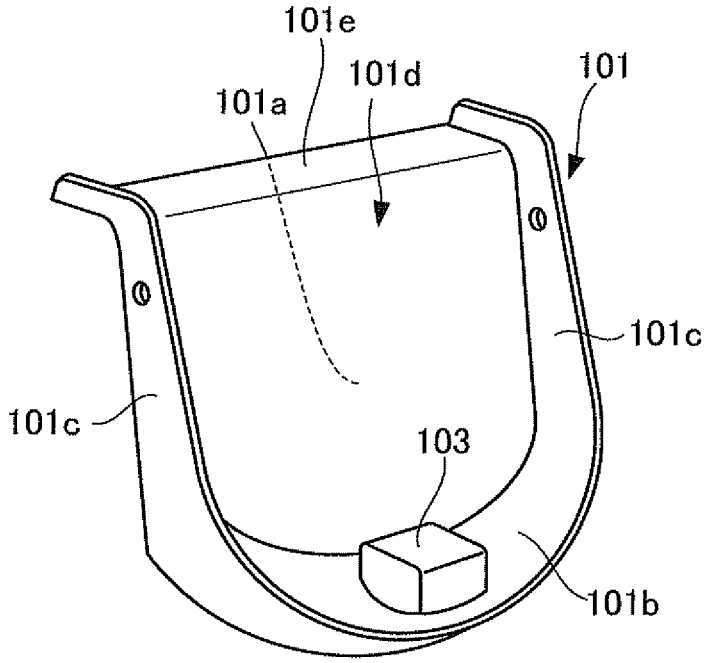
FIG. 44 shows a view of the ninth embodiment of the exhaust apparatus of the internal combustion engine according to the present invention, and is a perspective view of a swing plate.
Figure 48:
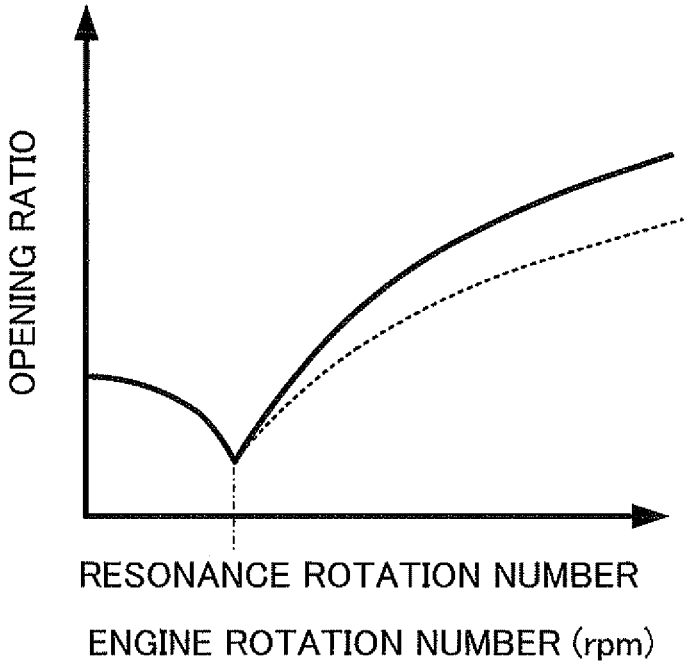
FIG. 48 shows a view of the ninth embodiment of the exhaust apparatus of the internal combustion engine according to the present invention, and is a view showing the relationship between the engine rotation numbers for the tail pipe having an opening property (solid line) having the swing plate without the inclination portion and for the tail pipe having an opening property (broken line) having the swing plate in the present embodiment, and the opening ratio of the tail pipe.
Figure 49:
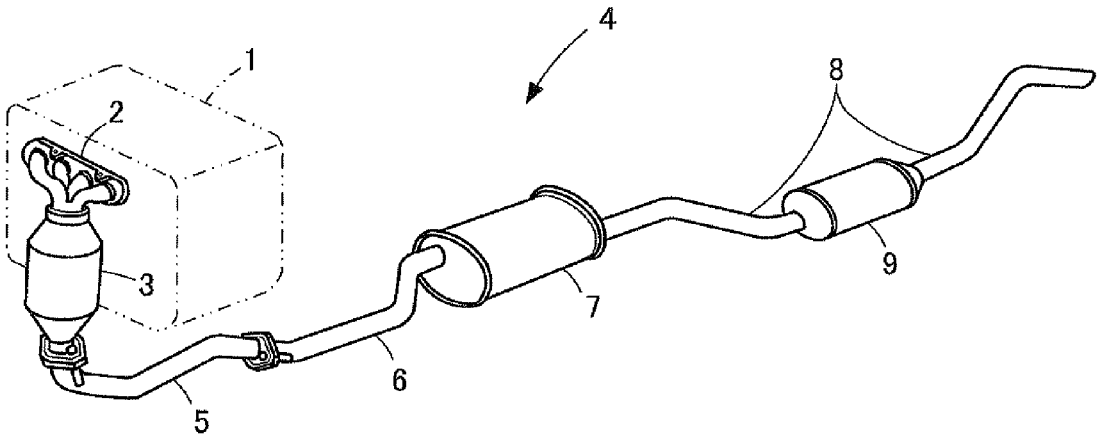
FIG. 49 shows a perspective construction view of a conventional exhaust apparatus of an internal combustion engine.
Figure 50:
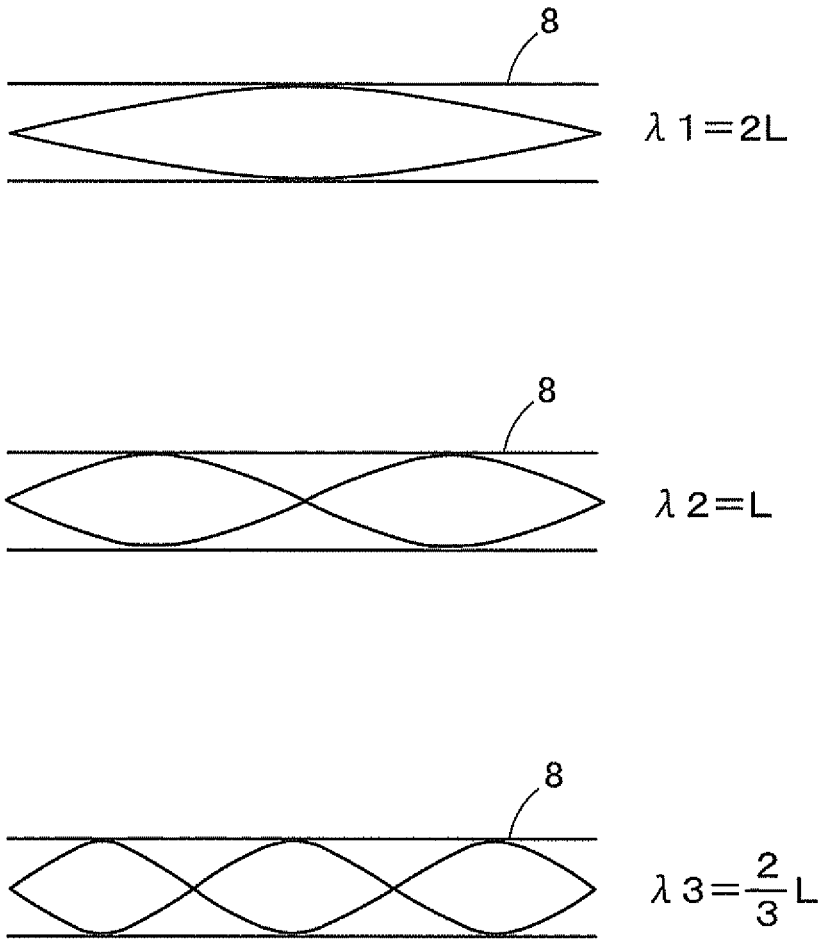
FIG. 50 shows views of the conventional exhaust apparatus of the internal combustion engine, and shows explanatory views for explaining standing waves in sound pressure distributions of air column resonances caused by an opening end reflection generated in the tail pipe.
Figure 51:
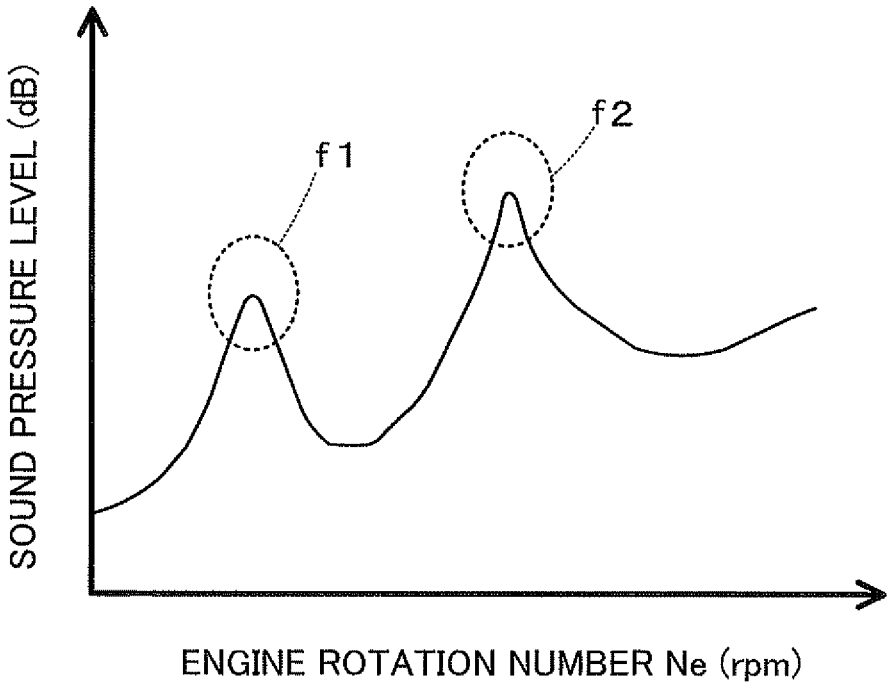
FIG. 51 shows the relationship between the sound pressure level of the conventional tail pipe and the engine rotation number.
Figure 52:
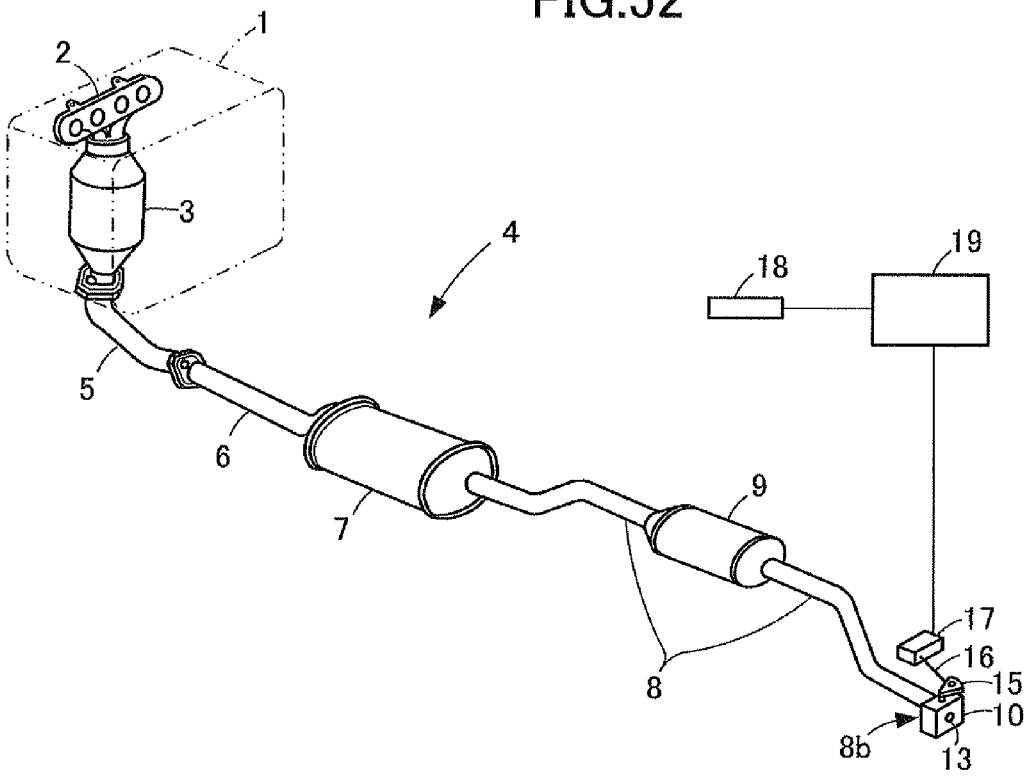
FIG. 52 shows a perspective construction view of the conventional exhaust apparatus of the internal combustion engine having another type of exhaust gas system.
Figure 53:
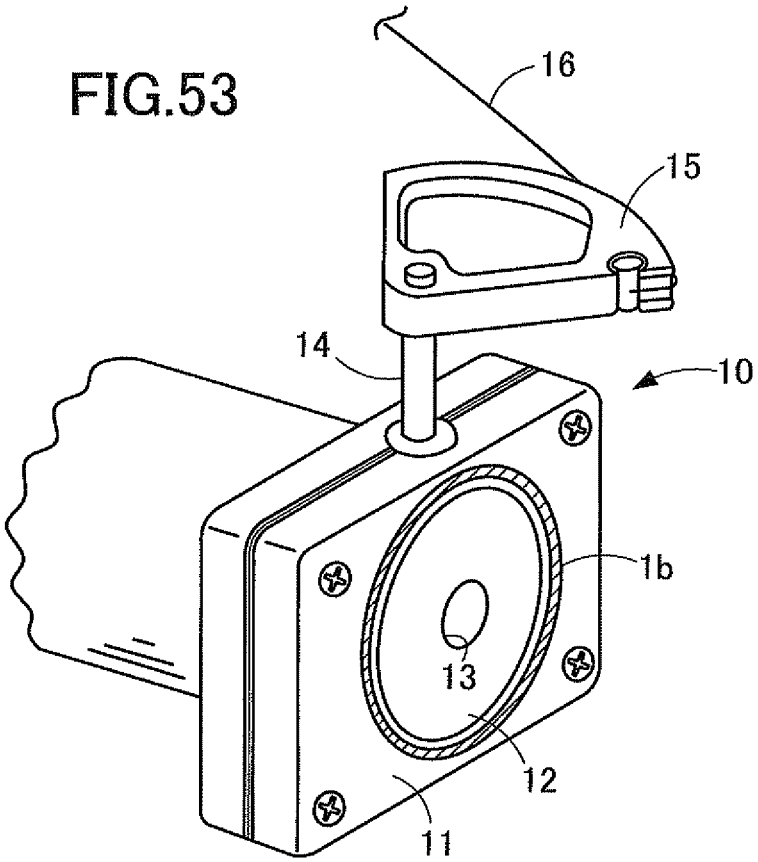
FIG. 53 shows a perspective view of a sound muting valve forming part of the exhaust gas system shown in FIG. 52.

FIGS. 43 and 48 show the ninth embodiment of the exhaust apparatus of the internal combustion engine according to the present invention. The constitution elements and parts of the ninth embodiment the same as the constitution elements and part of the first embodiment are illustrated with the reference numerals the same as the reference numerals of the first embodiment, and the detailed explanation about the ninth embodiment will be omitted hereinafter.

Figure 45:
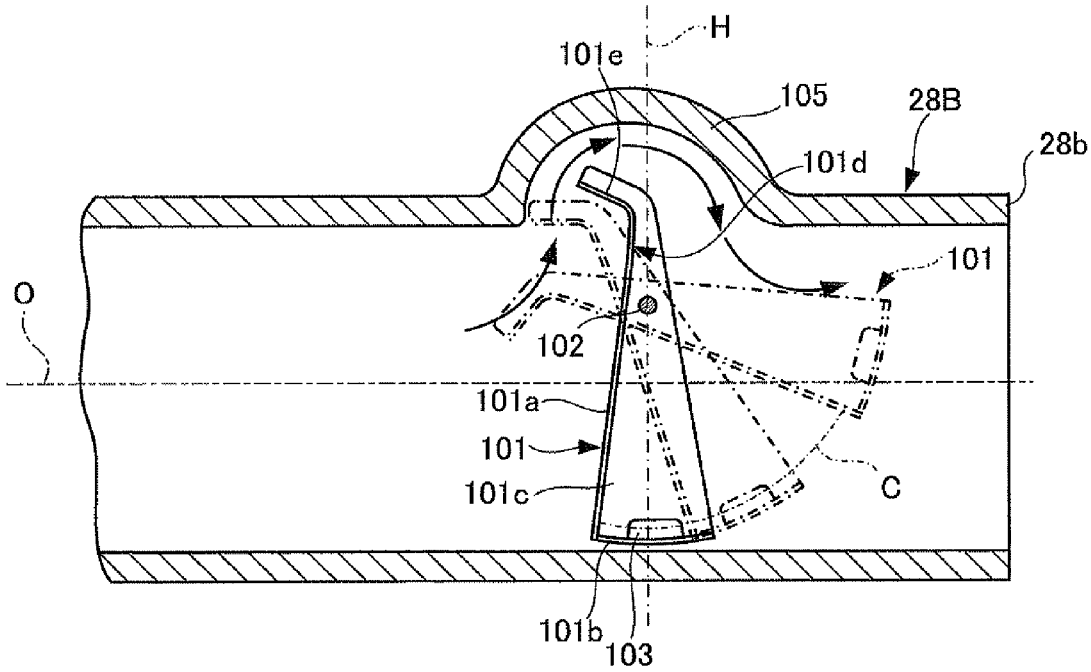
FIG. 45 shows a cross-sectional view of the tail pipe taken along and seen from the lines G-G in FIG. 43.

In FIGS. 43 and 45, the swing plate 101 serving as a valve body and having a receiving surface 101*a* for receiving the exhaust gas flow, a lower projection portion 101*b* projecting toward the downstream side of the exhaust gas flow from the lower end portion of the receiving surface 101*a* and serving as part of a throttle unit, and side projection portions 101*c* projecting toward the downstream side of the exhaust gas flow from the both widthwise end portions of the receiving surface 101*a* and serving as a guide portion.

The side projection portions 101*c* of the swing plate 101 have a swing shaft 102 pass therethrough, and the swing shaft 102 perpendicularly extends with respect to the center axis O of the tail pipe 28. The swing shaft 102 is spaced apart from the inner upper portion of the tail pipe 28 toward the center axis O of the tail pipe 28, and is swingably supported on the tail pipe 28 above the center axis O of the tail pipe 28.

The lower projection portion 101*b* has a weight 103 mounted thereon. The swing plate 101 has a gravity center set to take an initial swing position where the receiving surface 101*a* is inclined toward the upstream side of the vertical axis H in response to the increased mass of the weight 103. Further, the swing plate 101 is, as shown in FIG. 46, set to take another swing position where the receiving surface 101*a* is inclined toward the downstream side of the vertical axis H when the receiving surface 101*a* receives the exhaust gas flow at the time of the air column resonance rotation number.

The lower projection portion 101*b* of the swing plate 101 is curved, more specifically in the form of a shape curved along the swing locus C of the lower end portion of the receiving surface 101*a* when the swing plate 101 is swung.

Figure 46:
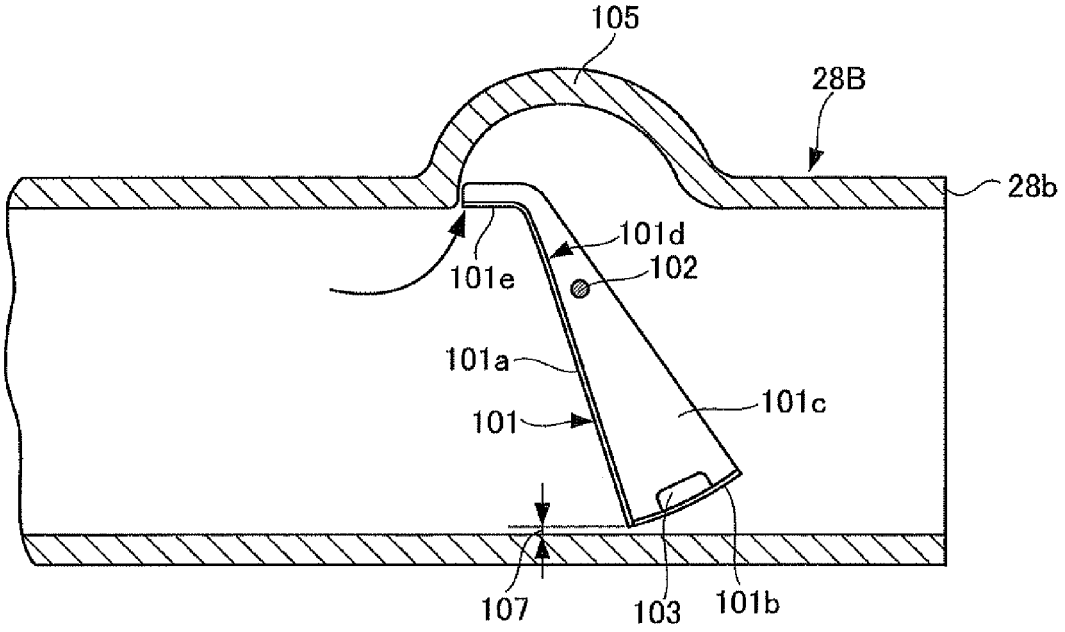
FIG. 46 shows a view of the ninth embodiment of the exhaust apparatus of the internal combustion engine according to the present invention, and is a cross-sectional view showing the state of the swing plate at the time of air column resonance rotation time.

When the swing plate 101 is swung in the predetermined angular range, the lower projection portion 101*b* and the inner peripheral surface of the downstream portion 28B of the tail pipe 28 allow the gap therebetween to be constant, thereby forming an opening portion 107 having a constant opening ratio between the lower projection portion 101*b* and the inner peripheral surface of the downstream portion 28B of the tail pipe 28 (see FIG. 46).

The swing plate 101 has an upper projection portion 101*d* upwardly projecting from the receiving surface 101*a*, viz., from the swing shaft 102. The upper projection portion 101*d* has an inclination portion 101*e* which is inclined toward the upstream side when the swing plate 101 is positioned in the vertical state.

The upper portion of the tail pipe 28 is formed with a diameter expansion portion (upper diameter expansion portion) 105. The diameter expansion portion 105 serves to allow the gap between the projected top end portion of the upper projection portion 101*d* and the diameter expansion portion 105 to be variable, so that the passage cross-sectional area between the projected top end portion of the upper projection portion 101*d* and the diameter expansion portion 105 can be varied in response to the swing positions of the swing plate 101.

More specifically, the swing plate 101 is set to take the initial position where the receiving surface 101*a* is inclined toward the upstream side of the vertical axis H when the engine rotation number is equal to the idle rotation number. Under this state, the projected top end portion of the upper projection portion 101*d* is spaced apart from the diameter expansion portion 105 and in face-to-face relationship with the diameter expansion portion 105 to allow the passage cross-sectional area between the projected top end portion of the inclination portion 101*e* and the diameter expansion portion 105 to be widened (see FIG. 45).

When the engine rotation number is equal to the air column resonance rotation number, the swing plate 101 is set to take the predetermined swing position where the receiving surface 101*a* receives the exhaust gas flow and is thus inclined toward the downstream side of the vertical axis H. Under this state, the projected top end portion of the inclination portion 101*e* is in the vicinity of the diameter expansion portion 105 and in face-to-face relationship with the diameter expansion portion 105 to allow the passage cross-sectional area between the projected top end portion of the inclination portion 101*e* and the diameter expansion portion 105 to be throttled to an extremely small level (see FIG. 46). This means that the swing plate 101 is set from the idle rotation time to the air column resonance rotation time to allow the passage cross-sectional area between the projected top end portion of the upper projection portion 101*d* and the diameter expansion portion 105 to remain widened.

Further, the swing plate 101 is constructed to take the predetermined swing position where the receiving surface 101*a* receives a large amount of the exhaust gas flow and is thus inclined toward the downstream side of the vertical axis H when the engine rotation number exceeds the air column rotation number. Under this state, the projected top end portion of the inclination portion 101*e* is moved toward the center axis O from the position where the projected top end portion of the inclination portion 101*e* is in face-to-face relationship with the diameter expansion portion 105 to allow the passage area of the tail pipe 28 to be more widened (see FIG. 47).

Next, the operation of the ninth embodiment will be described hereinafter.

At the idle rotation time when the tail pipe 28 has a small amount of the exhaust gas flow, the receiving surface 101*a* of the swing plate 101 receives the exhaust gas flow and is thus swung toward the upstream side with of the vertical axis H to take the initial position. At this time, the passage of the exhaust gas is secured between the diameter expansion portion 105 and the inclination portion 101*e*, thereby making it possible to prevent the back pressure from being increased at the idle rotation time.

At the air column resonance rotation time when the tail pipe 28 has the amount of the exhaust gas flow more increased than at the time of the idle rotation time, the receiving surface 101*a* of the swing plate 101 receives the exhaust gas flow and is thus swung toward the downstream side of the vertical axis H.

At this time, as shown in FIG. 46, the projected top end portion of the inclination portion 101*e* comes to be in the vicinity of and in face-to-face relationship with the diameter expansion portion 105 to allow the passage cross-sectional area between the projected top end portion of the inclination portion 101*e* and the diameter expansion portion 105 to be throttled to the extremely small level, so that the exhaust gas flow cannot pass through between the projected top end portion of the inclination portion 101*e* and the diameter expansion portion 105.

This means that the gap between the lower projection portion 101*b* and the inner peripheral surface of the downstream portion 28B of the tail pipe 28 can be sufficiently throttled. In other words, the opening area of the opening portion 107 can be reduced, so that the reflection wave caused by the opening end reflection and the reflection wave caused by the closed end reflection are interfered with each other, thereby making it possible to suppress the sound pressure level caused by the air column resonance in the tail pipe 28 from being increased.

Due to the fact that the lower projection portion 101*b* of the swing plate 101 has a curved surface formed along a swing locus extending on the swing locus C of the lower end portion of the receiving surface 101*a*, the passage cross-sectional area of the tail pipe 28 is maintained at a constant level, and the opening portion 107 having a constant opening area can be formed even when the swing plate 101 is swung by the vibrations of the exhaust apparatus 20, and by the vehicle cruising on the slope and the like within the predetermined angular range at the time of the air column resonance being generated.

For this reason, the swinging motions of the swing plate 101 can additionally be prevented from being generated in the state that the opening ratio of the tail pipe 28 is maintained constant at the time of the air column resonance being generated. As a consequence, it is possible to additionally suppress the sound pressure level caused by the air column resonance from being increased, and to prevent the noises from being generated in response to the swinging motions of the swing plate 101, thereby making it possible to suppress the noises.

On the other hand, in the case that the swing plate 101 is provided with the weight 103 to have the swing angle of the swing plate 101 reduced with respect to the vertical axis H for the purpose of reducing the opening ratio of the opening portion 107 at the time of the air column being generated, the swing plate 101 receives a force to have the swing plate 101 swung toward the upstream side by the own weight of the swing plate 101 when the swing plate 101 receives the exhaust gas flow at the acceleration time of the vehicle.

For this end, when the engine rotation number becomes increased in excess of the air column resonance rotation number as shown by the broken lines in FIG. 48, the opening ratio (valve opening degree) of the tail pipe 101 cannot be increased, thereby leading to increasing the back pressure of the exhaust gas flow, and thus causing fears of deteriorating the exhaust gas property.

Figure 47:
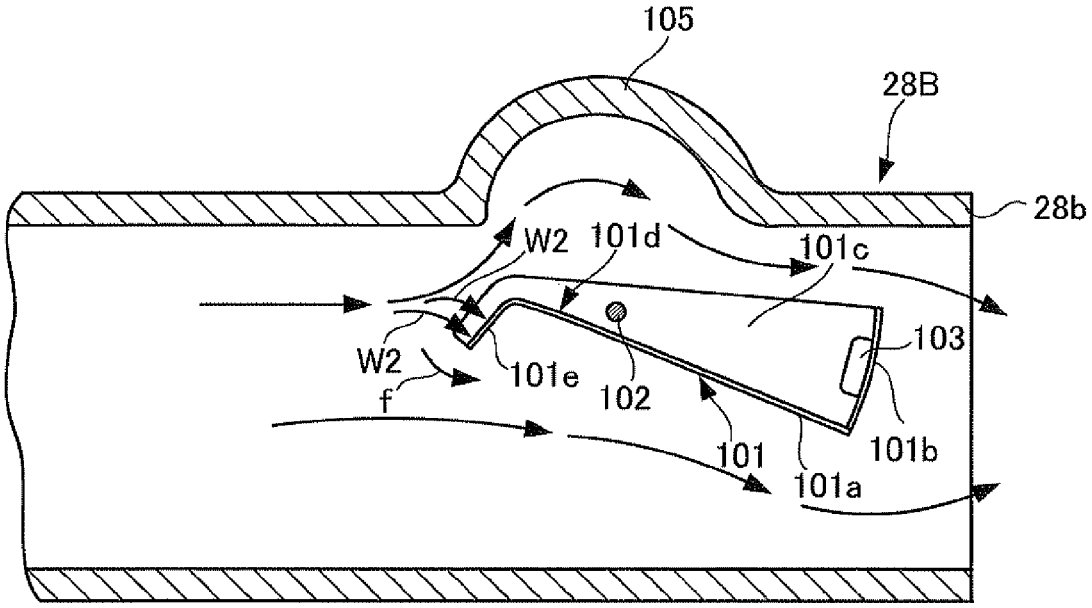
FIG. 47 shows a view of the ninth embodiment of the exhaust apparatus of the internal combustion engine according to the present invention, and is a cross-sectional view showing the state of the swing plate at the time of the engine rotation number exceeding the air column resonance rotation number.

According to the present embodiment, the upper projection portion 101*d* has an inclination portion 101*e* which is inclined toward the upstream side when the swing plate 101 is in the vertical state, so that the exhaust gas flow W2 can be collided with the inclination portion 101*e* of the upper projection portion 101*d* when the swing plate 101 receives the exhaust gas flow and is thus swung to the large swing angle at the high rotation time of the engine 21 allowing the tail pipe 28 to have a large amount of exhaust gas flow as shown in FIG. 47.

Therefore, it is possible to apply to the swing plate 101*a* rotation force (assist force) "f" to increase the opening degree of the swing plate 101 around the swing shaft 102. As a consequence, it is possible to increase the opening degree of the swing plate 101 shown by the solid line in FIG. 48 with respect to the opening degree shown in the broken line in FIG. 48 at the high rotation time of the engine 21.

According to the present embodiment, the swing shaft 102 is toward, viz., close to the center axis O of the tail pipe 28, and the upper projection portion 101*d* is formed with the inclination portion 101*e*, so that the opening degree of the swing plate 101 can be increased by slightly deforming the swing plate 101 to be simple in construction. This makes it possible to reduce the pressure loss of the exhaust gas flow, and to suppress the back pressure of the exhaust gas flow from being increased at the time of the high rotation of the engine 21.

In the previously mentioned embodiments, the swing plates 41, 51, 55, 81, 91, 101 are provided only at the downstream portion 2813 of the tail pipe 28, however, the swing plates 41, 51, 55, 81, 91, 101 may be provided only at the upstream portion 28A of the tail pipe 28.

Further, the swing plates 41, 51, 55, 81, 91, 101 may be provided at both of the upstream portion 28A and the downstream portion 28B of the tail pipe 28.

Each of the previously mentioned embodiments has been raised as an example for explaining the invention, and thus the present invention is not limited to these embodiments. The scope of the present invention is required to be construed based on the claims. All the modifications, the alterations and the equivalents should be included within the scope of the invention defined by the claims.

As has been explained in the above description, the exhaust apparatus of the internal combustion engine according to the present invention has such an excellent advantage that the exhaust apparatus is simple in construction with no need for complicated controls while reducing the increased weight and the increased production cost of the exhaust apparatus, and is capable of suppressing the sound pressure level caused by the air column resonance in the tail pipe from being increased. The exhaust apparatus of the internal combustion engine according to the present invention is useful as an exhaust apparatus of an internal combustion engine which can suppress the sound pressure level caused by the air column resonance from being increased in the tail pipe provided at the most downstream of the exhaust gas direction of the exhaust gas.

REFERENCE SIGNS LIST

20 exhaust apparatus
21 engine (internal combustion engine)
27 muffler (sound muting device)
28 tail pipe
28A upstream portion (one end portion)
28B downstream portion (the other end portion)
28*a* upstream opening portion
28*b* downstream opening portion
41, 51, 55, 81, 91, 101 swing plate (valve body)
41*b*, 51*b*, 55*b*, 81*b*, 91*b*, 101*b* lower projection portion (projection portion, throttle unit)
41*c*, 51*c*, 55*c*, 81*c*, 91*c*, 101*c* side projection portion (guide portion)
43, 54, 60, 82, 92, 102 swing shaft
52 curved portion (throttle unit)
55*d* base section
55*e* front section (guide projection portion in the downstream side in the exhaust gas direction)
59 projection portion (throttle unit)
66, 71, 76, 77 diameter expansion portion (lower diameter expansion portion)
84 curved projection portion
91*d*, 101*d* upper projection portion
95, 96, 105 diameter expansion portion (upper diameter expansion portion)
101*e* inclination portion

The invention claimed is:

1. An exhaust gas apparatus of an internal combustion engine, provided with an exhaust gas pipe at the downstream side of an internal combustion engine in the exhaust gas direction of an exhaust gas flow, the exhaust gas pipe having an upstream opening end at one end portion thereof and connected with a sound deadening device at the upstream side in the exhaust gas direction of the exhaust gas flow, and a downstream opening end at the other end portion thereof for exhausting the exhaust gas flow to the atmosphere, the exhaust gas apparatus comprises;

a valve body having a swing shaft connected with the exhaust gas pipe to perpendicularly extend with respect to the center axis of the exhaust gas pipe and to be positioned outwardly of the center axis of the exhaust gas pipe and spaced apart from the center axis of the exhaust gas pipe, the valve body being adapted to receive only the exhaust gas flow flowing in the exhaust gas pipe and to be swingable around the center axis of the swing shaft to allow the passage cross-sectional area of the exhaust gas pipe to be varied, in which the valve body is formed with a pair of guide portions at the both widthwise end portions of the valve body perpendicularly extending to the center axis of the exhaust gas pipe, the guide portions projecting from the both widthwise end portions of the valve body toward the downstream side of the exhaust gas direction of the exhaust gas flow, and a throttle unit for throttling the passage cross-sectional area of the exhaust gas pipe to a predetermined passage cross-sectional area when the valve body receives the flow amount of the exhaust gas flow flowing in the exhaust gas pipe in response to the operation state of the internal combustion engine to be swung around the center axis of the swing shaft in the case of an air column resonance being generated in the exhaust gas pipe, in which the throttle unit is constituted by at least part of a projection portion provided at the lower end portion of the valve body to project from the lower end portion of the valve body toward the downstream side of the exhaust gas direction of the exhaust gas flow.

2. The exhaust gas apparatus of the internal combustion engine as set forth in claim 1, in which the throttle unit is constituted by a projection base end portion forming part of the projection portion, the initial position of the valve body being set to be inclined toward the upstream side of the exhaust gas direction of the exhaust gas flow with respect to the vertical direction, the throttle unit having a section forming part of the projection portion extending from the projection base end portion toward the downstream side of the exhaust gas direction of the exhaust gas flow, the section of the projection portion allowing the passage cross-sectional area of the exhaust gas pipe to be larger than the predetermined passage cross-sectional area at the time of an air column resonance being generated in the exhaust gas pipe.

3. The exhaust gas apparatus of the internal combustion engine as set forth in claim 1, in which the projection portion has a curved shape along the swing locus of the lower portion of the valve body when the valve body is swung, the passage cross-sectional area of the exhaust gas pipe being throttled to the predetermined passage cross-sectional area when the valve body is in a predetermined swing range.

4. An exhaust gas apparatus of an internal combustion engine, provided with an exhaust gas pipe at the downstream side of an internal combustion engine in the exhaust gas direction of an exhaust gas flow, the exhaust gas pipe having an upstream opening end at one end portion thereof and connected with a sound deadening device at the upstream side in the exhaust gas direction of the exhaust gas flow, and a downstream opening end at the other end portion thereof for exhausting the exhaust gas flow to the atmosphere, the exhaust gas apparatus comprises;

a valve body having a swing shaft connected with the exhaust gas pipe to perpendicularly extend with respect to the center axis of the exhaust gas pipe and to be positioned outwardly of the center axis of the exhaust gas pipe and spaced apart from the center axis of the exhaust gas pipe, the valve body being adapted to receive only the exhaust gas flow flowing in the exhaust gas pipe and to be swingable around the center axis of the swing shaft to allow the passage cross-sectional area of the exhaust gas pipe to be varied, and a throttle unit for throttling the passage cross-sectional area of the exhaust gas pipe to a predetermined passage cross-sectional area when the valve body receives the flow amount of the exhaust gas flow flowing in the exhaust gas pipe in response to the operation state of the internal combustion engine to be swung around the center axis of the swing shaft in the case of an air column resonance being generated in the exhaust gas pipe, in which the throttle unit is constituted by a protrusion portion projecting toward the center axis of the exhaust gas pipe from the inner peripheral lower portion of the exhaust gas pipe, the initial position of the valve body being set to be positioned on a vertical line with respect to the exhaust gas direction of the exhaust gas flow, the protrusion portion being brought into face-to-face relationship with the lower end portion of the valve body to throttle the passage cross-sectional area of the exhaust gas pipe to the predetermined passage cross-sectional area when the valve body is swung from the initial position toward the downstream side of the exhaust gas direction of the exhaust gas flow.

5. An exhaust gas apparatus of an internal combustion engine, provided with an exhaust gas pipe at the downstream side of an internal combustion engine in the exhaust gas direction of an exhaust gas flow, the exhaust gas pipe having an upstream opening end at one end portion thereof and connected with a sound deadening device at the upstream side in the exhaust gas direction of the exhaust gas flow, and a downstream opening end at the other end portion thereof for exhausting the exhaust gas flow to the atmosphere, the exhaust gas apparatus comprises;

a valve body having a swing shaft connected with the exhaust gas pipe to perpendicularly extend with respect to the center axis of the exhaust gas pipe and to be positioned outwardly of the center axis of the exhaust gas pipe and spaced apart from the center axis of the exhaust gas pipe, the valve body being adapted to receive only the exhaust gas flow flowing in the exhaust gas pipe and to be swingable around the center axis of the swing shaft to allow the passage cross-sectional area of the exhaust gas pipe to be varied, and a throttle unit for throttling the passage cross-sectional area of the exhaust gas pipe to a predetermined passage cross-sectional area when the valve body receives the flow amount of the exhaust gas flow flowing in the exhaust gas pipe in response to the operation state of the internal combustion engine to be swung around the center axis of the swing shaft in the case of an air column resonance being generated in the exhaust gas pipe, in which the throttle unit is partly constituted by a curved portion formed on the inner peripheral lower portion of the exhaust gas pipe to be curved along the swing locus of the lower portion of the valve body when the valve body is swung, the passage cross-sectional area of the exhaust gas pipe being throttled to the predetermined passage cross-sectional area by the curved portion when the valve body is in the predetermined swing range.

6. The exhaust gas apparatus of the internal combustion engine as set forth in claim 1, in which the lower portion of the exhaust gas pipe is formed with a lower diameter expansion portion at the downstream side of the exhaust gas direction of the exhaust gas flow with respect to the valve body, the valve body and the lower diameter expansion portion allowing the passage cross-sectional area of the exhaust gas pipe to be increased when the valve body is swung from the swing position at the time of the air column resonance being generated to the direction in which the passage cross-sectional area of the exhaust gas pipe is increased.

7. The exhaust gas apparatus of the internal combustion engine as set forth in claim 1, in which the swing shaft is positioned radially outwardly of the inner surface of the exhaust gas pipe at the upstream side of the exhaust gas direction of the exhaust gas flow with respect to the valve body.

8. The exhaust gas apparatus of the internal combustion engine as set forth in claim 1, in which the throttle unit is partly constituted by a curved projection portion curved to project toward the center axis of the exhaust gas pipe from the inner peripheral upper portion of the exhaust gas pipe at the inner peripheral upper portion of the upstream side of the exhaust gas direction of the exhaust gas flow with respect to the swing shaft, the curved projection portion allowing the exhaust gas flow flowing toward the swing shaft to be guided to the section of the valve body below the swing shaft.

9. The exhaust gas apparatus of the internal combustion engine as set forth in claim 1, in which the swing shaft is spaced apart from the inner peripheral upper portion of the exhaust gas pipe toward the center axis of the exhaust gas pipe, the valve body having an upper projection portion upwardly projecting from the swing shaft, the upper portion of the exhaust gas pipe being formed with a diameter expansion portion expanded toward the upper projection portion, the passage cross-sectional area between the forward end of the upper projection portion and the inner peripheral surface of the diameter expansion portion being variable in response to the swing motion of the valve body.

10. The exhaust gas apparatus of the internal combustion engine as set forth in claim 9, in which the upper projection portion has an inclination portion inclined toward the upstream side of the exhaust gas direction of the exhaust gas flow in the state of the valve body being positioned to vertically extend.

11. The exhaust gas apparatus of the internal combustion engine as set forth in claim 1, in which the valve body is provided at least one of one end portion and the other end portion of the exhaust gas pipe.

12. The exhaust gas apparatus of the internal combustion engine as set forth in claim 4, in which the lower portion of the exhaust gas pipe is formed with a lower diameter expansion portion at the downstream side of the exhaust gas direction of the exhaust gas flow with respect to the valve body, the valve body and the lower diameter expansion portion allowing the passage cross-sectional area of the exhaust gas pipe to be increased when the valve body is swung from the swing position at the time of the air column resonance being generated to the direction in which the passage cross-sectional area of the exhaust gas pipe is increased.

13. The exhaust gas apparatus of the internal combustion engine as set forth in claim 4, in which the swing shaft is positioned radially outwardly of the inner surface of the exhaust gas pipe at the upstream side of the exhaust gas direction of the exhaust gas flow with respect to the valve body.

14. The exhaust gas apparatus of the internal combustion engine as set forth in claim 4, in which the throttle unit is partly constituted by a curved projection portion curved to project toward the center axis of the exhaust gas pipe from the inner peripheral upper portion of the exhaust gas pipe at the inner peripheral upper portion of the upstream side of the exhaust gas direction of the exhaust gas flow with respect to the swing shaft, the curved projection portion allowing the exhaust gas flow flowing toward the swing shaft to be guided to the section of the valve body below the swing shaft.

15. The exhaust gas apparatus of the internal combustion engine as set forth in claim 4, in which the swing shaft is spaced apart from the inner peripheral upper portion of the exhaust gas pipe toward the center axis of the exhaust gas pipe, the valve body having an upper projection portion upwardly projecting from the swing shaft, the upper portion of the exhaust gas pipe being formed with a diameter expansion portion expanded toward the upper projection portion, the passage cross-sectional area between the forward end of the upper projection portion and the inner peripheral surface of the diameter expansion portion being variable in response to the swing motion of the valve body.

16. The exhaust gas apparatus of the internal combustion engine as set forth in claim 15, in which the upper projection portion has an inclination portion inclined toward the upstream side of the exhaust gas direction of the exhaust gas flow in the state of the valve body being positioned to vertically extend.

17. The exhaust gas apparatus of the internal combustion engine as set forth in claim 4, in which the valve body is provided at least one of one end portion and the other end portion of the exhaust gas pipe.

18. The exhaust gas apparatus of the internal combustion engine as set forth in claim 5, in which the lower portion of the exhaust gas pipe is formed with a lower diameter expansion portion at the downstream side of the exhaust gas direction of the exhaust gas flow with respect to the valve body, the valve body and the lower diameter expansion portion allowing the passage cross-sectional area of the exhaust gas pipe to be increased when the valve body is swung from the swing position at the time of the air column resonance being generated to the direction in which the passage cross-sectional area of the exhaust gas pipe is increased.

19. The exhaust gas apparatus of the internal combustion engine as set forth in claim 5, in which the swing shaft is positioned radially outwardly of the inner surface of the exhaust gas pipe at the upstream side of the exhaust gas direction of the exhaust gas flow with respect to the valve body.

20. The exhaust gas apparatus of the internal combustion engine as set forth in claim 5, in which the throttle unit is partly constituted by a curved projection portion curved to project toward the center axis of the exhaust gas pipe from the inner peripheral upper portion of the exhaust gas pipe at the inner peripheral upper portion of the upstream side of the exhaust gas direction of the exhaust gas flow with respect to the swing shaft, the curved projection portion allowing the exhaust gas flow flowing toward the swing shaft to be guided to the section of the valve body below the swing shaft.

21. The exhaust gas apparatus of the internal combustion engine as set forth in claim 5, in which the swing shaft is spaced apart from the inner peripheral upper portion of the exhaust gas pipe toward the center axis of the exhaust gas pipe, the valve body having an upper projection portion upwardly projecting from the swing shaft, the upper portion of the exhaust gas pipe being formed with a diameter expansion portion expanded toward the upper projection portion, the passage cross-sectional area between the forward end of the upper projection portion and the inner peripheral surface of the diameter expansion portion being variable in response to the swing motion of the valve body.

22. The exhaust gas apparatus of the internal combustion engine as set forth in claim 21, in which the upper projection portion has an inclination portion inclined toward the upstream side of the exhaust gas direction of the exhaust gas flow in the state of the valve body being positioned to vertically extend.

23. The exhaust gas apparatus of the internal combustion engine as set forth in claim 5, in which the valve body is provided at least one of one end portion and the other end portion of the exhaust gas pipe.

* * * * *